US009384636B2

(12) United States Patent
Cannon

(10) Patent No.: US 9,384,636 B2
(45) Date of Patent: Jul. 5, 2016

(54) MULTI-PLAYER BINGO GAME WITH MULTIPLE CARDS PER PLAYER

(71) Applicant: IGT, Las Vegas, NV (US)

(72) Inventor: Lee E. Cannon, Bozeman, MT (US)

(73) Assignee: IGT, Las Vegas, NV (US)

( * ) Notice: Subject to any disclaimer, the term of this patent is extended or adjusted under 35 U.S.C. 154(b) by 0 days.

(21) Appl. No.: 14/741,104

(22) Filed: Jun. 16, 2015

(65) Prior Publication Data

US 2015/0279163 A1 Oct. 1, 2015

Related U.S. Application Data

(60) Division of application No. 13/863,999, filed on Apr. 16, 2013, now Pat. No. 9,105,159, which is a continuation of application No. 10/941,388, filed on Sep. 15, 2004, now Pat. No. 8,430,738.

(60) Provisional application No. 60/503,161, filed on Sep. 15, 2003.

(51) Int. Cl.

| | |
|---|---|
| ***G07F 17/00*** | (2006.01) |
| ***G07F 17/32*** | (2006.01) |
| ***G07F 17/34*** | (2006.01) |

(52) U.S. Cl.

CPC ..... *G07F 17/3276* (2013.01); *G07F 17/329* (2013.01); *G07F 17/3213* (2013.01); *G07F 17/3225* (2013.01); *G07F 17/3267* (2013.01); *G07F 17/3286* (2013.01); *G07F 17/34* (2013.01)

(58) Field of Classification Search

CPC .. G07F 17/3276; G07F 17/3286; G07F 17/34
USPC ..... 463/16
See application file for complete search history.

(56) References Cited

U.S. PATENT DOCUMENTS

| | | | |
|---|---|---|---|
| 4,213,616 | A | 7/1980 | Dickey |
| 4,332,389 | A | 6/1982 | Loyd, Jr. et al. |

(Continued)

FOREIGN PATENT DOCUMENTS

| | | |
|---|---|---|
| EP | 0 769 769 A1 | 4/1997 |
| EP | 1 199 690 | 4/2002 |

(Continued)

OTHER PUBLICATIONS

EP Communication dated Jul. 26, 2006 from EP Application No. 04783938.6.

(Continued)

*Primary Examiner* — Reginald Renwick
(74) *Attorney, Agent, or Firm* — Neal, Gerber & Eisenberg LLP

(57) ABSTRACT

The invention is directed to methods and gaming units for conducting a multi-player wagering game in which at least one of the players may win the occurrence of the wagering game by matching a game-winning pattern of game indicia on one or more game arrays having unique combinations of game indicia based on matching the game indicia on the game arrays to game indicia randomly selected for the occurrence of the wagering game. Each player matching a game-winning pattern may receive game-winning award, and may receive a game-winning award for each game array on which a game-winning pattern is matched. The method and gaming unit may further include an alternate outcome display wherein an outcome of a second wagering game may be displayed that corresponds to the outcome for the player on the one or more game arrays for the occurrence of the multi-player wagering game.

9 Claims, 36 Drawing Sheets

(56) References Cited

U.S. PATENT DOCUMENTS 4,365,810 A 12/1982 Richardson
4,373,726 A 2/1983 Churchill et al.
4,455,025 A 6/1984 Itkis
4,624,462 A 11/1986 Itkis
4,798,387 A 1/1989 Richardson
4,842,278 A 6/1989 Markowicz et al.
4,848,771 A 7/1989 Richardson
4,856,787 A 8/1989 Itkis et al.
5,007,649 A 4/1991 Richardson
5,050,880 A 9/1991 Sloan et al.
5,145,182 A 9/1992 Swift et al.
5,242,163 A 9/1993 Fulton et al.
5,275,400 A 1/1994 Weingardt et al.
5,282,620 A 2/1994 Keesee et al.
5,297,802 A 3/1994 Pocock et al.
5,351,970 A 10/1994 Fioretti et al.
5,393,057 A 2/1995 Marnell et al.
5,393,061 A 2/1995 Manship et al.
5,407,199 A 4/1995 Gumina et al.
5,476,259 A 12/1995 Weingardt et al.
5,482,289 A 1/1996 Weingardt et al.
5,542,669 A 8/1996 Charron et al.
5,564,700 A 10/1996 Celona et al.
5,580,309 A 12/1996 Piechowiak et al.
5,639,088 A 6/1997 Schneider et al.
5,645,486 A 7/1997 Nagao et al.
5,647,798 A 7/1997 Falciglia
5,697,843 A 12/1997 Manship et al.
5,720,483 A 2/1998 Trinh et al.
5,755,619 A 5/1998 Matsumoto et al.
5,762,552 A 6/1998 Vuong et al.
5,775,692 A 7/1998 Watts et al.
5,779,547 A 7/1998 SoRelle et al.
5,788,573 A 8/1998 Baerlocher et al.
5,833,537 A 11/1998 Barrie
5,833,540 A 11/1998 Miodunski et al.
5,848,932 A 12/1998 Adams et al.
5,851,149 A 12/1998 Xidos et al.
5,855,515 A 1/1999 Pease et al.
5,876,283 A 3/1999 Parra et al.
5,944,606 A 8/1999 Gerow et al.
5,951,011 A 9/1999 Potter et al.
5,951,396 A 9/1999 Tawil
5,984,779 A 11/1999 Bridgeman et al.
6,012,984 A 1/2000 Roseman
6,017,032 A 1/2000 Grippo et al.
6,062,980 A 5/2000 Luciano
6,062,981 A 5/2000 Luciano
6,079,711 A 6/2000 Wei et al.
6,093,100 A 7/2000 Singer et al.
6,110,043 A 8/2000 Olsen
6,142,872 A 11/2000 Walker et al.
6,146,272 A 11/2000 Walker et al.
6,149,156 A 11/2000 Feola et al.
6,155,925 A 12/2000 Giobbi et al.
6,159,095 A 12/2000 Frohm et al.
6,168,521 B1 1/2001 Luciano et al.
6,183,361 B1 2/2001 Cummings et al.
6,206,782 B1 3/2001 Walker et al.
6,210,275 B1 4/2001 Olsen
6,210,276 B1 4/2001 Mullins
6,213,877 B1 4/2001 Walker et al.
6,217,448 B1 4/2001 Olsen
6,224,483 B1 5/2001 Mayeroff
6,224,484 B1 5/2001 Okuda et al.
6,231,445 B1 5/2001 Acres
6,238,288 B1 5/2001 Walker et al.
6,257,980 B1 7/2001 Santini, Jr.
6,270,412 B1 8/2001 Crawford et al.
6,280,325 B1 8/2001 Fisk
6,309,298 B1 10/2001 Gerow
6,312,332 B1 11/2001 Walker et al.
6,319,125 B1 11/2001 Acres
6,361,441 B1 3/2002 Walker et al.
6,375,567 B1 4/2002 Acres
6,375,569 B1 4/2002 Acres
6,386,977 B1 5/2002 Hole
6,398,218 B1 6/2002 Vancura
6,398,645 B1 6/2002 Yoseloff
6,419,583 B1 7/2002 Crumby et al.
6,454,648 B1 9/2002 Kelly et al.
6,471,591 B1 10/2002 Crumby
6,494,454 B2 12/2002 Adams
6,524,185 B2 2/2003 Lind
6,537,150 B1 3/2003 Luciano et al.
6,569,017 B2 5/2003 Enzminger et al.
6,582,307 B2 6/2003 Webb
6,585,590 B2 * 7/2003 Malone ..... 463/19
6,599,187 B2 7/2003 Gerow
6,609,973 B1 8/2003 Weiss
6,612,927 B1 9/2003 Slomiany et al.
6,634,946 B1 10/2003 Bridgeman et al.
6,652,378 B2 11/2003 Cannon et al.
6,656,044 B1 12/2003 Lewis
6,712,695 B2 3/2004 Mothwurf et al.
6,733,390 B2 5/2004 Walker et al.
6,743,102 B1 6/2004 Fiechter et al.
6,758,757 B2 7/2004 Luciano, Jr. et al.
6,761,633 B2 7/2004 Riendeau et al.
6,780,108 B1 8/2004 Luciano, Jr. et al.
6,800,026 B2 10/2004 Cannon
6,802,776 B2 10/2004 Lind et al.
6,805,629 B1 10/2004 Weiss
6,832,956 B1 12/2004 Boyd et al.
6,840,858 B2 1/2005 Adams
6,887,154 B1 5/2005 Luciano, Jr. et al.
6,926,607 B2 8/2005 Slomiany et al.
6,932,707 B2 8/2005 Duhamel et al.
6,966,834 B1 11/2005 Johnson
6,983,935 B2 1/2006 Kaminkow
7,008,324 B1 3/2006 Johnson et al.
7,029,395 B1 4/2006 Baerlocher
7,059,966 B2 6/2006 Luciano, Jr. et al.
7,297,059 B2 11/2007 Vancura et al.
7,311,598 B2 12/2007 Kaminkow et al.
7,311,604 B2 12/2007 Kaminkow et al.
7,419,430 B1 9/2008 Joshi et al.
7,562,873 B1 7/2009 Luciano, Jr.
7,578,739 B2 8/2009 Gauselmann
7,614,948 B2 11/2009 Saffari et al.
7,662,040 B2 2/2010 Englman et al.
7,731,581 B2 6/2010 Chamberlain et al.
7,946,915 B2 5/2011 Cannon
7,951,004 B2 5/2011 Saffari et al.
7,959,507 B2 6/2011 Cannon
7,959,509 B2 6/2011 Saffari et al.
7,980,943 B2 7/2011 McGlone et al.
8,192,279 B2 6/2012 Saffari et al.
8,197,326 B2 6/2012 Chamberlain et al.
2001/0004607 A1 6/2001 Olsen
2001/0018361 A1 8/2001 Acres
2001/0034262 A1 10/2001 Banyai
2001/0036855 A1 11/2001 DeFrees-Parrott et al.
2001/0036857 A1 11/2001 Mothwurf et al.
2001/0046892 A1 11/2001 Santini, Jr.
2002/0039923 A1 4/2002 Cannon et al.
2002/0045472 A1 4/2002 Adams
2002/0058546 A2 5/2002 Acres
2002/0082071 A1 6/2002 Riendeau et al.
2002/0094869 A1 7/2002 Harkham
2002/0111207 A1 8/2002 Lind et al.
2002/0113369 A1 8/2002 Weingardt
2002/0132661 A1 9/2002 Lind et al.
2002/0155877 A1 10/2002 Enzminger et al.
2002/0177483 A1 11/2002 Cannon
2002/0183105 A1 12/2002 Cannon et al.
2002/0183108 A1 12/2002 Baeg
2002/0198054 A1 12/2002 Auxier et al.
2003/0003981 A1 1/2003 Valenti
2003/0100361 A1 5/2003 Sharpless et al.
2003/0119581 A1 6/2003 Cannon et al.
2003/0125101 A1 7/2003 Campo
2003/0144050 A1 7/2003 Keaton et al.
2003/0148804 A1 8/2003 Ikeya et al.

(56) References Cited

U.S. PATENT DOCUMENTS

| | | | | |
|---|---|---|---|---|
| 2003/0148808 | A1 | 8/2003 | Price | |
| 2003/0171145 | A1 | 9/2003 | Rowe | |
| 2003/0181231 | A1 | 9/2003 | Vancura et al. | |
| 2003/0207707 | A1 | 11/2003 | Slomiany et al. | |
| 2003/0211884 | A1 | 11/2003 | Gauselmann | |
| 2003/0216165 | A1 | 11/2003 | Singer et al. | |
| 2003/0222402 | A1 | 12/2003 | Olive | |
| 2003/0224852 | A1 | 12/2003 | Walker et al. | |
| 2003/0228899 | A1 | 12/2003 | Evans | |
| 2003/0236110 | A1 | 12/2003 | Beaulieu et al. | |
| 2003/0236116 | A1 | 12/2003 | Marks et al. | |
| 2004/0048669 | A1 | 3/2004 | Rowe | |
| 2004/0072613 | A1 | 4/2004 | Visocnik | |
| 2004/0087368 | A1 | 5/2004 | Gauselmann | |
| 2004/0102243 | A1 | 5/2004 | Olsen | |
| 2004/0132523 | A1 | 7/2004 | Staw | |
| 2004/0142747 | A1 | 7/2004 | Pryzby | |
| 2004/0152499 | A1* | 8/2004 | Lind et al. | 463/16 |
| 2004/0152508 | A1 | 8/2004 | Lind et al. | |
| 2004/0214628 | A1 | 10/2004 | Boyd et al. | |
| 2004/0229683 | A1 | 11/2004 | Mothwurf et al. | |
| 2004/0235542 | A1 | 11/2004 | Stronach et al. | |
| 2004/0242297 | A1 | 12/2004 | Walker et al. | |
| 2004/0259621 | A1 | 12/2004 | Pfeiffer et al. | |
| 2004/0266517 | A1 | 12/2004 | Bleich et al. | |
| 2005/0026670 | A1 | 2/2005 | Lardie | |
| 2005/0032563 | A1 | 2/2005 | Sines | |
| 2005/0032569 | A1 | 2/2005 | Turk | |
| 2005/0037832 | A1 | 2/2005 | Cannon | |
| 2005/0043079 | A1 | 2/2005 | Huang | |
| 2005/0043094 | A1 | 2/2005 | Nguyen et al. | |
| 2005/0054419 | A1 | 3/2005 | Souza et al. | |
| 2005/0059449 | A1 | 3/2005 | Yarbrough | |
| 2005/0059467 | A1 | 3/2005 | Saffari et al. | |
| 2005/0059468 | A1 | 3/2005 | Cannon | |
| 2005/0059470 | A1 | 3/2005 | Cannon | |
| 2005/0059471 | A1 | 3/2005 | Cannon | |
| 2005/0064932 | A1 | 3/2005 | Cannon | |
| 2005/0075161 | A1 | 4/2005 | McGlone et al. | |
| 2005/0079911 | A1 | 4/2005 | Nakatsu | |
| 2005/0119042 | A1* | 6/2005 | Chamberlain et al. | 463/19 |
| 2005/0119044 | A1 | 6/2005 | Lim et al. | |
| 2005/0143168 | A1 | 6/2005 | Torango | |
| 2005/0167916 | A1 | 8/2005 | Banyai | |
| 2005/0187014 | A1 | 8/2005 | Saffari et al. | |
| 2005/0233798 | A1 | 10/2005 | Van Asdale | |
| 2006/0009285 | A1 | 1/2006 | Pryzby | |
| 2006/0025210 | A1 | 2/2006 | Johnson | |
| 2006/0040723 | A1 | 2/2006 | Baerlocher et al. | |
| 2006/0040732 | A1 | 2/2006 | Baerlocher et al. | |
| 2006/0040733 | A1 | 2/2006 | Baerlocher et al. | |
| 2006/0040734 | A1 | 2/2006 | Baerlocher et al. | |
| 2006/0040736 | A1 | 2/2006 | Baerlocher et al. | |
| 2006/0046821 | A1 | 3/2006 | Kaminkow et al. | |
| 2006/0046822 | A1 | 3/2006 | Kaminkow et al. | |
| 2006/0046823 | A1 | 3/2006 | Kaminkow et al. | |
| 2006/0052158 | A1 | 3/2006 | Raniere | |
| 2006/0052160 | A1 | 3/2006 | Saffari et al. | |
| 2006/0135245 | A1 | 6/2006 | Hedrick et al. | |
| 2006/0211493 | A1 | 9/2006 | Walker et al. | |
| 2006/0217176 | A1 | 9/2006 | Walker et al. | |
| 2007/0015585 | A1 | 1/2007 | Sartini et al. | |
| 2007/0060316 | A1 | 3/2007 | O'Halloran | |
| 2007/0093286 | A1 | 4/2007 | Marshall | |
| 2007/0105619 | A1 | 5/2007 | Kniesteadt et al. | |
| 2007/0135211 | A1 | 6/2007 | Block et al. | |
| 2007/0142113 | A1 | 6/2007 | Walker et al. | |
| 2007/0149292 | A1 | 6/2007 | Kaminkow et al. | |
| 2007/0202943 | A1 | 8/2007 | Thomas | |
| 2007/0207850 | A1 | 9/2007 | Darrah et al. | |
| 2008/0020817 | A1 | 1/2008 | Kaminkow et al. | |
| 2008/0020842 | A1 | 1/2008 | Kaminkow et al. | |
| 2008/0176627 | A1 | 7/2008 | Lardie | |
| 2010/0041459 | A1 | 2/2010 | Saffari et al. | |
| 2010/0210339 | A1 | 8/2010 | Chamberlain et al. | |
| 2011/0201417 | A1 | 8/2011 | Saffari et al. | |
| 2012/0165092 | A1 | 6/2012 | Saffari et al. | |

FOREIGN PATENT DOCUMENTS

| | | |
|---|---|---|
| EP | 1 341 135 | 9/2003 |
| EP | 1 302 914 A3 | 9/2004 |
| EP | 1 343 125 A3 | 12/2004 |
| EP | 1 665 182 | 6/2006 |
| EP | 1 668 608 | 6/2006 |
| EP | 1 668 609 | 6/2006 |
| EP | 1 671 285 | 6/2006 |
| EP | 1 671 286 | 6/2006 |
| EP | 1 671 287 | 6/2006 |
| EP | 1 671 288 | 6/2006 |
| EP | 1 671 289 | 6/2006 |
| EP | 1 687 782 | 8/2006 |
| JP | 06-246068 | 9/1994 |
| JP | 2007517535 | 7/2007 |
| WO | WO 96/18174 | 6/1996 |
| WO | WO 01/99067 | 12/2001 |
| WO | WO 03/063019 | 7/2003 |
| WO | WO 2005/029422 | 3/2005 |
| WO | WO 2005/029423 | 3/2005 |
| WO | WO 2005/029424 | 3/2005 |
| WO | WO 2005/029425 | 3/2005 |
| WO | WO 2005/029426 | 3/2005 |
| WO | WO 2005/029427 | 3/2005 |
| WO | WO 2005/029428 | 3/2005 |
| WO | WO 2005/029429 | 3/2005 |
| WO | WO 2005/029430 | 3/2005 |

OTHER PUBLICATIONS

EP Examiner's Communication dated Oct. 25, 2006, from EP Application No. 04784069.9.

EP Office Action dated Jan. 20, 2009 from EP Application No. 04784221.6.

EP Office Action dated Jan. 20, 2009 from EP Application No. 04783992.3.

EP Office Action dated May 18, 2009 from EP Application No. 04 783 891.7.

EP Office Action dated May 18, 2009 from EP Application No. 04 783 937.8-2221.

EP Oral Proceedings dated Jan. 28, 2009 from EP Application No. 04784069.9.

Examination Report from Related European Patent Application No. 04 778 725.2, dated Oct. 22, 2007, 9 pages.

Examiner's Communication pursuant to Article 96(2) EPC, dated Jul. 3, 2006, from related European Patent Application No. 04783935.2, 3 pp.

Examiner's Communication pursuant to Article 96(2) EPC, dated Jul. 3, 2006, from related European Patent Application No. 04784071.5, 3 pp.

Final Office Action mailed Feb. 4, 2008 from U.S. Appl. No. 10/931,673.

Final Office Action mailed Mar. 28, 2008, from U.S. Appl. No. 10/756,429.

International Search Report & Written Opinion of the International Searching Authority dated Feb. 21, 2005 for PCT App No. PCT/US2004/030089.

International Search Report and Written Opinion of the International Searching Authority of the International Searching Authority dated Feb. 3, 2005 from PCT/US2004/029983.

International Search Report and Written Opinion of the International Searching Authority dated Nov. 1, 2005, for related PCT Application No. PCT/US2004/029912.

International Search Report and Written Opinion of the International Searching Authority dated Jan. 24, 2005, for related PCT Application No. PCT/US2004/029906.

International Search Report and Written Opinion of the International Searching Authority dated Jan. 25, 2005, for related PCT Application No. PCT/US2004/029913.

(56) References Cited

OTHER PUBLICATIONS

International Search Report and Written Opinion of the International Searching Authority dated Jan. 24, 2005, for related PCT Application No. PCT/US2004/030093.
International Search Report and Written Opinion of the International Searching Authority dated Feb. 3, 2005, for related PCT Application No. PCT/US2004/030285.
International Search Report and Written Opinion of the International Searching Authority dated Feb. 3, 2005, for related PCT Application No. PCT/US2004/029839.
International Search Report and Written Opinion of the ISA dated Feb. 21, 2005 for PCT/US2004/029911.
MX Office Action dated Apr. 15, 2009 from MX Application No. 06/02903.
MX Office Action dated Apr. 15, 2009 from MX Application No. 06/02900.
MX Office Action dated Apr. 15, 2009 from MX Application No. 06102899.
MX Office Action dated Apr. 15, 2009 from MX Application No. 06102901.
MX Office Action dated Apr. 15, 2009 from MX Application No. 06102908.
MX Office Action dated Apr. 21, 2009 from MX Application No. 06102905.
MX Office Action dated Apr. 29, 2009 from MX Application No. 06102906.
MX Office Action dated Apr. 30, 2009 from MX Application No. 06102902.
MX Office Action dated May 8, 2009 from MX Application No. 06102907.
Notification Concerning Transmittal of International Preliminary Report on Patentability dated Mar. 23, 2006 from PCT/US2004/029906.
Notification Concerning Transmittal of International Preliminary Report on Patentability dated Mar. 23, 2006 from PCT/US2004/029913.
Notification Concerning Transmittal of International Preliminary Report on Patentability dated Mar. 23, 2006 from PCT/US2004/030089.
Notification Concerning Transmittal of International Preliminary Report on Patentability dated Mar. 16, 2006 from PCT/US2004/030285.
Notification Concerning Transmittal of International Preliminary Report on Patentability dated Mar. 23, 2006 from PCT/US2004/030093.
Notification Concerning Transmittal of International Preliminary Report on Patentability dated Mar. 23, 2006 from PCT/US2004/029839.
Notification Concerning Transmittal of International Preliminary Report on Patentability dated Mar. 23, 2006 from PCT/US2004/029912.
Notification Concerning Transmittal of International Preliminary Report on Patentability dated Mar. 23, 2006 from PCT/US2004/029911.
Notification of Transmittal ofInternational Preliminary Report on Patentability dated Mar. 23, 2006 from PCT/US2004/029983.
Office Action mailed Aug. 20, 2007, from U.S. Appl. No. 10/931,673.
Office Action mailed Dec. 31, 2007 from U.S. Appl. No. 10/755,982.
Office Action mailed Jul. 3, 2007, from U.S. Appl. No. 10/755,982.
Office Action mailed Mar. 19, 2008 from U.S. Appl. No. 10/941,606.
Office Action mailed Mar. 28, 2008 from U.S. Appl. No. 10/940,293.
Office Action mailed Sep. 13, 2007, from U.S. Appl. No. 10/941,606.
Office Action mailed Sep. 21, 2007, from U.S. Appl. No. 10/756,429.
Restriction Requirement mailed Jun. 8, 2007 from U.S. Appl. No. 10/931,673.
Summons to Oral Proceedings dated Sep. 17, 2008 from EP Application No. 04 788 725.2.
Third Party Submission for U.S. Appl. No. 13/092,005 dated Oct. 17, 2011.
US Advisory Action dated Apr. 28, 2008 issued in U.S. Appl. No. 10/931,673.
US Advisory Action mailed Jun. 26, 2008 from U.S. Appl. No. 10/756,429.
US Final Office Action dated Aug. 2, 2010 from U.S. Appl. No. 10/940,247.
US Final Office Action dated Jan. 19, 2012 issued in U.S. Appl. No. 10/887,111.
US Final Office Action dated Oct. 14, 2010 from U.S. Appl. No. 10/887,111.
US Final Office Action dated Oct. 29, 2012 issued in U.S. Appl. No. 13/092,005.
US Final Office Action mailed Oct. 21, 2008 from U.S. Appl. No. 10/941,606.
US Notice of Allowance and Allowability dated Dec. 13, 2011 issued in U.S. Appl. No. 12/603,752.
US Notice of Allowance and Allowability dated Feb. 10, 2012 issued in U.S. Appl. No. 12/603,752.
US Notice of Allowance and Examiner Amendment dated Apr. 13, 2011 issued in U.S. Appl. No. 10/940,293.
US Notice of Allowance and Examiner Amendment dated Dec. 1, 2010 from U.S. Appl. No. 10/941,606.
US Notice of Allowance and Examiner Amendment dated Nov. 15, 2010 from U.S. Appl. No. 10/755,982.
US Notice of Allowance and Examiner Interview Summary dated Aug. 25, 2011 issued in U.S. Appl. No. 12/603,752.
US Notice of Allowance and Examiner's Amendment dated Feb. 3, 2011 issued in U.S. Appl. No. 10/931,673.
US Notice of Allowance and Examiner's Amendment dated Jan. 31, 2011 issued in U.S. Appl. No. 10/940,247.
US Notice of Allowance and Interview Summary dated Jul. 23, 2009 issued in U.S. Appl. No. 10/755,982.
US Notice of Allowance dated Apr. 15, 2010 from U.S. Appl. No. 10/941,606.
US Notice of Allowance dated Apr. 23, 2008 from U.S. Appl. No. 10/755,982.
US Notice of Allowance dated Aug. 12, 2010 from U.S. Appl. No. 10/755,982.
US Notice of Allowance dated Dec. 21, 2009 from U.S. Appl. No. 10/941,606.
US Notice of Allowance dated Dec. 4, 2009 from U.S. Appl. No. 10/755,982.
US Notice of Allowance dated Dec. 6, 2011 issued in U.S. Appl. No. 12/764,829.
US Notice of Allowance dated Feb. 17, 2012 issued in U.S. Appl. No. 12/764,829.
US Notice of Allowance dated Feb. 18, 2010 from U.S. Appl. No. 10/931,673.
US Notice of Allowance dated Feb. 25, 2009 from U.S. Appl. No. 10/756,429.
US Notice of Allowance dated Jul. 23, 2008 from U.S. Appl. No. 10/755,982.
US Notice of Allowance dated Jun. 16, 2009 from U.S. Appl. No. 10/756,429.
US Notice of Allowance dated Jun. 9, 2010 from U.S. Appl. No. 10/755,982.
US Notice of Allowance dated Mar. 18, 2011 issued in U.S. Appl. No. 10/941,606.
US Notice of Allowance dated Mar. 25, 2010 from U.S. Appl. No. 10/755,982.
US Notice of Allowance dated Oct. 16, 2009 from U.S. Appl. No. 10/931,673.
US Notice of Allowance dated Oct. 29, 2010, from U.S. Appl. No. 10/931,673.
US Notice of Allowance mailed Jan. 21, 2010, from U.S. Appl. No. 10/940,272.
US Notice of Allowance with Examiner Amendment and Examiner Interview Summary dated Mar. 15, 2011 issued in U.S. Appl. No. 10/755,982.
US Office Action dated Dec. 9, 2010 from U.S. Appl. No. 10/940,293.
US Office Action dated Jan. 8, 2010 from U.S. Appl. No. 10/940,293.
US Office Action dated Jul. 7, 2010 from U.S. Appl. No. 10/940,293.

(56) References Cited

OTHER PUBLICATIONS

US Office Action dated Jun. 24, 2011 issued in U.S. Appl. No. 10/887,111.
US Office Action dated Mar. 30, 2010 from U.S. Appl. No. 10/887,111.
US Office Action dated May 16, 2011 issued in U.S. Appl. No. 12/603,752.
US Office Action dated May 25, 2012 issued in U.S. Appl. No. 13/092,005.
US Office Action mailed Apr. 14, 2009 from U.S. Appl. No. 10/941,606.
US Office Action mailed Aug. 11, 2008 from U.S. Appl. No. 10/931,673.
US Office Action mailed Feb. 19, 2010, from U.S. Appl. No. 10/940,247.
US Office Action mailed Jan. 6, 2009 from U.S. Appl. No. 10/940,247.
US Office Action mailed Jul. 9, 2008 from Application No. 1940,247.
US Office Action mailed May 14, 2009 from U.S. Appl. No. 10/931,673.
US Office Action mailed May 20, 2009 from U.S. Appl. No. 10/940,272.
US Office Action mailed Oct. 2, 2009 from U.S. Appl. No. 10/940,247.
US Office Action mailed Sep. 17, 2008 from U.S. Appl. No. 10/756,429.
US Restriction Requirement mailed Jun. 26, 2008 from U.S. Appl. No. 10/940,272.
US Supplemental Notice of Allowance and Examiner Amendment dated Oct. 8, 2009 issued in 101756,429.
US Supplemental Notice of Allowance and Interview Summary dated Jul. 6, 2010 from U.S. Appl. No. 10/941,606.
US Supplemental Notice of Allowance dated Apr. 13, 2010 from U.S. Appl. No. 10/755,982.
US Supplemental Notice of Allowance dated Sep. 9, 2010 from U.S. Appl. No. 10/941,606.

* cited by examiner

FIG. 22

PAY GROUPS

956

| 1 | 2 | 3 | 4 | 5 | 6 | 7 | 8 | 9 | 10 |
|---|---|---|---|---|---|---|---|---|---|
| 1 | 11 | 21 | 31 | 41 | 51 | 61 | 71 | 81 | 91 |
| 2 | 12 | 22 | 32 | 42 | 52 | 62 | 72 | 82 | 92 |
| 3 | 13 | 23 | 33 | 43 | 53 | 63 | 73 | 83 | 93 |
| 4 | 14 | 24 | 34 | 44 | 54 | 64 | 74 | 84 | 94 |
| 5 | 15 | 25 | 35 | 45 | 55 | 65 | 75 | 85 | 95 |
| 6 | 16 | 26 | 36 | 46 | 56 | 66 | 76 | 86 | 96 |
| 7 | 17 | 27 | 37 | 47 | 57 | 67 | 77 | 87 | 97 |
| 8 | 18 | 28 | 38 | 48 | 58 | 68 | 78 | 88 | 98 |
| 9 | 19 | 29 | 39 | 49 | 59 | 69 | 79 | 89 | 99 |
| 10 | 20 | 30 | 40 | 50 | 60 | 70 | 80 | 90 | 100 |

FIG. 28

PAY GROUPS

| 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|
| 900 | 540 | 360 | 300 | 225 | 150 | 130 | 120 | 100 | 80 | 50 | 40 | 30 | 20 | 10 | 2 |
| 902 | 550 | 362 | 302 | 226 | 151 | 132 | 121 | 102 | 81 | 51 | 42 | 31 | 21 | 12 | 4 |
| 906 | 585 | 366 | 306 | 227 | 152 | 134 | 122 | 104 | 82 | 52 | 44 | 32 | 22 | 14 | 5 |
| 1350 | 587 | 368 | 308 | 231 | 155 | 135 | 124 | 105 | 83 | 53 | 45 | 34 | 23 | 15 | 6 |
| 1500 | 600 | 375 | 310 | 233 | 175 | 136 | 125 | 106 | 85 | 55 | 46 | 35 | 25 | 17 | 7 |
| 1502 | 683 | 377 | 314 | 240 | 180 | 140 | 126 | 107 | 87 | 57 | 47 | 36 | 27 | 18 | 8 |
| 1800 | 720 | 380 | 315 | 242 | 182 | 142 | 127 | 110 | 89 | 60 | | 37 | 29 | | 9 |
| 2250 | 752 | 435 | 317 | 250 | 187 | 145 | 128 | 111 | 90 | 61 | | 38 | | | |
| 4727 | 810 | 450 | 325 | 256 | 190 | | | 112 | 92 | 62 | | | | | |
| | 850 | 525 | 340 | | 195 | | | 115 | 95 | 65 | | | | | |
| | | | 342 | | 197 | | | | 96 | 67 | | | | | |
| | | | 347 | | 200 | | | | | 70 | | | | | |
| | | | | | 201 | | | | | 75 | | | | | |
| | | | | | 220 | | | | | 77 | | | | | |

1050

MULTI-PLAYER BINGO GAME WITH MULTIPLE CARDS PER PLAYER

PRIORITY CLAIM

This application is a divisional of, claims priority to and the benefit of U.S. patent application Ser. No. 13/863,999, filed on Apr. 16, 2013, which is a continuation of, claims priority to and the benefit of, U.S. patent application Ser. No. 10/941,388, filed on Sep. 15, 2004, now U.S. Pat. No. 8,430,738, which claims priority to and the benefit of U.S. Provisional Patent Application No. 60/503,161, filed on Sep. 15, 2003, the entire contents of each of which are incorporated herein by reference.

BACKGROUND

The present disclosure relates to gaming networks and, more particularly, to a gaming network providing a multi-player Bingo game wherein each player may have a plurality of Bingo cards for each occurrence of the multi-player Bingo game.

Indian gaming in the United States is divided into Class I, Class II and Class III games. Class I gaming includes social games played for minimal prizes, or traditional ceremonial games. Class II gaming includes Bingo and Bingo-like games. Bingo is defined as games played for prizes, including monetary prizes, with cards bearing numbers or other designations in which the holder of the cards covers such numbers or designations when objects, similarly numbered or designated, are drawn or electronically determined, and in which the game is won by the first person covering a previously designated arrangement of numbers or designations on such cards. Class II gaming may also include pull tab games if played in the same location as Bingo games, lotto, punch boards, tip jars, instant Bingo, and other games similar to Bingo. Class III gaming includes any game that is not a Class I or Class II game, such as games of chance (slots, video poker, video blackjack, video Keno, and the like) typically offered in non-Indian, state-regulated casinos.

Two basic forms of Bingo exist. In traditional Bingo, the players purchase cards after which a draw takes place. The first player to achieve a designated pattern wins. In one type of Bingo game known as Bonanza Bingo, the draw for the game takes place before the players know the arrangements on their Bingo cards. After the draw occurs, the players may either purchase cards or expose previously purchased cards and compare the arrangements on the cards to the drawn numbers to determine whether predetermined patterns are matched. Play continues in Bonanza Bingo until at least one of the players matches a designated game-winning pattern. Bonanza Bingo may also encompass Bingo variations wherein a partial draw is conducted for some numbers (generally fewer than the number of balls expected to be necessary to win the game) prior to selling and/or revealing the Bingo cards. After the Bingo cards are sold and/or revealed, additional numbers are drawn until there is a winner.

As indicated above, a Bingo game is played until at least one player covers a predetermined game-winning pattern on the player's Bingo card. The game may also include interim winners of prizes based on matching predetermined interim patterns on the Bingo card using the same ball draw. The interim pattern wins do not terminate the Bingo game. For interim pattern awards, players covering certain interim patterns may receive an additional award as the game continues. Some exceptional Bingo versions may allow Bingo draws beyond those needed to achieve the Bingo game win so as to payout interim pattern wins at a desired rate. The game winning awards may be partially or fully pari-mutuel in nature. That is, the Bingo win award is based upon the total amount wagered on a given occurrence of the Bingo game. However, interim pattern awards typically are not pari-mutuel.

For a given game-winning pattern, the expected number of balls drawn for at least one Bingo card to match the game-winning pattern depends on the number of Bingo cards being played in the Bingo game. Bingo is typically played with a variable number of Bingo cards resulting from varying numbers of players and players playing varying numbers of Bingo cards. Consequently, if the interim patterns are evaluated based on the balls drawn until at least one Bingo card matches the game-winning pattern, the odds of awarding interim awards also varies with the number of Bingo cards being played in the Bingo game. If the interim awards are determined based on the ball draw to Bingo, the Bingo game may be restricted to a fixed number of Bingo cards in order to achieve a desired payout rate for the interim pattern awards. However, it may be difficult to use a fixed number of Bingo cards in every occurrence of the Bingo game in a real-time environment wherein the players' expectation may be to play the Bingo game on demand.

For example, to achieve a desired interim award payout rate, it may be desirable to play each occurrence of the Bingo game with a fixed number of Bingo cards, such as fifteen. If there are at least two players but less than fifteen Bingo cards are enrolled in the Bingo game within a short period of time, in order to serve the players, the casino may want to start the game for those players available to play. With the fewer number of Bingo cards, the average number of balls drawn for at least one of the Bingo cards to match the game-winning pattern may be expected to be greater than for fifteen Bingo cards. Correspondingly, the number of balls used by the players to match the interim patterns increases, thereby increasing the odds of players matching the interim patterns and increasing the interim award payout rate. Therefore, a need exists for a method for minimizing the impact of the players and/or Bingo cards upon the award structure for a multi-player Bingo game, including the impact on the odds of awarding interim pattern awards.

In general, players may find games such as slot machines, whether electromechanical or video, to be more appealing to Bingo games. Typically, slot machine outcomes are based upon the resultant patterns of symbols displayed on the reels. However, as mentioned above, slot machines and other similar type games of chance fall into the category of Class III games, which may be subject to stricter approval and regulation.

As such, there is a recognized need for providing a system wherein a Bingo outcome may be presented to the players with the display simulating the appearance of traditional Class III games, such as with electro-mechanical or video slot reels, but with the outcome of the Bingo game determining the outcome to be displayed instead of the game engine typically used for the selected Class III game. For example, a Bingo outcome may be used to determine the positioning of the reels of a display device having the look and feel of a slot machine. Thus, the positioning of the slot reels is based upon the Bingo pattern(s) matched by the player during the Bingo game. Further, the award amounts depicted by the display device may correspond to the award amounts, plus any scatter and bonus awards, represented by the Bingo patterns. The display device, therefore, serves as an alternative display of the results of the Bingo game. The Bingo card, which may also be displayed, is the ultimate outcome-determining entity, with that outcome determining the outcome that is displayed on the display device.

For slot machines and other games of chance having a single payline (i.e. a single sequence or grouping of game symbols that is evaluated to determine whether a winning combination occurs), mapping between the winning outcomes of the game of chance and patterns in a Bingo game may not be difficult to achieve. Such games of chance typically encompass a couple dozen possible winning combinations and associated payout amounts. Selecting Bingo patterns with odds of occurrence similar to those of each desired winning outcome of the game of chance maybe readily achieved by one skilled in the art.

The current trend in slot machines, for example, is to provide multi-line spinning reel games (i.e., multiple sequences or groupings of game symbols that are evaluated to determine whether one or more winning combinations occur). The award resulting from the final positioning of the reels may be the sum of the awards for all the selected paylines, plus any scatter or bonus awards. Thus, the number of possible award amounts for a given play of the game is increased dramatically and can easily reach several hundred. In order to provide a display device for a Bingo game and offer the look and feel of a multi-line slot machine, a need exists for a method to map the Bingo patterns to each of a desired large number of award amounts. Attempting to define patterns for all or most such award amounts may be analytically challenging and potentially confusing to the Bingo player.

One example of a method of mapping Bingo game outcomes to slot machine awards is disclosed in U.S. Pat. No. 6,537,150 to Luciano. Luciano discloses a method wherein a limited number of Bingo outcome award amounts are provided while still using a majority of reel display outcomes. For each of the defined winning patterns in a reasonably sized set, a maximum award amount is defined. When such a winning pattern occurs, a display device outcome is chosen having an award amount near the maximum award amount. The difference between the maximum award amount and the chosen award amount is added to a separate prize pool that is awarded to players by some other means, such as a bonus. Consequently, the Luciano method does not pay the player the exact amount reflected by the player's Bingo outcome.

When playing class Ill games, such as slot machines, players may be offered the ability to vary their wager amount for an occurrence of the game to achieve their desired expected win frequencies and/or award amounts. For example, when playing a slot machine, a player may be able to increase their expected win frequency for an occurrence of the slot game by increasing the number of paylines on which the player wagers, while the player may also increase the award amounts for winning outcomes of the slot game by increasing the number of credits wagered per payline. In order to provide a player similar flexibility in a Class II Bingo game, it may be desirable to offer the players the ability to select multiple cards and to vary the amount wagered per card for an occurrence of the Bingo game in order to achieve target or desired expected win frequencies and/or expected award amounts corresponding to the players' preferences for their gaming experience. It may further be desired to allow the players to make their wagering decisions based on the wagering options for a second wagering game displayed in an alternate outcome display of the Bingo game, with the player selections for the second wagering game dictating, among other aspects of the Bingo game, the number of cards and wager amounts per card to be used by the player for the occurrence of the Bingo game.

SUMMARY OF THE INVENTION

In one aspect, the invention is directed to a method for providing a multiplayer wagering game on a gaming network having a plurality of gaming units wherein each player may have at least one game array having a unique combination of indicia from a range of game indicia for an occurrence of the wagering game. Individual game indicia may be randomly selected from the range of game indicia during the occurrence of the wagering game and transmitted to the gaming units over the gaming network, and at least one of the players may win the occurrence of the wagering game by matching a game-winning pattern, or one of a plurality of game winning patterns, of game indicia on at least one of the player's game arrays with the randomly selected game indicia.

The method may include enrolling a plurality of players at corresponding gaming units for an occurrence of the multi-player wagering game, wherein each occurrence of the multi-player wagering game may include at least a predetermined total number of game arrays, and wherein each player may have a plurality of game arrays for the occurrence of the multi-player wagering game. The method may further include randomly selecting game indicia from the range of game indicia, determining whether each randomly selected game indicia matches any of the game indicia of the at least one game array for each player in the order that the randomly selected game indicia are selected, and determining that at least one game array for the occurrence of the multi-player wagering game has matched a game-winning pattern of game indicia on the player's game array with the randomly selected game indicia in the fewest number of randomly selected game indicia. Additionally, the method may include determining a game-winning award amount for each player having at least one game array matching a game-winning pattern in the fewest number of randomly selected game indicia, wherein each player may receive a game-winning award for each of the at least one game arrays matching the game-winning pattern in the fewest number of randomly selected game indicia.

In one embodiment, the method may include providing an alternate outcome display of an outcome of an occurrence of a second wagering game corresponding to the combined outcome for all of the plurality of the player's game arrays for the occurrence of the multi-player wagering game. The alternate outcome display may include a plurality of second wagering games, each of which may correspond to a number of game arrays that may be enrolled by a player, and may be displayed when the player enrolls the corresponding number of game arrays in an occurrence of the wagering game. In another embodiment, a player may be awarded a first game winning award amount for matching the game-winning pattern in fewer than a predetermined number of randomly selected game indicia, and a second game winning award amount for matching the game-winning pattern in more than the predetermined number. Still further, a plurality of available game awards may be divided into groups of game awards, and players may be awarded one of the game awards in a group for matching the game-winning pattern within a range of the randomly selected game indicia corresponding to the group.

In another aspect, the invention is directed to a gaming unit for conducting a multi-player wagering game over a gaming network having a plurality of gaming units operatively coupled together, wherein each player may have at least one game array having a unique combination of indicia from a range of game indicia for an occurrence of the wagering game, wherein individual game indicia may be randomly selected from the range of game indicia during the occurrence of the wagering game and transmitted to the gaming units over the gaming network, and wherein at least one of the players may win the occurrence of the wagering game by matching a game winning pattern, or one of a plurality of game-winning patterns, of game indicia on at least one of the player's game arrays with the randomly selected game indicia. The gaming unit may include an input device for inputting a plurality of input selections, a currency-accepting mechanism that may be capable of allowing a player to deposit a medium of currency, a display device, a value-dispensing mechanism that may be capable of dispensing value to the player, and a gaming unit controller that may be operatively coupled to the input device, the currency-accepting mechanism, the output device, and the value-dispensing mechanism.

The gaming unit controller may be programmed to allow the currency accepting mechanism to accept a deposit of an amount of a medium of currency by a player at the gaming unit, and to allow the input device to receive input for a player's enrollment in an occurrence of the multi-player wagering game, wherein each occurrence of the multi-player wagering game may include at least a predetermined total number of game arrays, and wherein each player may have a plurality of game arrays for the occurrence of the multi-player wagering game. The gaming unit controller may also be programmed to receive randomly selected game indicia from the range of game indicia transmitted to the gaming units over the gaming network, and to determine whether each randomly selected game indicia matches any of the game indicia of each game array in the order that the randomly selected indicia is selected. Still further, the gaming unit controller may be programmed to determine whether the game arrays have matched a game-winning pattern of game indicia on the player's game arrays with the randomly selected game indicia in the fewest number of randomly selected game indicia, and to award the player a game-winning award amount for each of the plurality of game arrays matching a game-winning pattern in the fewest number of randomly selected game indicia in response to determining that at least one game array matched the game-winning pattern of game indicia in the fewest number of randomly selected game indicia.

In a further aspect, the invention is directed to a method for providing a multi-player wagering game on a gaming network having a plurality of gaming units wherein each player may have at least one game array having a unique combination of indicia from a range of game indicia for an occurrence of the wagering game. Individual game indicia may be randomly selected from the range of game indicia during the occurrence of the wagering game and transmitted to the gaming units over the gaming network, and at least one of the players may win the occurrence of the wagering game by matching a predetermined game-winning pattern of game indicia on at least one of the player's game arrays with the randomly selected game indicia.

The method may include enrolling a plurality of players at corresponding gaming units for an occurrence of the multi-player wagering game, wherein each occurrence of the multi-player wagering game may include at least a predetermined total number of game arrays, and wherein each player may have a plurality of game arrays for the occurrence of the multi-player wagering game. The method may further include randomly selecting game indicia from the range of game indicia, determining whether each randomly selected game indicia matches any of the game indicia of the at least one game array for each player in the order that the randomly selected game indicia are selected, and determining that at least one game array for the occurrence of the multi-player wagering game has matched the predetermined game-winning pattern of game indicia on the player's game array with the randomly selected game indicia in the fewest number of randomly selected game indicia. Additionally, the method may include determining a game outcome for a player based on the game indicia of the player's game arrays matching the randomly selected game indicia, and providing an alternate outcome display of a second wagering game at the gaming unit, wherein the second wagering game may have a plurality of wagering options, and wherein the number of game arrays for the player may correspond to one of the wagering options of the second wagering game. Still further, the method may include displaying a second wagering game outcome at the alternate outcome display corresponding to the game outcome for the player for the multi-player wagering game, wherein the displayed second wagering game outcome may be an outcome for the one of the wagering options corresponding to the number of game arrays for the player. In one embodiment, the method may include allowing the player to select one of the wagering options of the second wagering game of the alternate outcome display, and enrolling the number of game arrays corresponding to the selected wagering option of the second wagering game for the player for the occurrence of the wagering game.

In one aspect, the invention is directed to a method for providing a multiplayer wagering game on a gaming network having a plurality of gaming units wherein each player may have at least one game array having a unique combination of indicia from a range of game indicia for an occurrence of the wagering game. Individual game indicia may be randomly selected from the range of game indicia during the occurrence of the wagering game and transmitted to the gaming units over the gaming network, and at least one of the players may win the occurrence of the wagering game by matching a game-winning pattern, or one of a plurality of game winning patterns, of game indicia on at least one of the player's game arrays with the randomly selected game indicia. The method may include enrolling a plurality of players at corresponding gaining units for an occurrence of the mufti-player wagering game for a predetermined enrollment time period, wherein each player may have a plurality of game arrays for the occurrence of the multi-player wagering game, beginning the occurrence of the multi-player wagering game in response to determining that the number of game arrays enrolled for the occurrence of the multiplayer wagering game within the enrollment time period is equal to a predetermined total number of game arrays.

The method may also include determining a range of the total number of game arrays required to begin the occurrence of the multi-player wagering game in response to determining that the number of game arrays enrolled for the occurrence of the multi-player wagering game within the enrollment time period is less than the predetermined total number of game arrays, and beginning the occurrence of the multi-player wagering game in response to determining that the number of game arrays enrolled for the occurrence of the multi-player wagering game after the enrollment time period is within the required range of the total number of game arrays. Still further, the method may include randomly selecting game indicia from the range of game indicia, determining whether each randomly selected game indicia matches any of the game indicia of the at least one game array for each player in the order that the randomly selected game indicia are selected, determining that at least one game array for the occurrence of the multi-player wagering game has matched a game-winning pattern of game indicia on the player's game array with the randomly selected game indicia in the fewest number of randomly selected game indicia, and determining a game-winning award amount for each player having at least one game array matching a game-winning pattern in the fewest number of randomly selected game indicia. Each player may receive a game-winning award for each of the at least one game arrays matching the game-winning pattern in the fewest number of randomly selected game indicia.

BRIEF DESCRIPTION OF THE DRAWINGS

FIG. 22 is a table of pay groups for a plurality of award amounts;

FIG. 28 is a table of pay groups for a plurality of award amounts;

DETAILED DESCRIPTION OF VARIOUS EMBODIMENTS

Although the following text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . ." or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

Figure 1:
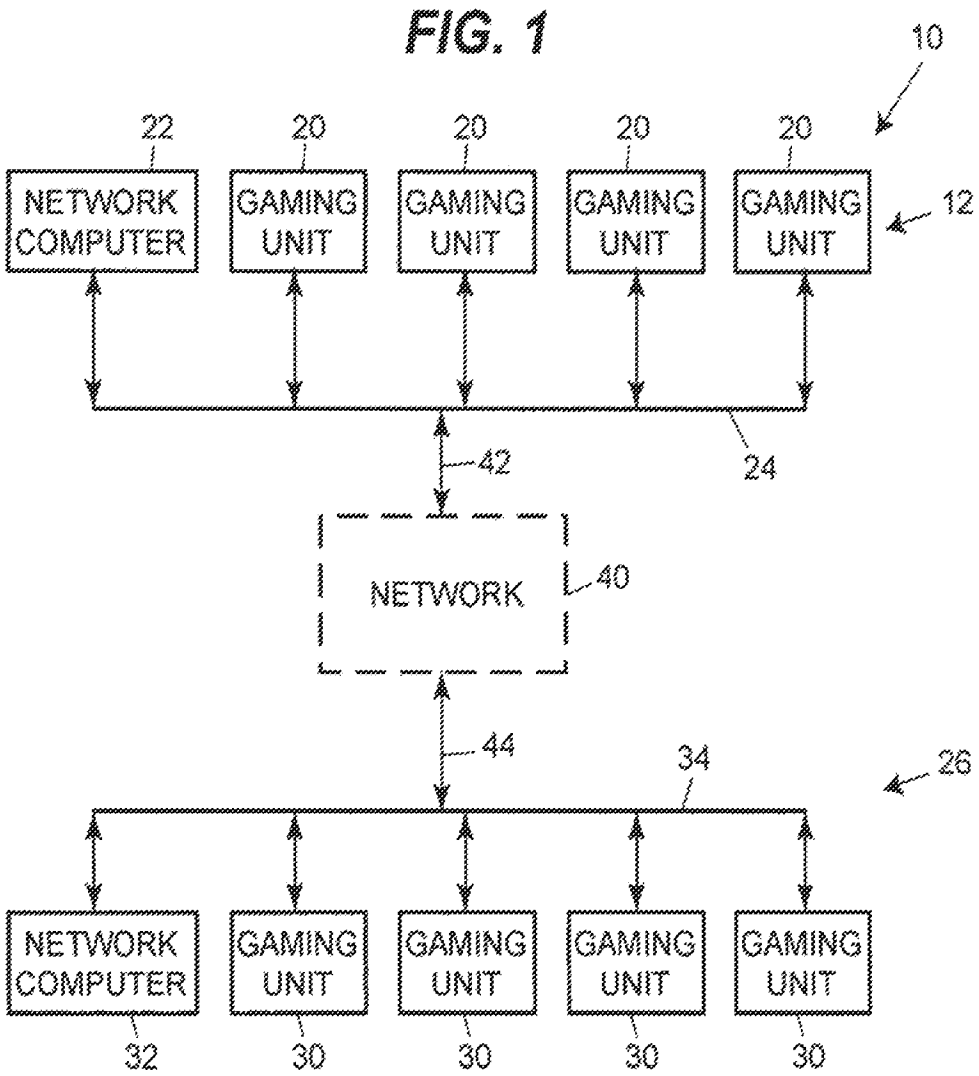
FIG. 1 is a block diagram of an embodiment of a gaming system In accordance with the invention.

FIG. 1 illustrates one possible embodiment of a Bingo gaming system 10 in accordance with the invention. Referring to FIG. 1, the Bingo gaming system 10 may include a first group or network 12 of casino gaming units 20 operatively coupled to a network computer 22 via a network data link or bus 24. The Bingo gaming system 10 may include a second group or network 26 of casino gaming units 30 operatively coupled to a network computer 32 via a network data link or bus 34. The first and second gaming networks 12, 26 may be operatively coupled to each other via a network 40, which may comprise, for example, the Internet, a wide area network (WAN), or a Racal area network (LAN) via a first network link 42 and a second network link 44.

The first network 12 of gaming units 20 may be provided in a first casino, and the second network 26 of gaming units 30 may be provided in a second casino located in a separate geographic location than the first casino. For example, the two casinos may be located in different areas of the same city, or they may be located in different states. The network 40 may include a plurality of network computers or server computers (not shown), each of which may be operatively interconnected. Where the network 40 comprises the Internet, data communication may take place over the communication links 42, 44 via an Internet communication protocol.

The network computer 22 may be a server computer and may be configured to control the execution of a multi-player Bingo game played at a plurality of the gaming units 20, and to accumulate and analyze data relating to the operation of the gaming units 20. For example, the network computer 22 may continuously receive data from each of the gaming units 20 indicative of the dollar amount and number of wagers being made on each of the gaming units 20, data indicative of how much each of the gaming units 20 is paying out in winnings, data regarding the identity and gaming habits of players playing each of the gaming units 20, etc. The network computer 32 may be a server computer and may be used to perform the same or different functions in relation to the gaming units 30 as the network computer 22 described above.

Although each network 12, 26 is shown to include one network computer 22, 32 and four gaming units 20, 30, it should be understood that different numbers of computers and gaming units may be utilized. For example, the network 12 may include a plurality of network computers 22 and tens or hundreds of gaming units 20, all of which may be interconnected via the data link 24. The data link 24 may provided as a dedicated hardwired link or a wireless link. Although the data link 24 is shown as a single data link 24, the data link 24 may comprise multiple data links.

Figure 2:
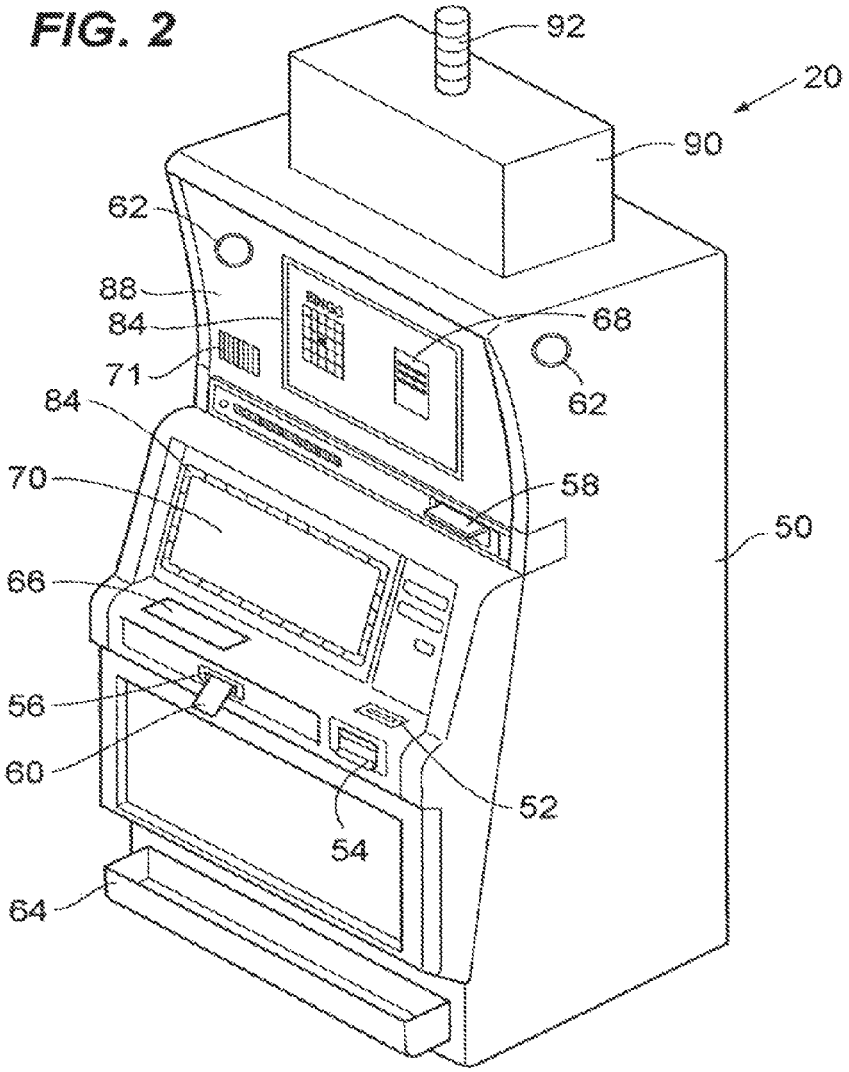
FIG. 2 is a perspective view of an embodiment of one of the gaming units shown schematically in FIG. 1.

FIG. 2 is a perspective view of one possible embodiment of one or more of the gaming units 20. Although the following description addresses the design of the gaming units 20, it should be understood that the gaming units 30 may have the same design as the gaming units 20 described below. It should be understood that the design of one or more of the gaming units 20 may be different than the design of other gaming units 20, and that the design of one or more of the gaming units 30 may be different than the design of other gaming units 30. Each gaming unit 20 may be any type of casino gaining unit and may have various different structures and methods of operation. For exemplary purposes, various designs of the gaming units 20 are described below, but it should be understood that numerous other designs may be utilized.

Referring to FIG. 2, the casino gaming unit 20 may include a housing or cabinet 50 and one or more input devices, which may include a coin slot or acceptor 52, a paper currency acceptor 54, a ticket reader/printer 56 and a card reader 58, which may be used to input value to the gaming unit 20. A value input device may include any device that can accept value from a customer. As used herein, the term "value" may encompass gaming tokens, coins, paper currency, ticket vouchers, credit or debit cards, smart cards, and any other object representative of value.

If provided on the gaming unit 20, the ticket reader/printer 56 may be used to read and/or print or otherwise encode ticket vouchers 60. The ticket vouchers 60 may be composed of paper or another printable or encodable material and may have one or more of the following informational items printed or encoded thereon: the casino name, the type of ticket voucher, a validation number, a bar code with control and/or security data, the date and time of issuance of the ticket voucher, redemption instructions and restrictions, a description of an award, and any other information that may be necessary or desirable. Different types of ticket vouchers 60 could be used, such as bonus ticket vouchers, cash-redemption ticket vouchers, casino chip ticket vouchers, extra game play ticket vouchers, merchandise ticket vouchers, restaurant ticket vouchers, show ticket vouchers, etc. The ticket vouchers 60 could be printed with an optically readable material such as ink, or data on the ticket vouchers 60 could be magnetically encoded. The ticket reader/printer 56 may be provided with the ability to both read and print ticket vouchers 60, or it may be provided with the ability to only read or only print or encode ticket vouchers 60. In the latter case, for example, some of the gaming units 20 may have ticket printers 56 that may be used to print ticket vouchers 60, which could then be used by a player in other gaming units 20 that have ticket readers 56.

If provided, the card reader 58 may include any type of card reading device, such as a magnetic card reader or an optical card reader, and may be used to read data from a card offered by a player, such as a credit card or a player tracking card. If provided for player tracking purposes, the card reader 58 may be used to read data from, and/or write data to, player tracking cards that are capable of storing data representing the identity of a player, the identity of a casino, the player's gaming habits, etc.

The gaming unit 20 may include one or more audio speakers 62, a coin return tray 64, an input control panel 66, upper and lower color video display units 68, 70 for displaying images relating to the game or games provided by the gaming unit 20, a status display 71 for providing player information, such as number of credits remaining, and a light device, such as, for example, illuminated light bezels 84, a lighted topbox 88, a topper 90, and a lighted gaming candle 92, as are well known in the art. The display units 68, 70 may be video displays capable of displaying graphical images associated with the game or games offered at the gaming unit 20. For example, the display unit 68 may display images associated with the multi-player Bingo game, while the display unit 70 may display an alternate presentation of the outcome of the Bingo game in the form of another casino game, such as slots. Alternatively, one or both of the displays 68, 70 may be mechanical or electromechanical devices configured to display game outcomes or other graphics associated with the game(s), such as for slot reels or wheels controlled by stepper motors as is well known in the art, or any other desired mechanism. Moreover, the displays 68, 70 may be combined into a single video display device, such as a CRT or LCD.

The audio speakers 62 may generate audio representing sounds such as the noise of spinning slot machine reels, a dealer's voice, music, announcements or any other audio related to a casino game. The input control panel 66 may be provided with a plurality of pushbuttons as shown or as touch-sensitive areas in cabinet 50 or on displays 68, 70 where implemented as video displays with touch-sensitive screens or other input devices that may be pressed or otherwise actuated by a player to select games, make wagers, make gaming decisions, etc. The status display 71 may provide gaming information to the player, such as the number of credits remaining, the outcome of the current game, the payout schedule, or the like. The light bezel(s) 84 may be coupled to the front face of the cabinet 50 and may enclose a plurality of lights, and further may have an aperture, allowing the color video display unit 70 to be visible therethrough. The lighted topbox 88, the topper 90, and the lighted gaming candle 92 may be stylistic elements added to the gaming unit 20 to attract a player's attention, or to provide visual cues to gaming status.

Figure 2A:
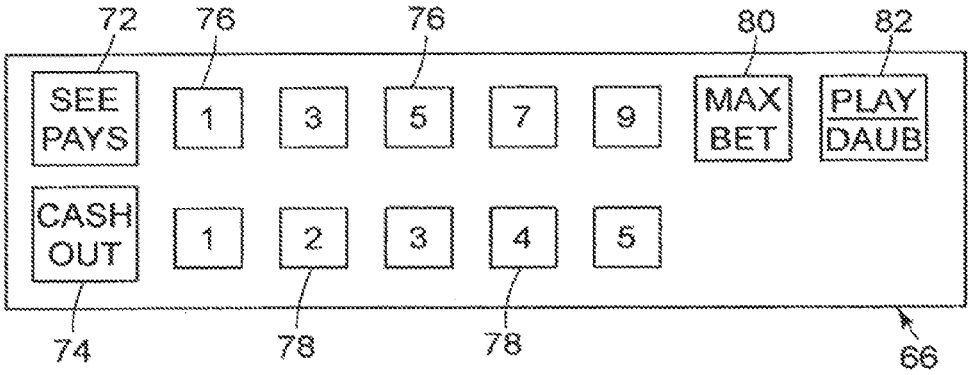
FIG. 2A illustrates an embodiment of a control panel for a gaming unit.

FIG. 2A illustrates one possible embodiment of the control panel 66, which may be used where the gaming unit 20 is a slot machine having a plurality of mechanical or "virtual" reels. Referring to FIG. 2A, the control panel 66 may include a "See Pays" button 72 that, when activated, causes the display unit 70 to generate one or more display screens showing the odds or payout information for the game or games provided by the gaming unit 20. As used herein, the term "button" is intended to encompass any device that allows a player to make an input, such as an input device that must be depressed to make an input selection or a display area that a player may simply touch. The control panel 66 may include a "Cash Out" button 74 that may be activated when a player decides to terminate play on the gaming unit 20, in which case the gaming unit 20 may return value to the player, such as by returning a number of coins to the player via the coin return tray 64.

For the multi-player Bingo game, the control panel of the gaming unit 20 may be provided with a plurality of selection buttons 76, each of which may allow the player to select a different number of Bingo cards to play prior to enrolling in the Bingo game. For example, five buttons 76 may be provided, each of which may allow a player to select one, three, five, seven or nine Bingo cards. Alternatively, where multiple sets of interim patterns are provided as described in co-pending Provisional Patent Appl. Ser. No. 60/503,161, filed on Sep. 15, 2003, and entitled Gaming Network with Multi-Player Bingo Game, which is expressly incorporated herein by reference, along with allowing the player to select multiple Bingo cards, buttons 76 may allow a player to select one of the available interim pattern sets for use in the Bingo game, each of which may correspond to a different wager amount. The control panel 66 may further be provided with a plurality of selection buttons 78 each of which allows a player to specify a wager amount for each Bingo card selected. For example, if the smallest wager accepted by the gaming unit 20 is a quarter ($0.25), the gaming unit 20 may be provided with five selection buttons 78, each of which may allow a player to select one, two, three, four or five quarters to wager for each Bingo card selected. In that case, if a player were to activate the "5" button 76 (meaning that five Bingo cards were to be played in the Bingo game, or that an interim pattern set requiring a five credit wager was selected) and then activate the "3" button 78 (meaning that three coins per Bingo card or interim pattern were to be wagered), the total wager would be $3.75 (assuming the minimum bet was $0.25).

If the gaming unit 20 provides, for example, a slots display having a plurality of reels and a plurality of paylines which define winning combinations of reel symbols, the plurality of selection buttons 76 on the control panel 66 may allow the player to select a different number of paylines prior to spinning the reels. For example, five buttons 76 may be provided, each of which may allow a player to select one, three, five, seven or nine paylines. Further, the plurality of selection buttons 78 on the control panel 66 may further allow a player to specify a wager amount for each payline selected. The total wager amount calculation above may apply equally to the slot display where a player activates the "5" button 76 to wager on five paylines, and' activates the "3" button 78 to wager three coins per payline. Ultimately, however, the selections made for the alternate display, such as the slots display, translate into a Bingo game wager.

The control panel 66 may include a "Max Bet" button 80 to allow a player to make the maximum wager allowable for a game. In the above example, where up to nine paylines were provided and up to five quarters could be wagered for each payline selected, the maximum wager would be 45 quarters, or $11.25. Depending on the implementation, the gaming unit 20 may be configured such that a player entered in the next occurrence of the Bingo game when the "Max Bet" button is pressed by the player. The control panel 66 may include a "Play/Daub" button 82 to allow the player to enter or enroll in the next occurrence of the Bingo game and to initiate spinning of the reels of a slots game after a wager has been made, and to "daub" or mark the player's Bingo card during the Bingo game as described more fully below. Alternatively, the gaming unit 20 may be configured with separate "Play" and "Daub" buttons.

In FIG. 2A, a rectangle is shown around the buttons 72, 74, 76, 78, 80, 82. It should be understood that that rectangle simply designates, for ease of reference, an area in which the buttons 72, 74, 76, 78, 80, 82 may be located. Consequently, the term "control panel" should not be construed to imply that a panel or plate separate from the housing 50 of the gaming unit 20 is required, and the term "control panel" may encompass a plurality or grouping of player activatable buttons.

Although one possible control panel 66 is described above, it should be understood that different buttons could be utilized in the control panel 66, and that the particular buttons used may depend on the game or games that could be played on the gaming unit 20. Although the control panel 66 is shown to be separate from the display unit 70, it should be understood that the control panel 66 could be generated by the display unit 70. In that case, each of the buttons of the control panel 66 could be a colored area generated by the display unit 70, and some type of mechanism may be associated with the display unit 70 to detect when each of the buttons was touched, such as a touch-sensitive screen.

Gaming Unit Electronics

Figure 3:
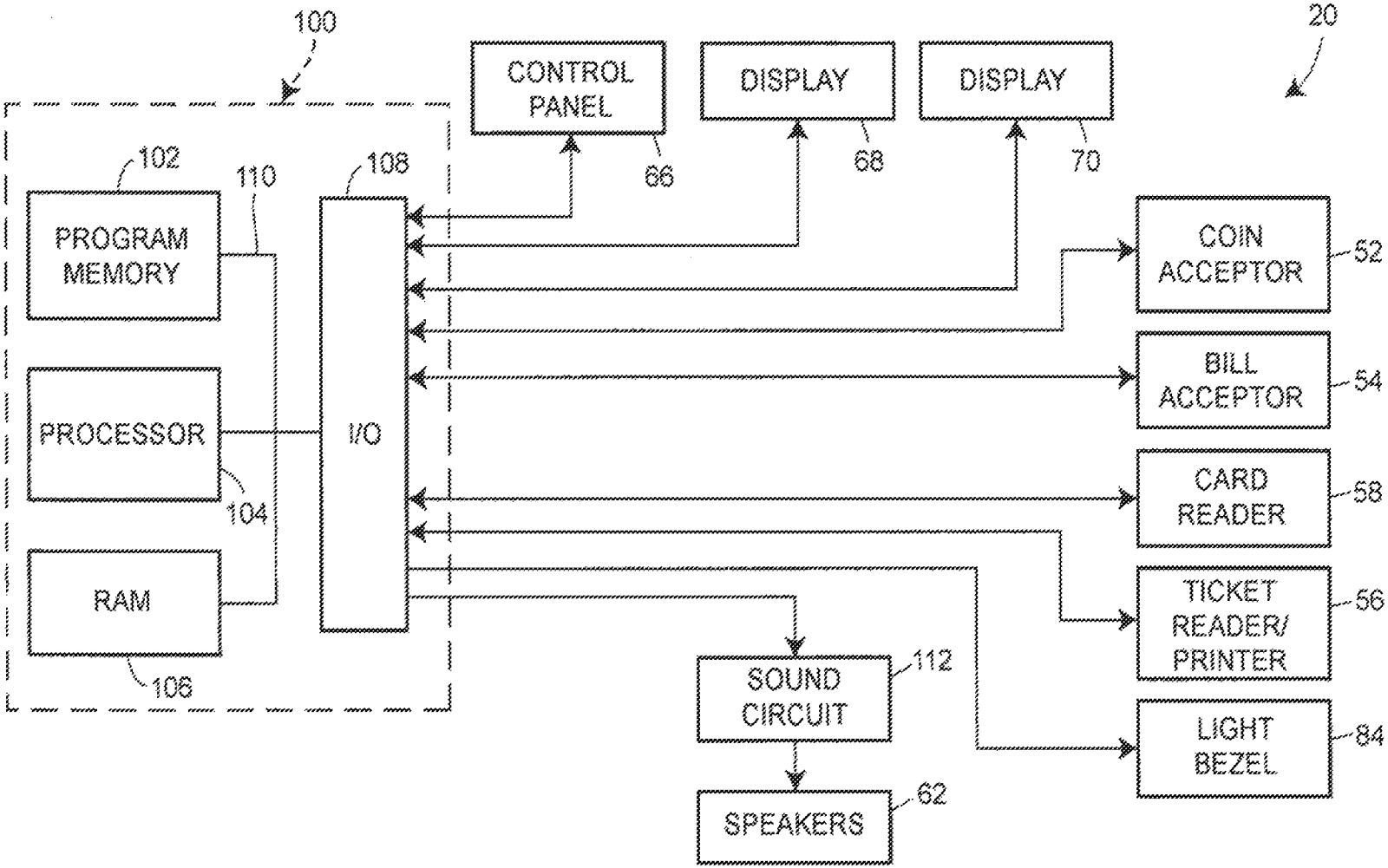
FIG. 3 is a block diagram of the electronic components of the gaming unit of FIG. 2.

FIG. 3 is a block diagram of a number of components that may be incorporated in the gaming unit 20 or alternatively, the network computer 22. Referring to FIG. 3, the gaming unit 20 may include a controller 100 that may comprise a program memory 102, a micro controller or microprocessor (MP) 104, a random-access memory (RAM) 106 and an input/output (I/O) circuit 108, all of which may be interconnected via an address/data bus 110. It should be appreciated that although only one microprocessor 104 is shown, the controller 100 may include multiple microprocessors 104. Similarly, the memory of the controller 100 may include multiple RAMs 106 and multiple program memories 102. Although the 110 circuit 108 is shown as a single block, it should be appreciated that the I/O circuit 108 may include a number of different types of I/O circuits. The RAM(s) 104 and program memories 102 may be implemented as semiconductor memories, magnetically readable memories, and/or optically readable memories, for example.

Although the program memory 102 is shown in FIG. 3 as a read-only memory (ROM) 102, the program memory of the controller 100 may be a read/write or alterable memory, such as a hard disk. In the event a hard disk is used as a program memory, the address/data bus 110 shown schematically in FIG. 3 may comprise multiple address/data buses, which may be of different types, and there may be an I/O circuit disposed between the address/data buses.

FIG. 3 illustrates that the control panel 66, the coin acceptor 52, the bill acceptor 54, the card reader 58 and the ticket reader/printer 56 may be operatively coupled to the I/O circuit 108, each of those components being so coupled by either a unidirectional or bidirectional, single-line or multiple-line data link, which may depend on the design of the component that is used. The speaker(s) 62 may be operatively coupled to a sound circuit 112, that may comprise a voice- and sound synthesis circuit or that may comprise a driver circuit. The sound-generating circuit 112 may be coupled to the I/O circuit 108.

As shown in FIG. 3, the components 52, 54, 56, 58, 66, 68, 70, 84 and 112 may be connected to the I/O circuit 108 via a respective direct line or conductor. Different connection schemes could be used. For example, one or more of the components shown in FIG. 3 may be connected to the I/O circuit 108 via a common bus or other data link that is shared by a number of components. Furthermore, some of the components may be directly connected to the microprocessor 104 without passing through the I/O circuit 108. Moreover, while not illustrated in the figures, the components 71, 88, 90 and 92 may also be operatively coupled to the controller 100. For example, the components 71, 86, 88, 90 and 92 may be connected to the I/O circuit 108 via a respective direct line or other similar connection scheme.

Overall Operation of Gaming Unit

One manner in which one or more of the gaming units 20 (and one or more of the gaming units 30) may operate is described below in connection with a number of flowcharts which represent a number of portions or routines of one or more computer programs, which may be stored in one or more of the memories of the controller 100. The computer program(s) or portions thereof may be stored remotely, outside of the gaming unit 20, and may control the operation of the gaming unit 20 from a remote location. Such remote control may be facilitated with the use of a wireless connection, or by an Internet interface that connects the gaming unit 20 with a remote computer (such as one of the network computers 22, 32) having a memory in which the computer program portions are stored. The computer program portions may be written in any high level language such as C, C++, C#, Java or the like or any low-level assembly or machine language. By storing the computer program portions therein, various portions of the memories 102, 106 are physically and/or structurally configured in accordance with computer program instructions.

Network Computer/Server Electronics

Figure 4:
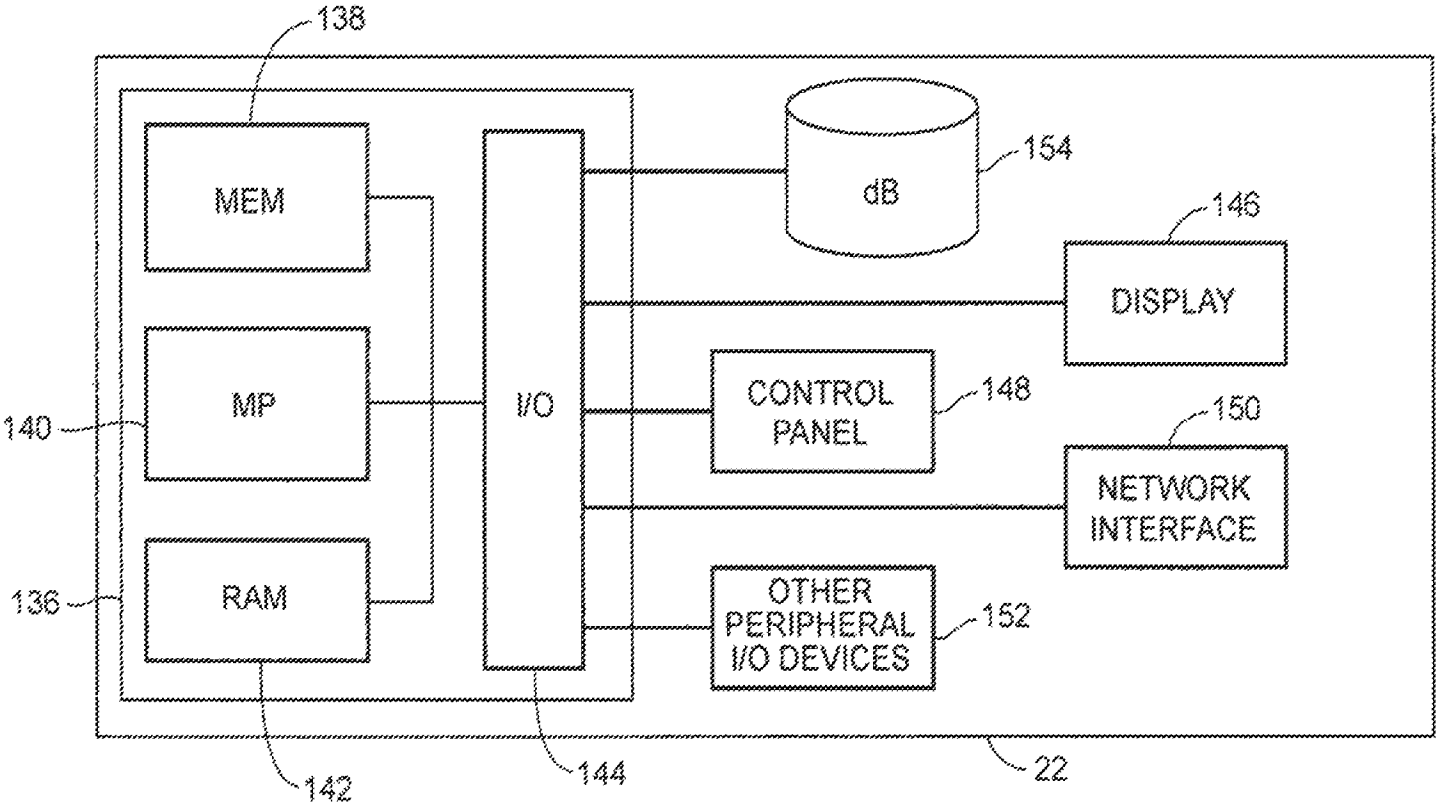
FIG. 4 is a block diagram of the electronic components of a network computer of FIG. 1.

The network 40, and hence the individual gaming units 20, 30, may be communicatively connected to network computers or servers 22, 32. Using network computer 22 as an example, the network computer 22 may be a single networked computer, or a series of interconnected computers having access to the network 10 via a gateway or other known networking system. Referring to FIG. 4, generally, the network computer 22 may include a central gaming controller 136 configured to manage, execute and control the individual gaming units 20, 30 and the routines used to play the multi-player Bingo games. The network computer 22 may include a memory 138 for storing programs and routines, a microprocessor 140 (MP) for executing the stored programs, a random access memory 142 (RAM) and an input/output bus 144 (110). The memory 138, microprocessor 140, RAM 142 and the 110 bus 144 may be multiplexed together via a common bus, as shown, or may each be directly connected via dedicated communications lines, depending on the needs of the network 10.

Further, the network computer 22 may be directly connected, hardwired, or indirectly connected through the 110 bus 144 to external components such as a display 146, a control panel 148, a network interface device 150 and other peripheral 110 devices 152. Examples of other peripherals device include, but are not limited to, storage devices, wireless adaptors, printers, and the like. In addition, a database 154 may be communicatively connected to the central gaming controller 136 and provide a data repository for the storage and correlation of information gathered from the individual gaming units 20, 30. The information stored within the database 154 may be information relating to individual gaming units 20, 30 such as gaming unit-specific information like a gaming unit identification code and/or location code. The database 154 may further include casino game specific information such as the total amounts wagered and paid out, game outcomes, player selection history information, and the like.

Multi-Player Bingo

Figure 5A:
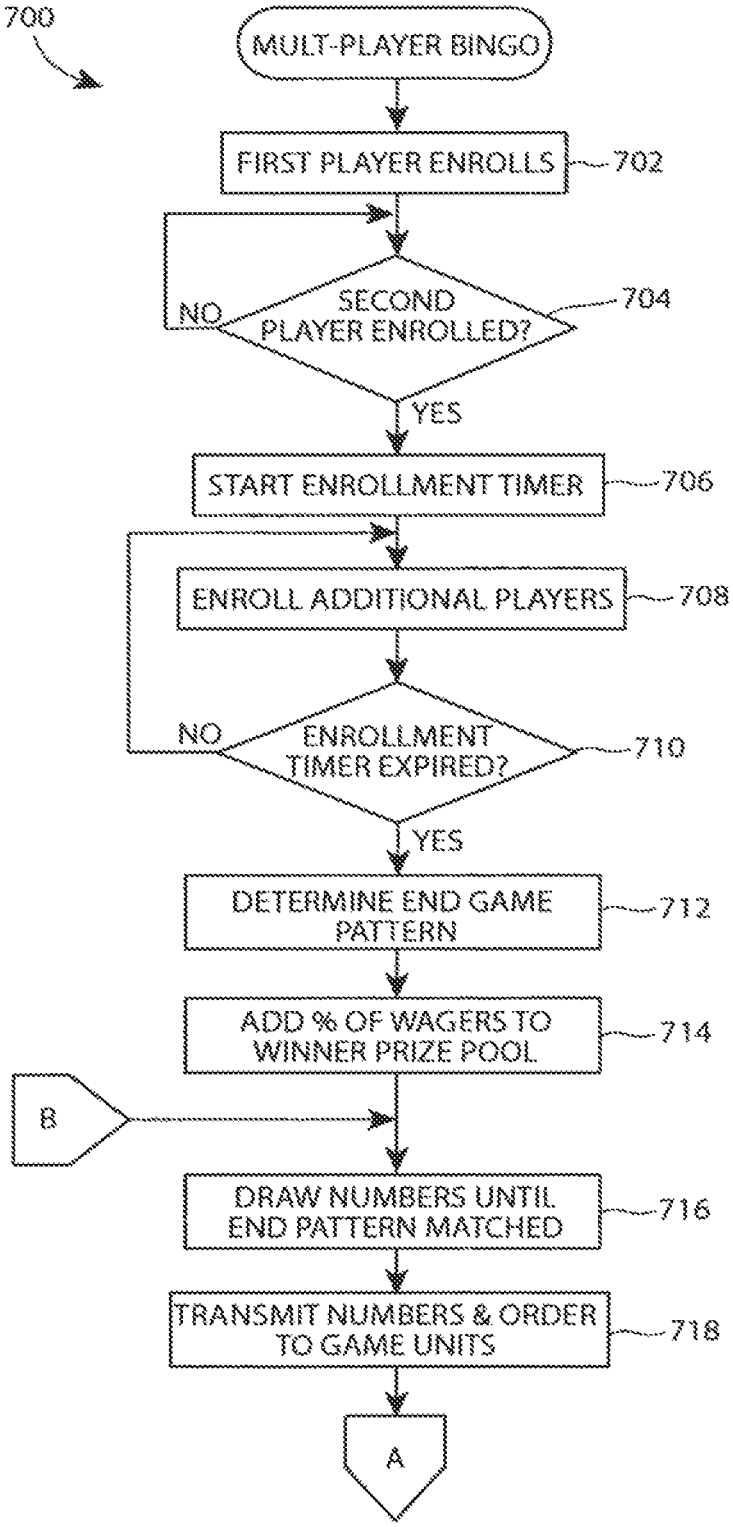
FIGS. 5A and 5B are a flowchart of an embodiment of a multi-player Bingo game routine that may be performed by the gaming network.
Figure 5B:
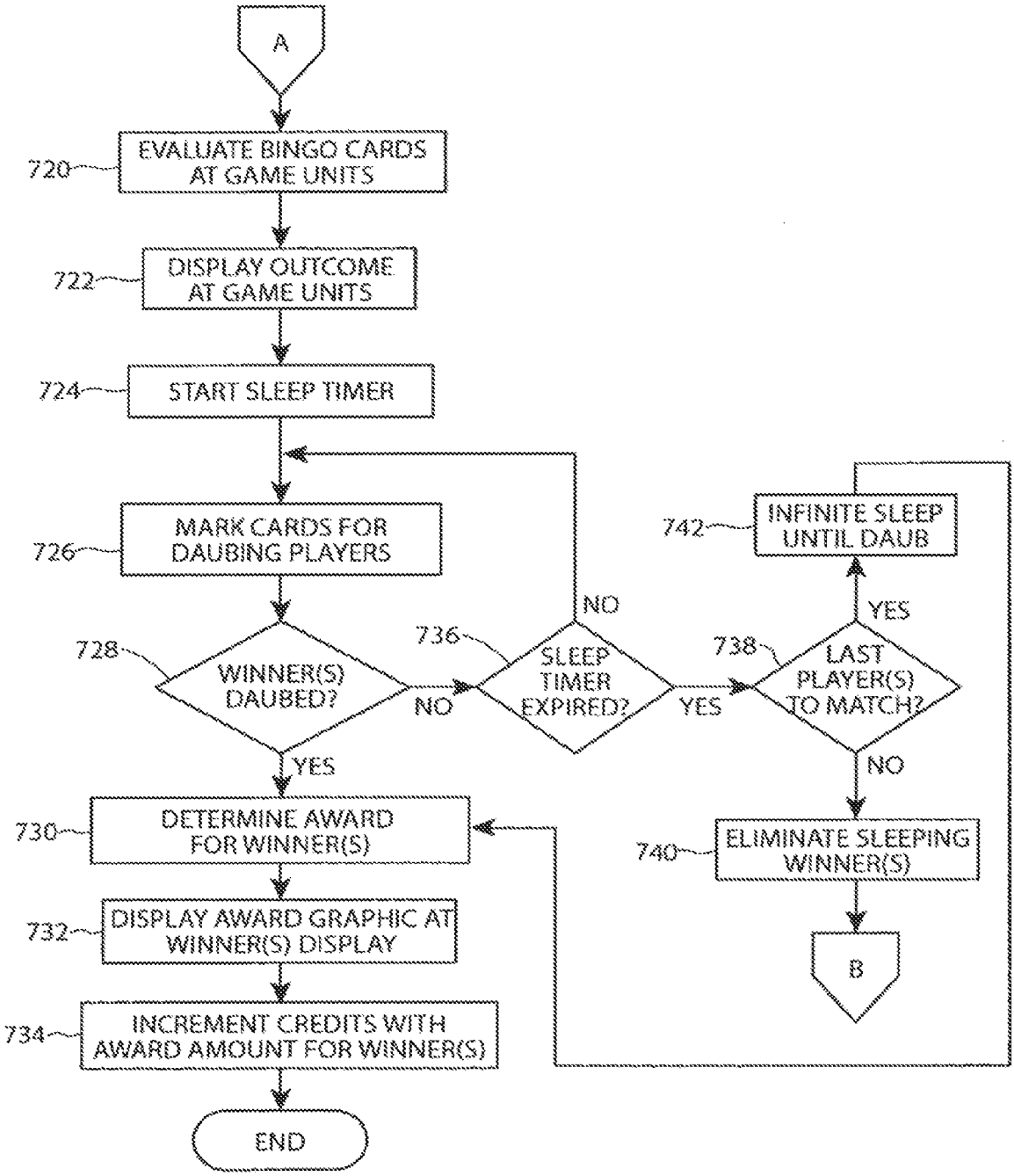

FIGS. 5A and 5B are a flowchart of a multi-player Bingo game operating routine 700 that may have portions stored in the memories of a plurality of gaming units 20 and the network computer 22 to allow a plurality of players to play a Bingo game against each other. Referring to FIG. 5A, the multi-player Bingo routine 700 may begin operation at block 702 at which a first player enrolls in the multi-player Bingo game at one of the gaming units 20. In order to enroll in the multi-player Bingo game, a player may initially deposit value in the gaming unit 20 via the coin slot 52, currency acceptor 54, ticket reader 56, card reader 58, or by any other means by which a player may obtain credits on the gaming unit 20. Once value is deposited and credits are registered on the gaming unit 20, a player may make game-specific selections for the occurrence of the Bingo game via one or more selection buttons at input control panel 66, or by touching designated portions of the video display units 68, 70.

Figure 6:
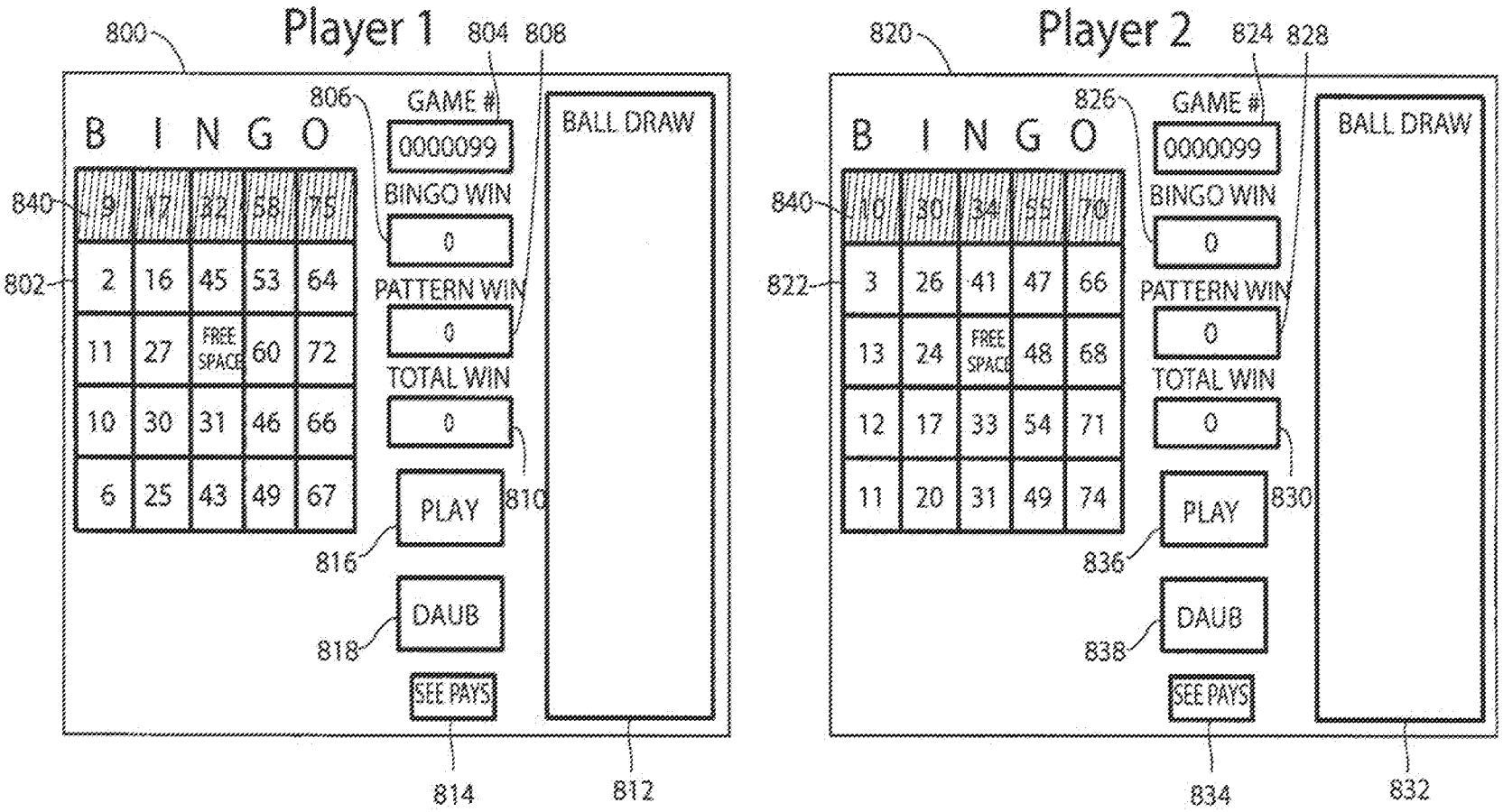
FIG. 6-15 are illustrations of visual displays that may be displayed during the performance of the multi-player Bingo game routine of FIGS. 5A and SB.

FIG. 6 illustrates an exemplary first player display 800 that may be shown on, for example, the display unit 68 during the performance of the multi-player Bingo routine 700 at a first gaming unit 20, and an exemplary second player display 802 that may be shown, for example, on the display unit 68 during the performance of the multi-player Bingo routine 700 at a second gaming unit 20. The first player display 800 may include video images 802 of a Bingo card that may represent the first player's entry in the multi-player Bingo game. In the illustrated embodiment, the Bingo card image 802 may be in the form of a traditional Bingo card as is known in the art and may consist of a 5×5 matrix of numbers, with the first column having five numbers selected from the range of 1 to 15 without repeating numbers, the second column having five numbers selected from the range of 16 to 30 without repeating numbers, the third column having four numbers selected from the range of 31 to 45 without repeating numbers and having a "Free Space" spot disposed in the middle position, the fourth column having five numbers selected from the range of 46 to 60 without repeating numbers, and the fifth column having five numbers selected from the range of 61 to 75 without repeating numbers.

The first player display 800 may include video images 804-810 corresponding to information relating to the game being executed by the network computer 22 and gaming unit 20. These images may include a game number image 804 for the Bingo game being played by the player at the gaming unit 20, a Bingo win amount image 806 displaying the amount awarded to the first player or players matching the game-winning pattern on the Bingo card 802, a pattern win amount image 808 displaying the amount awarded for matching predefined interim win patterns if interim pattern wins are offered with the Bingo game, and a total win amount image 810 displaying the total amount awarded to the player for the Bingo game indicated at game number 804, and an area 812 that may be used to display the numbers in the ball draw for the Bingo game in a manner illustrated more fully below. In addition, the first player display 800 may include images of buttons that, when touched by the player, may cause additional game-related information to be displayed, or may control execution of the multi-player Bingo routine 700.

For example, the first player display 800 may include a "See Pays" button 814 that, when activated, may cause the display unit 68 to generate one or more display screens showing the pattern or patterns to be matched, odds of matching the various patterns or winning the available awards, or other payout information for the Bingo game and the interim pattern wins. The first player display 800 may also display a "Play" button 816 that when touched may cause the gaming unit 20 to enroll the player in the next occurrence of the Bingo game, and a "Daub" button 818 that the player may touch to mark matched numbers on the Bingo card after the ball draw. The term "daub" in Bingo refers to marking or covering by the player, or possibly by an electronic Bingo handset, of the numbers or symbols on the Bingo card(s). With respect to the multi-player Bingo game, "daubing" refers to the player acting to mark or cover the numbers either individually or by initiating a process wherein the gaming unit 20 marks or covers the matched numbers on the Bingo card 802. While not shown, those skilled in the art will understand that a plurality of player-selectable buttons may also be displayed on the first player display 800 of the control panel 66 to allow the player to control the play of the Bingo game. The second player display 820 may be similar to the first player display 800 and display similar images, such as Bingo card 822, game number image 824, Bingo win amount image 826, pattern win amount image 828, total win amount image 830, ball draw area 832, "See Pays" button 834, "Play" button 836, "Daub" button 838, and other control buttons if necessary.

Figure 6A:
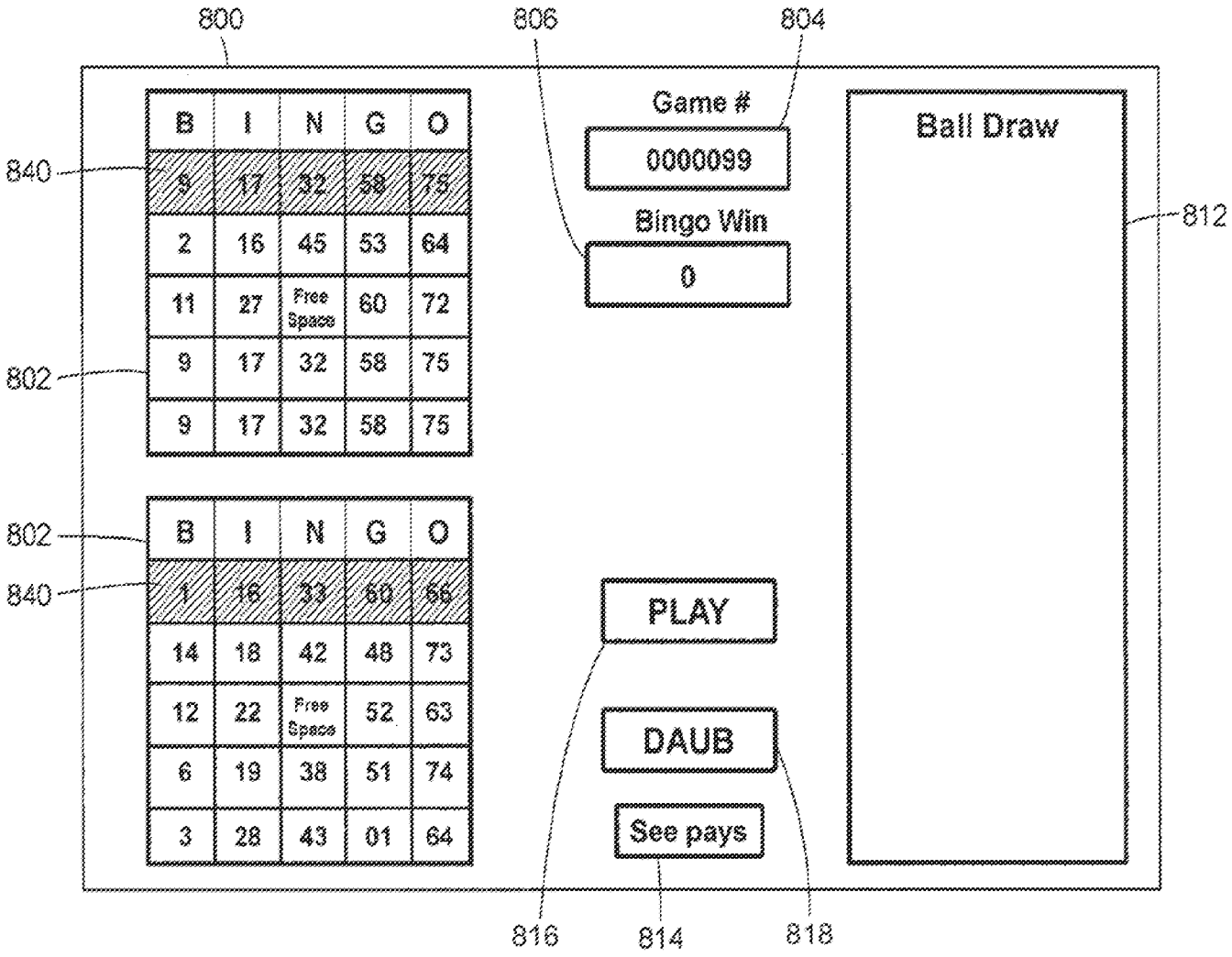

In some implementations of the Bingo game, a player may be permitted to have multiple Bingo cards for an occurrence of the Bingo game. FIGS. 6A-60 illustrate embodiments of the display 800 wherein multiple Bingo cards 802 for an occurrence of the Bingo game may be displayed to the player. Referring to FIG. 6A, the display 800 may simultaneously display a plurality of cards 802 corresponding to the number of Bingo cards selected by the player. As shown in the figure, the size of the cards 802 shown in the display 800 may be reduced so that all of the cards 802 may be displayed in their entirety during the occurrence of the Bingo game. FIG. 6A further illustrates the alternative display 800 for a Bingo game wherein game-winning awards may be won by the players, but interim pattern awards may not be offered. In such implementations, the Bingo win amount image 806 may be displayed without the need for additional pattern win amount and total win amount images 808, 810, respectively.

Figure 6B:
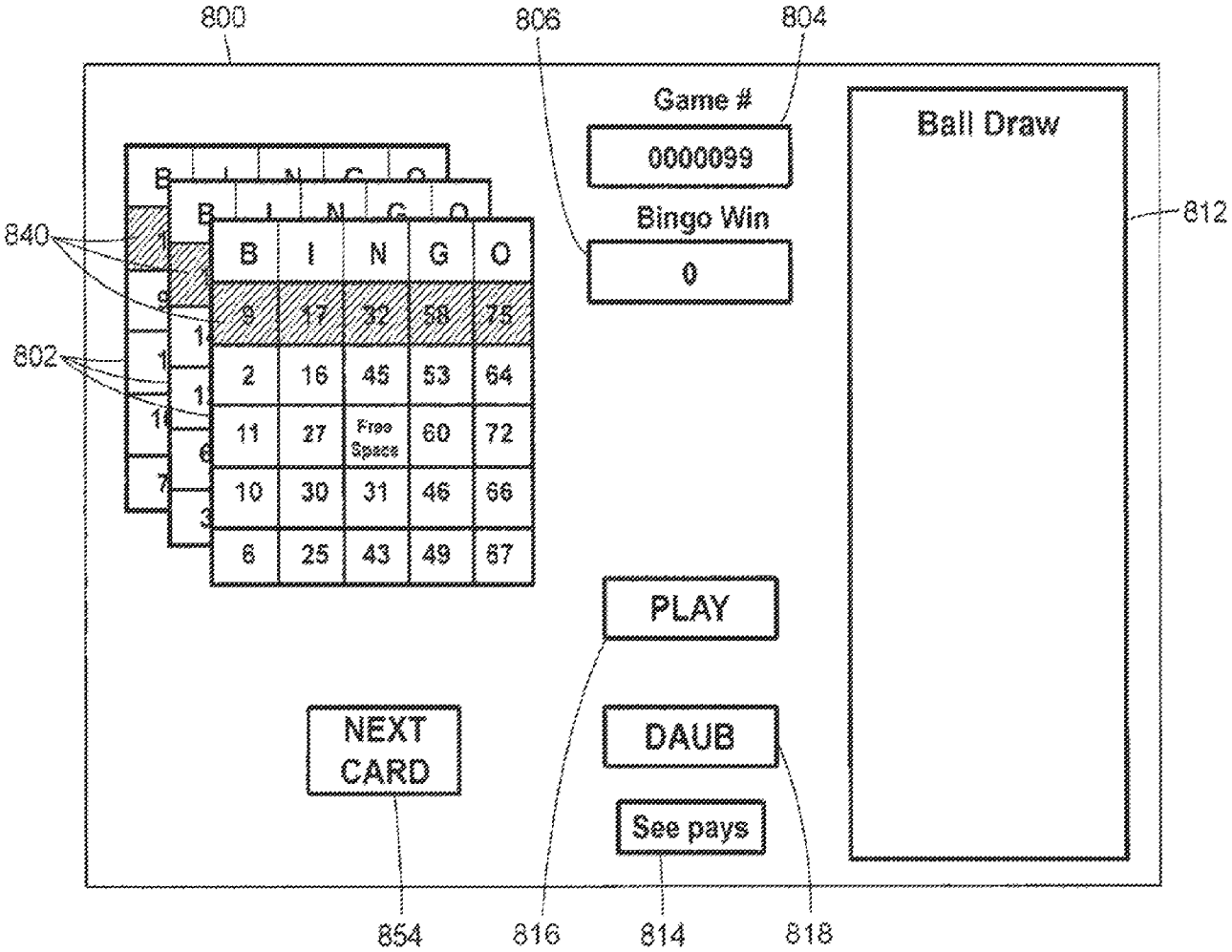
Figure 6C:
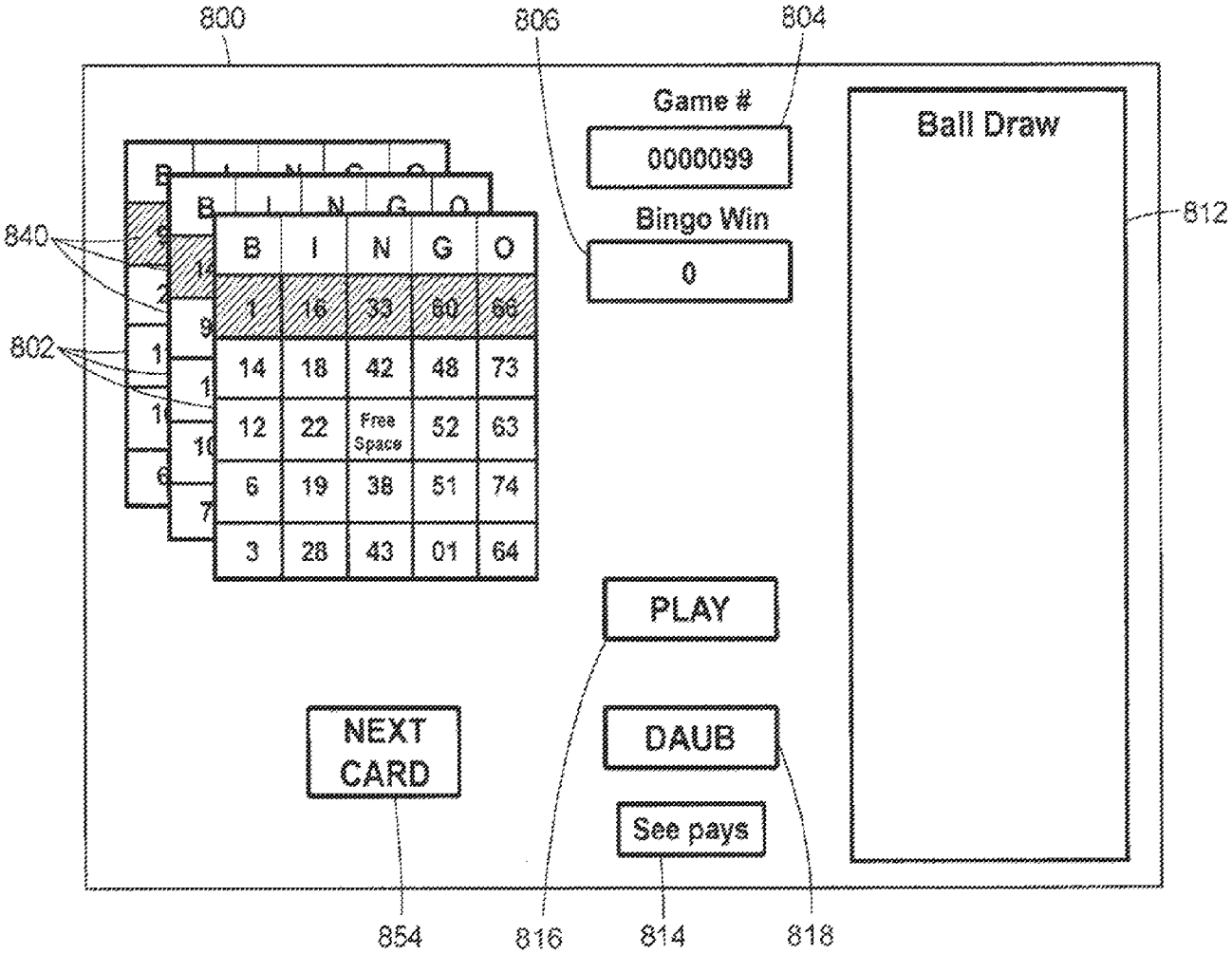

FIGS. 6B and 6D illustrate a further embodiment of the display 800 wherein the size of the Bingo cards 802 may be maintained by illustrating the cards 802 in a cascaded fashion such that the front-most card 802 may be fully visible, with portions of the edges of the remaining cards 802 being visible so that the remaining cards 802 appear to be disposed behind the front-most card 802. In such a cascaded display, the display device 68 may be configured to detect a player touching a visible portion of one of the partially hidden cards 802 on the display 800, and to cause the touched card 802 to appear to move to the front of the stack such that the touched card 802 may be visible in its entirety. Alternatively or additionally, the display 800 may include an additional "Next Card" button 854, and the gaming unit 20 may include additional corresponding control button, that when touched or depressed cause the display 800 to alternately bring each of the cards 802 to the front of the pile for viewing. For example, when the "Next Card" button 854 is touched on the display 800 of FIG. 6B, the controller 100 may cause the display 800 to make the card 802 with the number "9" in the top position of the "B" column to shift the back of the pile of cards 802 so that the card 802 with the number "1" in the top position of the "B" column may be fully displayed as shown in FIG. 6C. Of course, other displays 800 are contemplated wherein multiple cards 802 may be fully or partially displayed, and with the gaming unit 20 being configured to allow the player to cycle alternately view each of the cards 802 being used during the occurrence of the Bingo game.

While the Bingo game illustrated herein uses a traditional 5×5 matrix of numbers with a free space in the center, those skilled in the art will understand that the Bingo game may be configured to use other configurations of numbers, characters or other game indicia arranged in any fashion wherein numbers, characters, or other indicia may be drawn and compared to the configuration, with the first player or players matching a predetermined pattern of numbers, characters or other indicia being declared the winner. For purposes of this specification, such configurations of numbers, characters or other game indicia may be referred to as "arrays," and an array may be any configuration or grouping of numbers, characters or other game indicia wherein the game indicia of the array may be compared to game indicia drawn from the range of game indicia available for the multi-player game, and wherein matched indicia of the array may be compared to a predetermined pattern or patterns in order to determine a winner or winners of an occurrence of the multi-player wagering and/or to award game-winning or other awards to the players. Such arrays may be configured as two-dimensional matrices such as, for example, traditional Bingo cards as described above, or in any other arrangement of game indicia wherein matched game indicia of the array may form patterns.

When the first player enrolls in the Bingo game, the Bingo card or cards 802 may be selected at random by the controller 100 of the gaming unit 20. While an occurrence of the Bingo game wherein each player has only one card 800 is illustrated for purposes of the general discussion of the game play of the Bingo game and evaluation of the Bingo cards, it will be understood that the game play and evaluation of the Bingo cards are generally similar in embodiments wherein players may have multiple cards for an occurrence of the Bingo game. Various aspects of such multicard embodiments will be discussed more thoroughly below. The player may be required to play the controller-generated Bingo card 802 or, alternatively, the player may be permitted to view other Bingo cards 802 and to select a Bingo card 802 for use in the Bingo game. For example, once the controller-selected Bingo card 802 is displayed to the player at video display 68, the player may be able to cycle through other Bingo cards 802 by touching the area of the video display 68 where the Bingo card 802 is displayed, or by touching other appropriate buttons either displayed on the video display 68 or located at the control panel 66. While the players may be generally be able to select the Bingo card or cards 802 for the occurrence of the wagering game, it should be noted that the gaming units 20 and network computer 22 should prevent identical Bingo cards 802 to be enrolled in a given occurrence of the Bingo game, either for a single player playing multiple Bingo cards 802 or for different players each attempting to enroll the same Bingo card 802. In addition to being assigned and/or selecting a Bingo card 802, the player may also enter a wager amount for the Bingo game by pressing the appropriate selection buttons on the first player display 800 or control panel 66. Selection of the wager amount is discussed further herein below. Once the Bingo card is selected for the first player, and the player enters a wager for the Bingo game, the player may enroll in a Bingo game by pressing the "Play" button 816. When the controller 100 detects that the first player has touched the "Play" button 816, the controller 100 may transmit a message to the network computer 22 indicating that the first player has enrolled in the Bingo game. In the illustrated embodiment, the gaming unit 20 may also transmit information to the network computer 22 regarding the content of the first player's Bingo card for use by the network computer 22 in a manner discussed more fully below.

Because each Bingo game is played by multiple players, the network computer 22 may be required to wait for the enrollment of additional players before drawing numbers for the occurrence of the Bingo game. Referring back to FIG. 5A, the network computer 22 may determine whether a second player has enrolled in the Bingo game and another gaming unit 20 at block 704. If the network computer 22 has not received a message from another gaming unit 20 indicating that a second player has enrolled in the Bingo game, the network computer 22 will continue to wait until receiving such a message. At the same time, the first gaming unit 20 may display a message on the first player display 800 informing the first player that the system is waiting for additional players to join the Bingo game before beginning the ball draw.

At some point, a second player at a second gaming unit 20 may select a Bingo card and desired wagering amount, and touch the play button 836 of the second player display 820 to enroll in the Bingo game. The second gaming unit 20 may detect the touching of the play button 836 by the second player and transmit the necessary enrollment message to the network computer 22 to enroll the second player. When the network computer 22 detects the enrollment message from the second gaming unit 20, control may pass to a block 706 wherein the network computer 22 may start an enrollment timer for a predetermined period of time within which additional players may enroll in the Bingo game. The enrollment period may be a fixed amount of time for all occurrences of the Bingo game, or may be capable of being changed to a desired time period by a casino employee at the network computer 22. Further, the network computer 22 may be programmed to adjust the time period dynamically as the Bingo game is being played in order to maintain a desired average number of players. For example, the network computer 22 may reduce the time period during heavy play periods to prevent too many players from enrolling, and increase the time period during light play periods to give more players the opportunity to enroll in an occurrence of the Bingo game.

During the enrollment time period, the network computer 22 and other gaming units 20 may enroll additional players in the Bingo game at block 708. The enrollment process for the additional players may be similar to the process for the first two players, with each additional player selecting a Bingo card, selecting a wager amount, and touching the play button of the gaming unit 20 and thereby causing an enrollment message to be transmitted from the gaming unit 20 to the network computer 22. If the gaming units 20 include alternative outcome displays for displaying the outcome of the Bingo game in an alternative format, such as a slots display as discussed below, animated graphics or other display, such as the spinning of video or electro-mechanical reels, may be initiated at the gaming units 20 once the second player enrolls in the Bingo game. At block 710, the network computer 22 evaluates the enrollment timer to determine whether the time for additional players to enroll in the Bingo game has expired. If the enrollment timer has not expired, the network computer 22 continues to wait for additional players to enroll in the Bingo game. Once the enrollment timer expires, the network computer 22 proceeds with conducting the Bingo game for the players that have enrolled in that occurrence of the Bingo game. Any players enrolling after the expiration of the enrollment timer may be enrolled in the subsequent occurrence of the Bingo game in the same manner. Consequently, the network computer 22 may conduct multiple occurrences of the Bingo game simultaneously.

A game-winning pattern or patterns may be predetermined and used for each occurrence of the Bingo game. Alternatively, at block 712 the network computer 22 may determine a game-winning pattern to be used for the occurrence of the Bingo game. The network computer 22 may store a plurality of predetermined game-winning patterns and randomly or serially select one or more of the stored game-winning patterns for each occurrence of the Bingo game. The predetermined game-winning patterns may include game-winning patterns used in traditional Bingo games, such as rows, columns or diagonals of numbers on the Bingo card 802, four corners matches, picture frames, coveralls, and the like. The predetermined patterns may also include nontraditional game-winning patterns such as patterns forming letters, numbers, or other symbols, or any other desired pattern that may be formed by one or more of the numbers, characters, or other game indicia used to form the Bingo card 802 for a player. Alternatively, the game-winning pattern for a given occurrence of the Bingo game may be determined at least in part on the number of players entered for the occurrence of the Bingo game in order to approach a desired distribution of the number of balls drawn for the first player to match the game winning pattern in a manner described more fully below. This may be desirable in implementations where the number of cards may vary from occurrence to occurrence of the Bingo game, but may not be necessary where the number of cards per occurrence of the game is fixed. Whether based the number of players or Bingo cards enrolled for the occurrence of the Bingo game or other criteria, the game-winning patterns may be generated randomly but consistent with predesignated parameters, such as number of spots in the game-winning pattern, number of shared spots between two or more game-winning patterns, and the like. Once the game-winning pattern is determined, the network computer 22 may transmit the game-winning pattern to the gaming units 20 which in turn may display the game-winning pattern to the players on the Bingo displays 800, 820, such as with a shaded area 840 on the Bingo cards 802, 822 corresponding to the game-winning pattern.

In some implementations of the multi-player Bingo game, the first player or players matching the game-winning pattern may be awarded a fixed prize amount, a prize amount proportionate to the amount wagered by the player or players on the occurrence of the Bingo game, or a prize amount determined at least in part on the number of balls required to match the game-winning pattern. In this embodiment, a portion of each players wager on each occurrence of the Bingo game may be accumulated in a prize pool from which players may be awarded an additional prize amount for matching the game-winning pattern or other pattern in fewer than a predetermined number of balls are drawn for the occurrence of the Bingo game. For example, a player may be awarded an additional prize from the prize pool for matching a five number pattern when ten or fewer balls have been drawn, or by covering the entire Bingo card when fewer than 30 balls have been drawn. The amount of the additional prize from the prize pool may be determined in a manner described more fully below. In this embodiment, control may pass to a block 714, wherein a percentage or other predetermined portion or each player's wager on the occurrence of the Bingo game may be added to a prize pool. The portion of each players wager for the prize pool may be determined at each gaming unit 20 and transmitted to the network computer 22 or other device in the gaming network 10 where at the prize pool is accumulated and stored. Alternatively, the network computer 22 may deduct the portion for the prize pool from each of the players' wagers after the players enroll in the Bingo game. While block 714 is illustrated as occurring prior to the ball draw, the additions to the prize pool may occur at any appropriate or desired time during the Bingo game.

In this embodiment, control of the Bingo game routine 700 may pass to a block 716 wherein the network computer 22 draws numbers from the range of 1 to 75 until one or more Bingo card matches the game-winning pattern. The network computer 22 may be configured to randomly select numbers from the range of 1 to 75 without repeating numbers, and to compare the drawn number to the numbers on each players Bingo card to find matching numbers. As each number is selected and compared to the player's game cards, the network computer 22 may also compare the patterns formed by the matching numbers on each game card to the game-winning pattern for the occurrence of the Bingo game. Once the network computer 22 determines that one game card has a pattern of matched numbers matching the game winning pattern, the network computer 22 may cease selecting numbers for the ball draw and transmit the numbers for the ball draw to the gaming units 20 corresponding to each player entered in the occurrence of the Bingo game at block 718.

Figure 7:
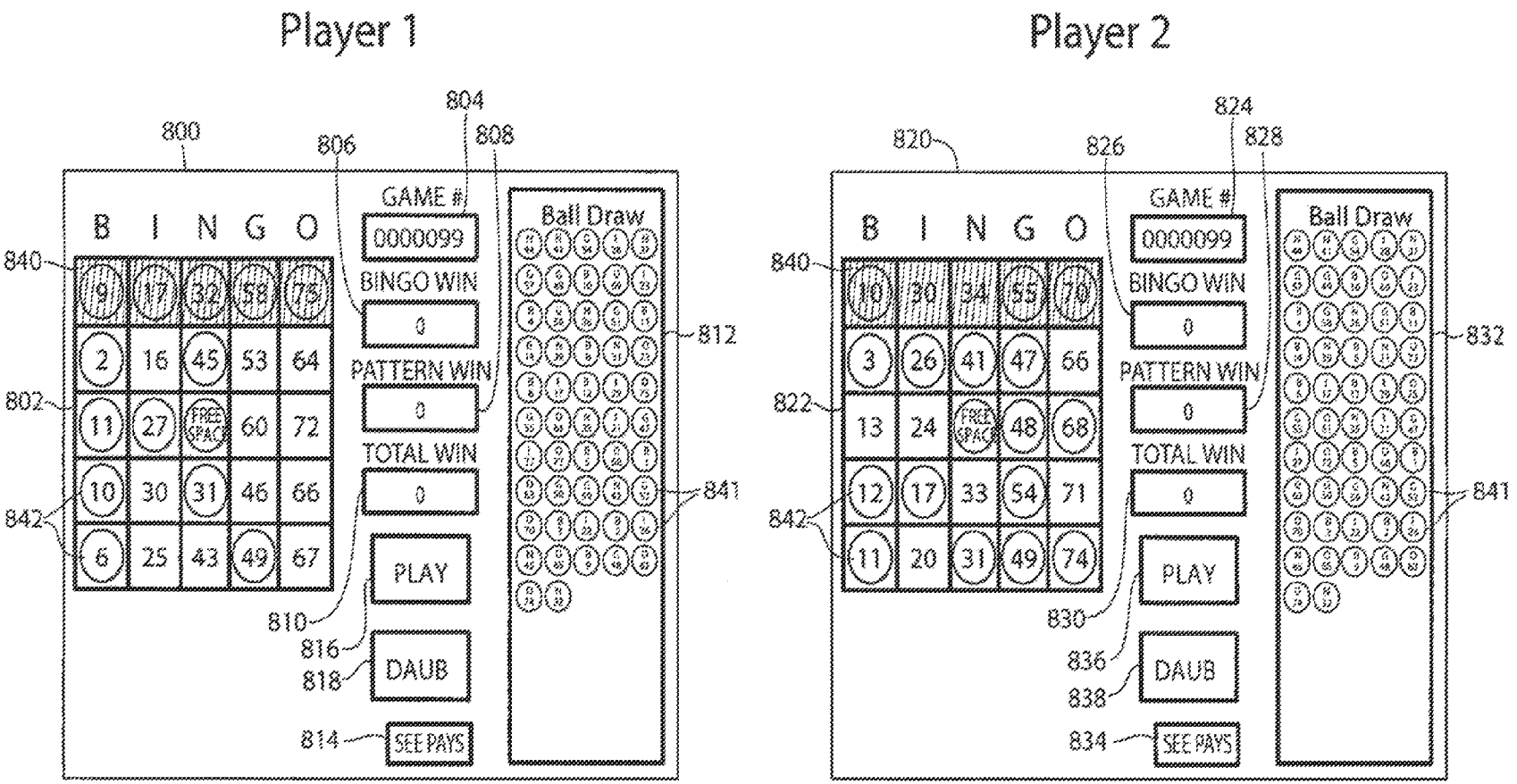

The gaming units 20 receive the numbers for the ball draw from the network computer 22, and compare the drawn numbers to the corresponding players' Bingo cards at block 720 of FIG. 5B in a similar manner as the network computer 22 to identify matches between the numbers in the ball draw and the numbers on the players Bingo card. After comparing the numbers from the ball draw to the numbers on the player's card, the gaming unit 20 may further determine whether patterns formed on the player's Bingo card matches the game-winning pattern for the occurrence of the Bingo game. At block 722, each gaming unit 20 may display the outcome of the ball draw for the Bingo game at the display unit 68. In the illustrated embodiment (FIG. 7), the numbers for the ball draw may be displayed on the Bingo displays 800, 820 in the ball draw areas 812, 832, respectively, with the numbers being displayed in the order the numbers were selected by the network computer 22. The ball draw display may further be enhanced to match the Bingo theme by encircling each number, or graphically displaying each number as being printed on the surface of a ball 841, and by further adding the associated letter from the word "Bingo" corresponding to the column of the Bingo card in which the number would appear. Further, where interim pattern awards may be available and interim patterns may be evaluated using a predetermined maximum number of the balls from the ball draw as discussed further below, the numbers used for the interim pattern awards may be displayed with distinctive markings, coloration or other distinguishing indicia for easy identification. Additionally, the numbers on the players' Bingo cards 802, 822 matching numbers selected by the network computer 22 in the ball draw may be highlighted on the Bingo cards 802, 822, such as by displaying phantom marks 842 to assist the players in identifying which numbers on the Bingo cards 802, 822 have been matched.

Figure 8:
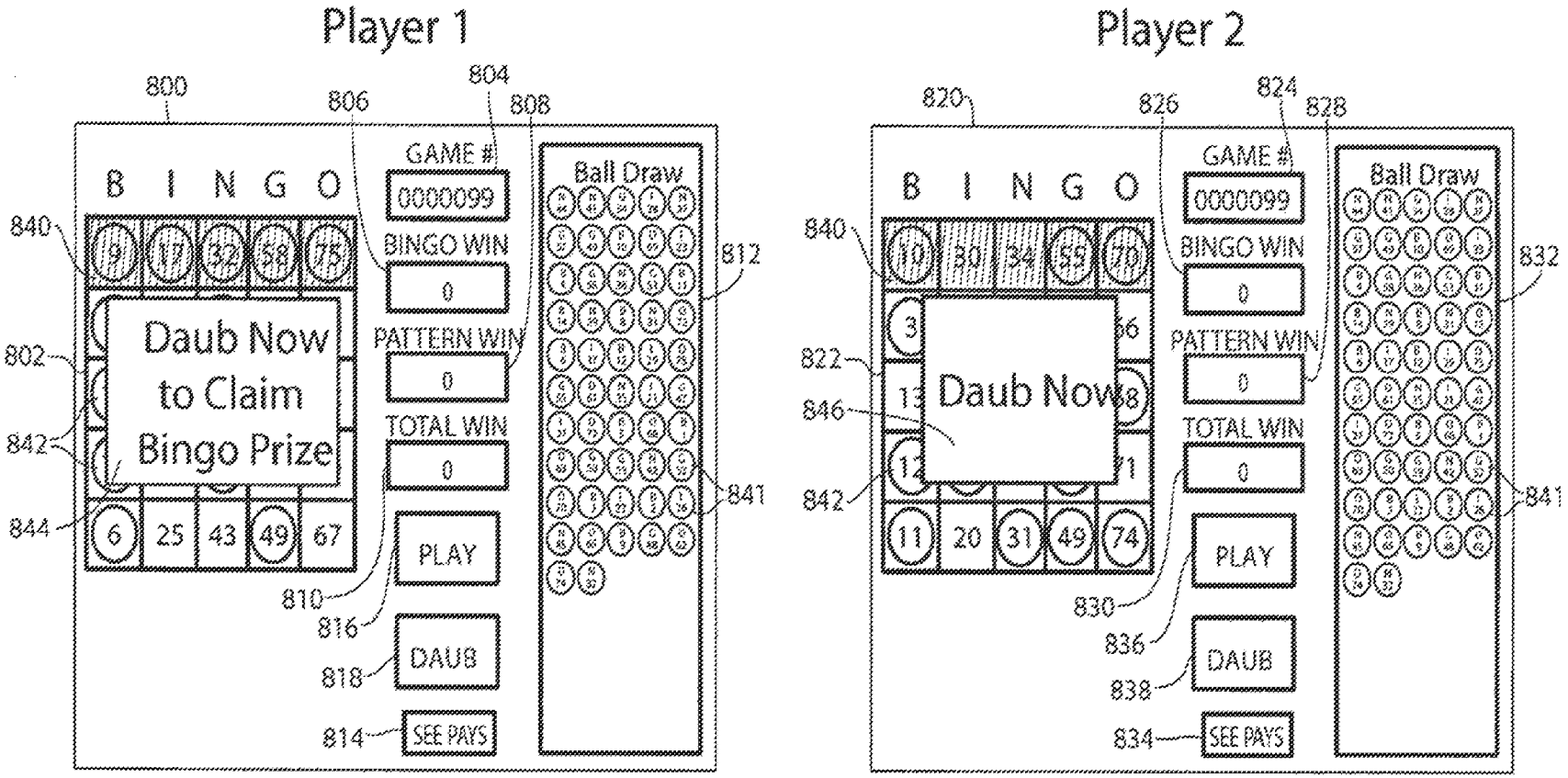

The multi-player Bingo game may be implemented such that once at least one player matches the game-winning pattern, the game is over and the player or players matching the game-winning pattern receive the corresponding Bingo win award. If the gaming units 20 include alternative outcome displays for displaying the outcome of the Bingo game in an alternative format, the alternative outcome display may also show the player's outcome for the Bingo game, such as by stopping the reels of slots display in positions corresponding to the outcome of the Bingo game. However, the multi-player Bingo game may be implemented such that the players may be required to perform a physical act to cause the matching numbers to be marked on the players' Bingo cards. In fact, such a physical act may be a regulatory requirement in the jurisdiction in which the multi-player Bingo game is implemented. In the embodiment of the Bingo game routine 700 illustrated in FIGS. 5A and 5B, players may be required to daub in order to have the matching numbers marked on their Bingo cards, and the winning players may be required to daub their Bingo cards in order to claim the award for the occurrence of the Bingo game. In this embodiment, at block 722, each gaming unit 20 may be configured to display prompts to the players, such as prompts 844, 846 on the Bingo displays 800, 820, respectively, of FIG. 8, instructing the players to daub in order to complete the Bingo game. The same prompt may be displayed for all players, or different prompts may be displayed to players who may have a winning Bingo card. For example, as illustrated in FIG. 8, the first player with Bingo card 802 may be one of the first players to match the game-winning pattern. In this case, the prompt 844 displayed to the first player may instruct the player to daub the Bingo card to claim the Bingo game prize. The Bingo game prize may be claimed by the winning player by touching the "Daub" button 818 to acknowledge the prompt. The remaining players, such as the second player, that have not matched the game-winning pattern may be shown a prompt 846 that may merely instruct the players to daub in order to complete the Bingo game, which may be accomplished by touching the "Daub" button 838.

Figure 9:
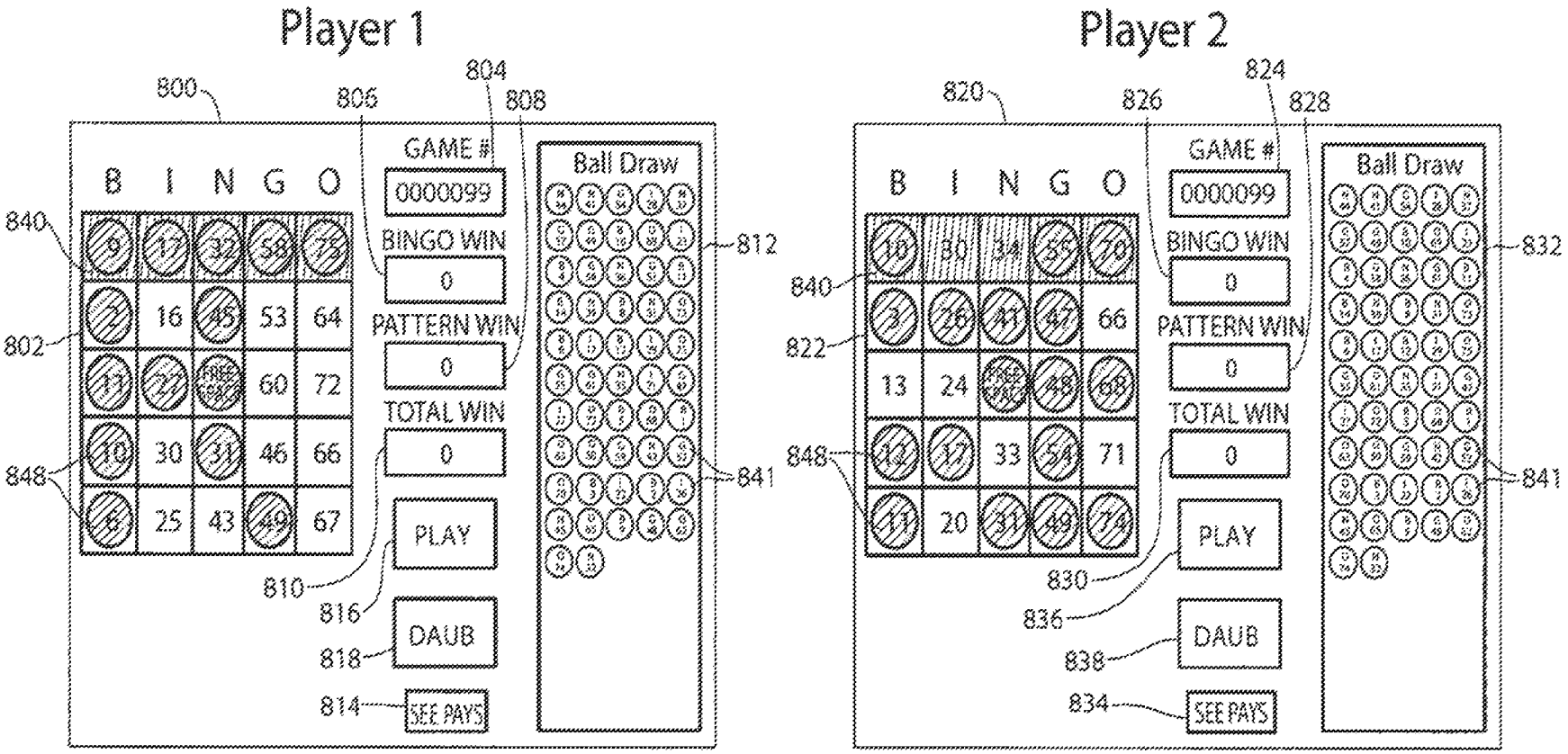

Once the initial ball draw is transmitted from the network computer 22 to the gaming units 20, and the ball draw and phantom marks 842, if any, are displayed to the players at their respective gaming units 20, control may pass to a block 724 wherein a sleep timer may be initiated with a predetermined amount of time within which the winning player or players must daub their Bingo cards in order to claim the Bingo game award. A sleep timer may be set at each gaming unit 20 at which the player matches the game-winning pattern, or a single timer may be set at the network computer 22. During the sleep timer period, the gaming units 20 may mark the matching numbers on the players Bingo cards as the players touch the corresponding "Daub" buttons 818, 838. Shown in FIG. 9, the phantom marks 842 on the Bingo cards 802, 822 may be changed into daub marks 848 by the gaming units 20 as the gaming units 20 detect the players touching the "Daub" buttons 818, 838. Also during the sleep timer period, the network computer 22 and/or gaming units 20 may evaluate whether one or more players matching the game-winning pattern has daubed the players Bingo card at block 728. If the winner or winners of the occurrence of the Bingo game have daubed their Bingo cards, control passes to a block 730 wherein the Bingo win award may be determined for the winning player or players at either the corresponding gaming units 20, or at the network computer 22.

Figure 10:
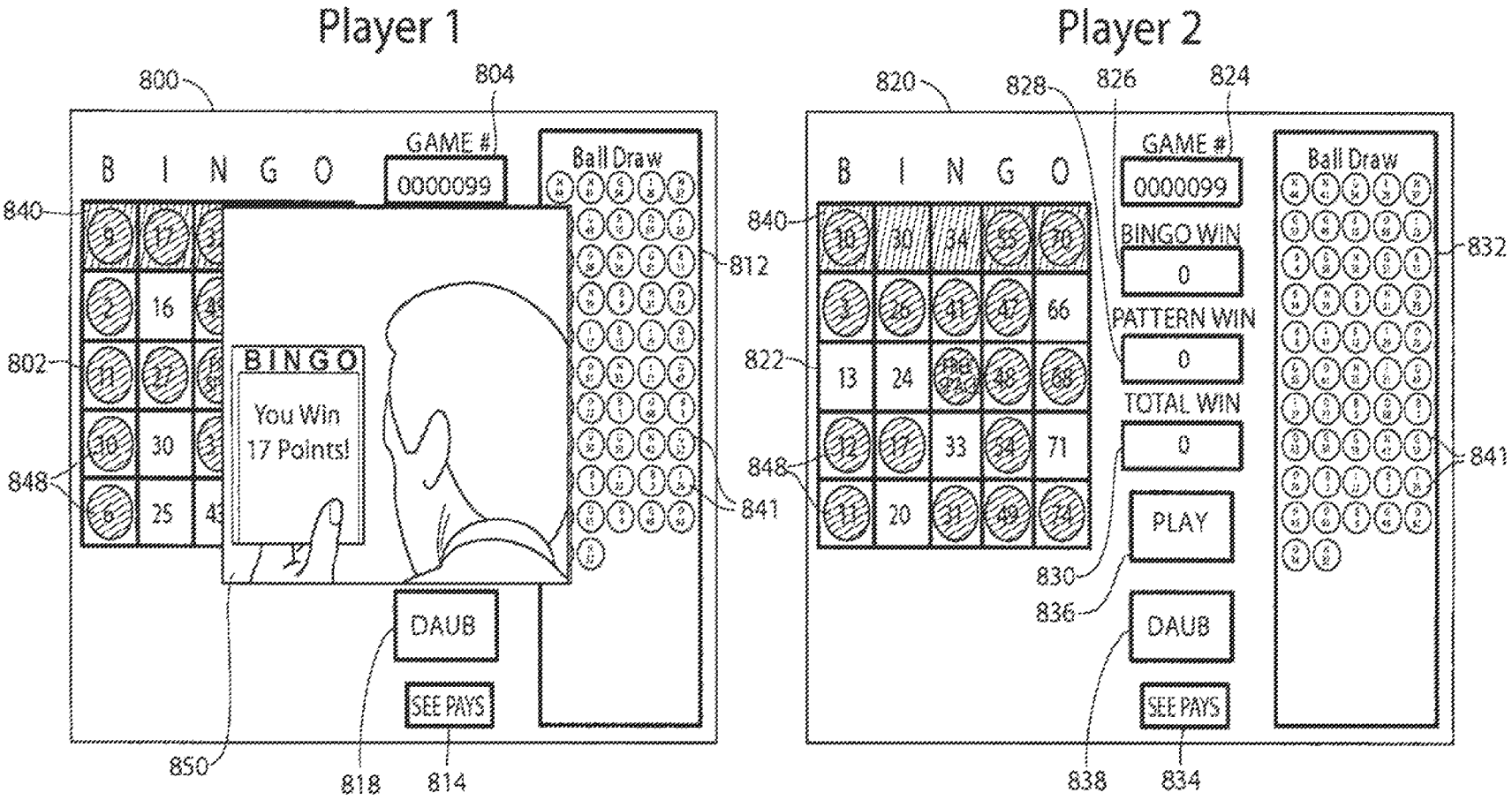
Figure 11:
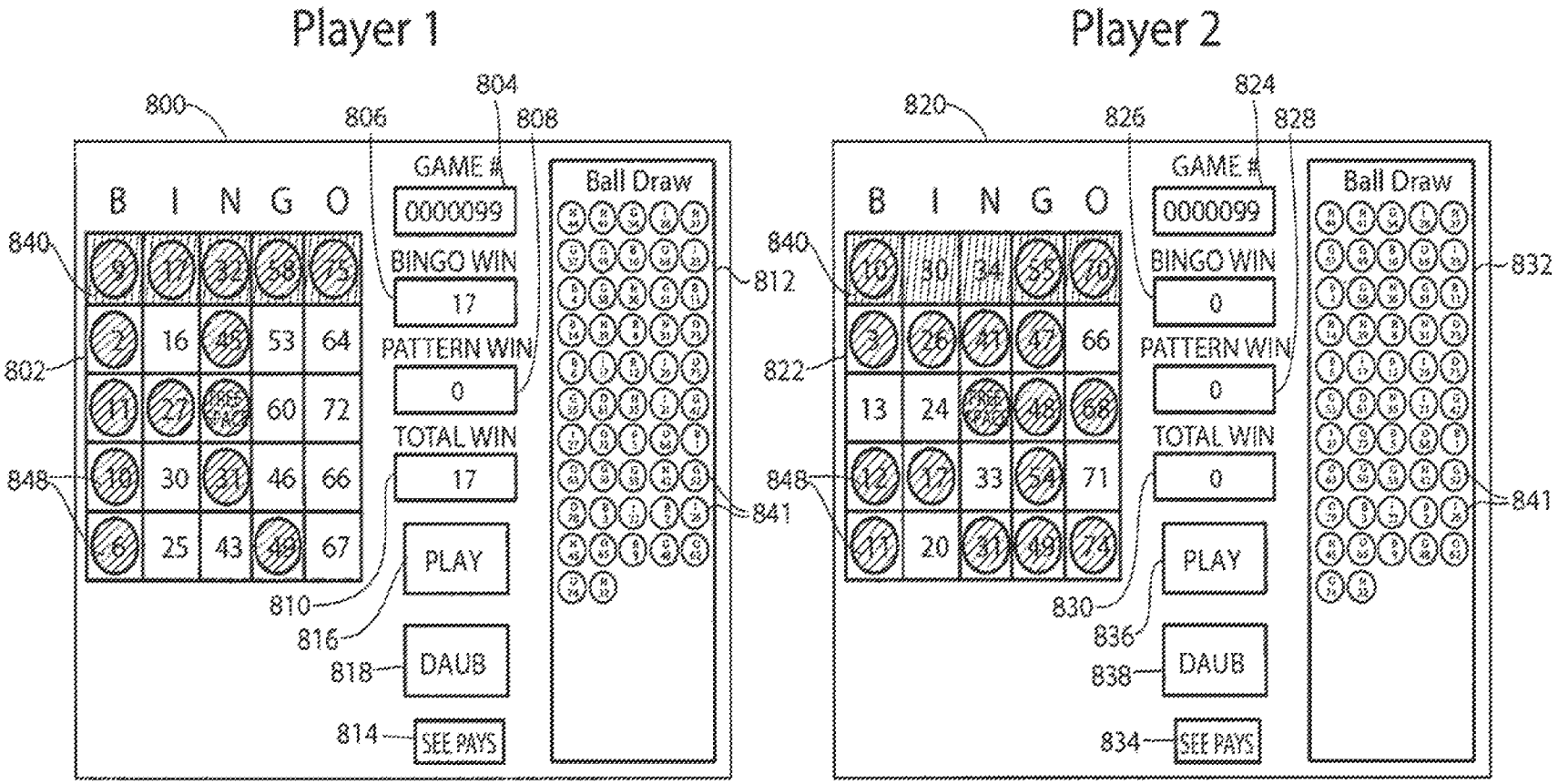

After the Bingo game award or awards are determined, control may pass to block 732 wherein an award image, such as the award image 850 illustrated in FIG. 10, may be displayed to the winning players at the corresponding gaming units 20. The award image 850 may include a summary of the award amount, a congratulatory message to the winning player or players, and other images that may enhance the winning experience of the player or players. The award image 850 may be displayed for a predetermined amount of time or until the player touches the display unit 68 to acknowledge the display of the game award. At this time, an alternative outcome display at the gaming unit 20 may also show the player's outcome for the Bingo game, such as by stopping the reels of slots display in positions corresponding to the outcome of the Bingo game. After the award graphic is displayed, control may pass to a block 734 wherein the credits at the gaming units 20 for the winning players are incremented by the award amount. As illustrated in FIG. 11, the Bingo game award may further be reflected at the Bingo display 800 by updating the Bingo win amount image 806 and the total win amount image 810 to reflect the amount won by the player for the corresponding Bingo game.

If the network computer 22 and game units 20 do not detect that the winner or winners of the Bingo game have daubed their Bingo cards at block 728, control passes to a block 736 that determines whether the sleep timer has expired. If the sleep timer has not expired, control passes back to block 726 wherein the gaming units 20 continue to mark the Bingo cards of the corresponding players as the players touch the "Daub"

button 818, 838. If the sleep timer expires without any winner or winners of the Bingo game daubing their Bingo cards, control passes to a block 738 wherein the network computer 22 may determine whether all the players have slept through their opportunity to win the Bingo game. If players remain that have not slept through their opportunity to win the Bingo game, i.e., players whose Bingo cards have not yet matched the game-winning pattern, control passes to a block 740 wherein the winner or winners who have failed to daub their Bingo cards are eliminated from being able to claim the prize for the Bingo game. For example, after the potential winner sleeps through the player's opportunity to win the Bingo game, the network computer 22 may flag or otherwise indicate that the player has slept through the player's opportunity to win the occurrence of the Bingo game. Additionally, the players sleeping through the period for daubing the players' winning Bingo cards may be notified that the right to claim an award for the Bingo game has been relinquished by displaying an image on the video display 68 of the corresponding gaming unit 20, such as the image 852 on the Bingo display 800 shown in FIG. 12. However, where multiple game-winning patterns are used in the Bingo game, a player sleeping through a match of one of the game-winning pattern may be eliminated from claiming that Bingo win, but may be permitted to win the Bingo game if the player matches another game-winning pattern later in the ball draw and successfully daubs their Bingo card.

For security purposes, it may be desired to implement measures to prevent players from sleeping their pattern matches in order to defraud or otherwise gain an advantage on the game. For example, the award amount may be limited to the amount that may have been won by the first player to match a game-winning pattern to prevent that player from intentionally sleeping the Bingo game win to allow another player the opportunity to receive additional drawn numbers and, consequently have a greater chance at winning a larger award.

Figure 12:
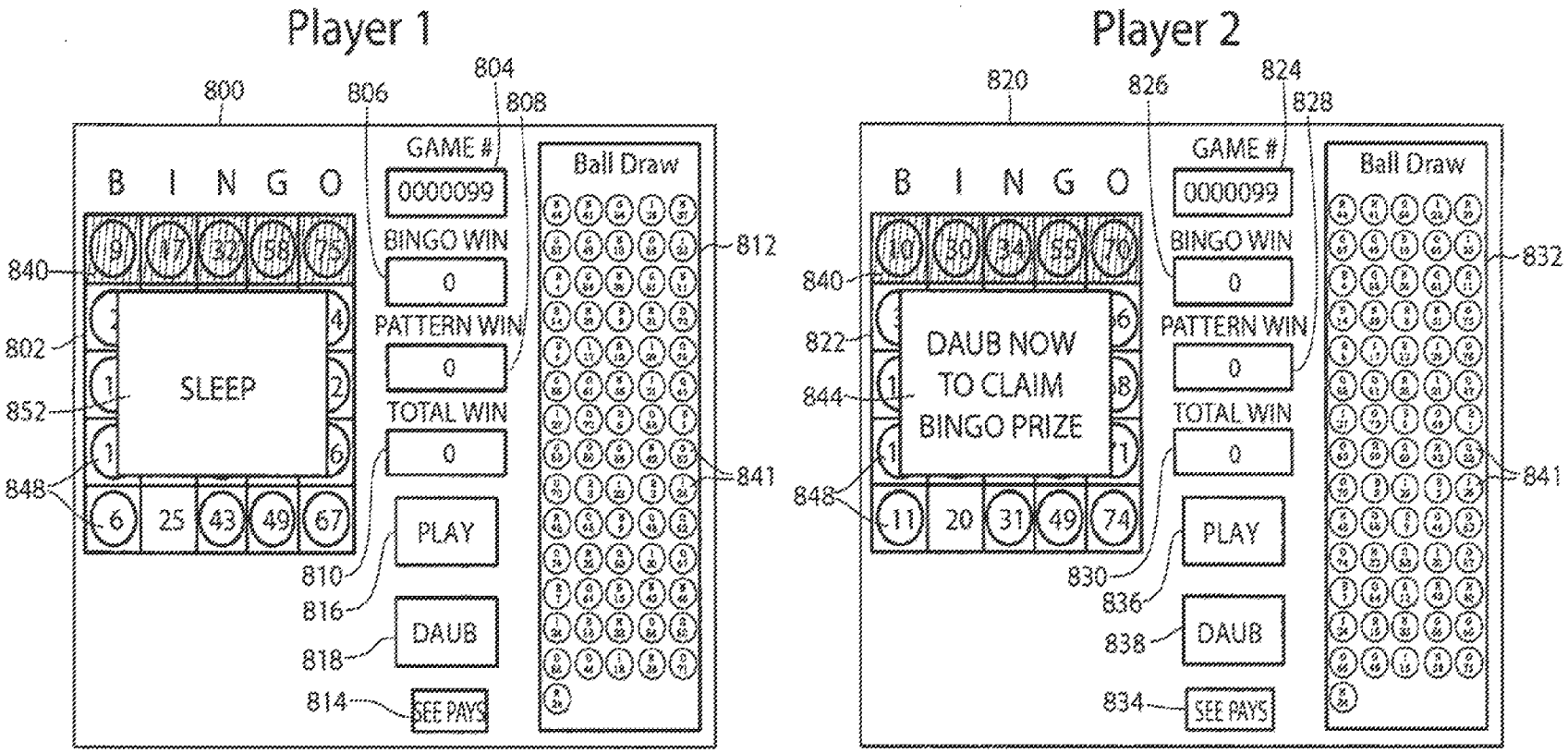
Figure 13:
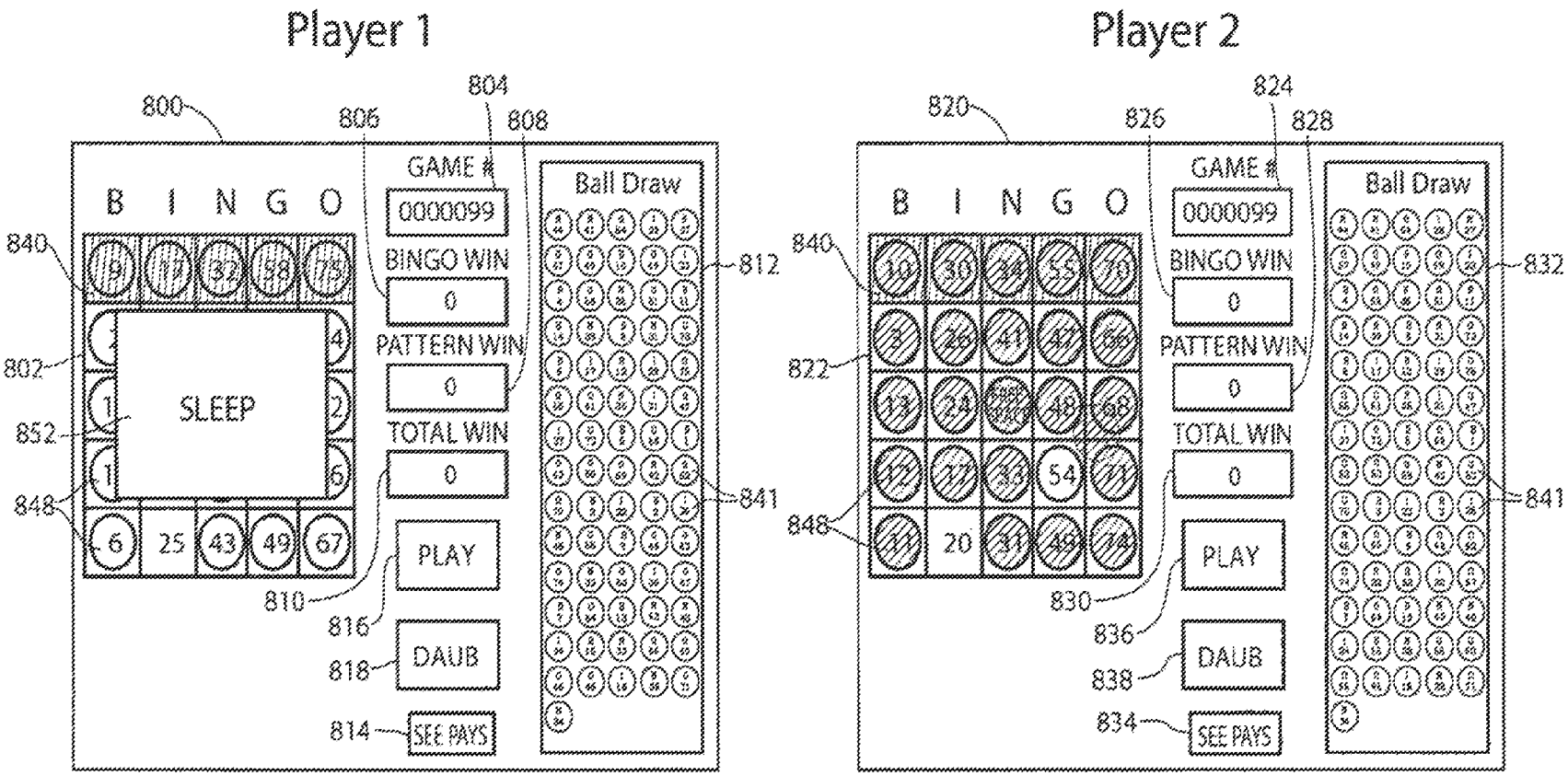
Figure 14:
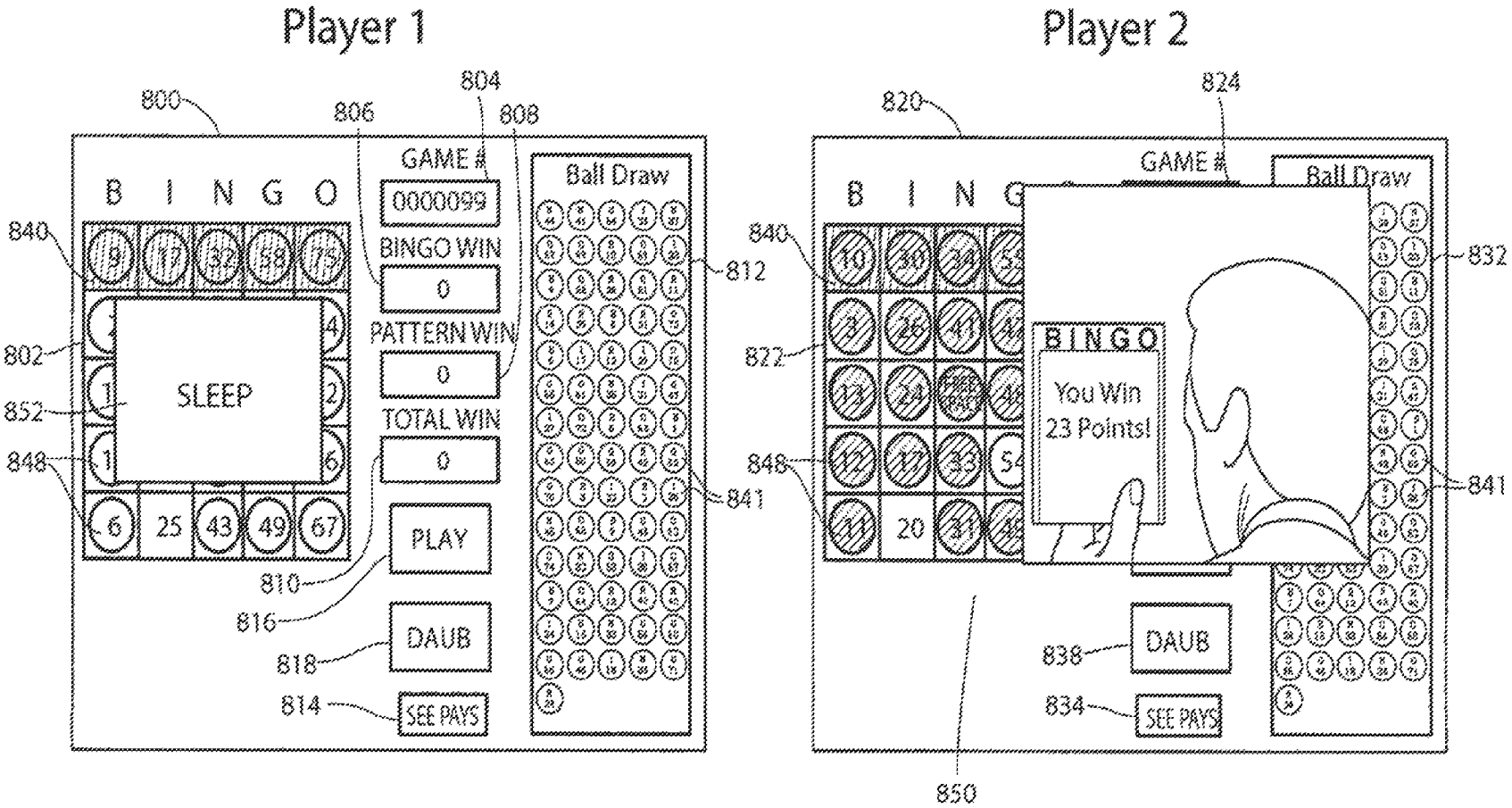
Figure 15:
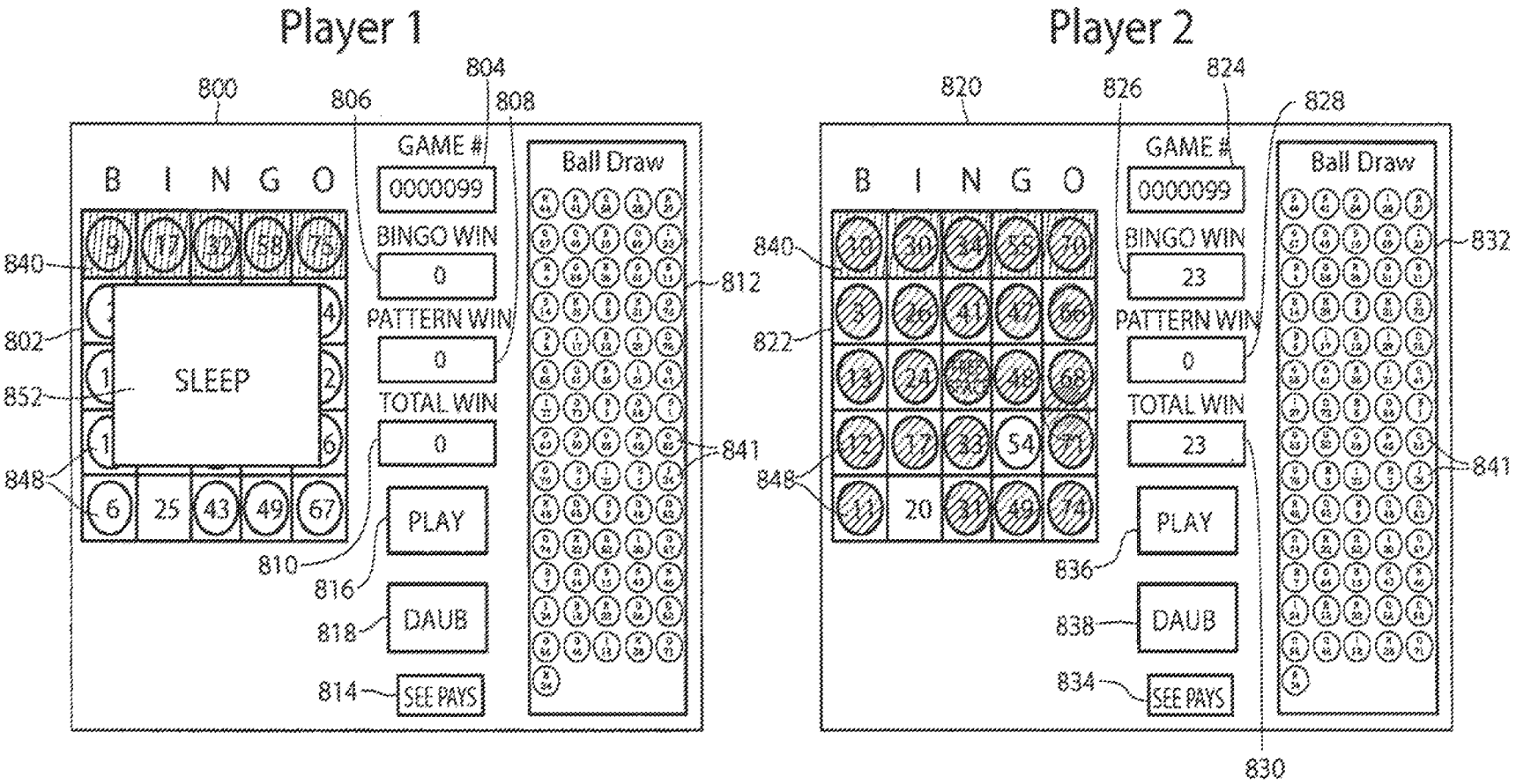

After eliminating the sleeping player or players, control may return to block 716 wherein the network computer 22 may draw additional numbers until at least one Bingo card of the remaining players matches the game-winning pattern. The Bingo game routine 700 continues in the manner previously described, with the game computer 22 transmitting the numbers to game units 200 at block 718, and the game units evaluating the players Bingo cards at block 720. At block 722, the display of the outcome of the Bingo game displayed at the video display 68 at the game units 20 may be updated to reflect the continuation of the ball draw. For example, as shown in FIG. 12, the Bingo display 820 may be updated to display the additional numbers in the ball draw area 832, display additional phantom marks 842 at the numbers on the Bingo card 822 matching the newly drawn Bingo numbers, and display the prompt 844 instructing the player to daub to claim the players Bingo prize. The sleep timer may be reinitiated at block 724, and the gaming units 20 may mark the players Bingo cards as the players touch the "Daub" button 818, 838 at block 726 (see additional daub marks 848 at FIG. 13) until either all the winners daub (block 728) or the sleep timer expires (block 736). If the remaining player or players matching the game winning pattern have daubed their Bingo cards, Bingo win awards are determined at block 730 and the award image 850 may be displayed at the video display 86 of the gaming units 20 corresponding to the winning players at block 732 (see, e.g., award image 815 displayed at Bingo display 820 in FIG. 14) and the Bingo award amounts may be credited to the winning players at block 734 (see, e.g., Bingo win amount 826 and total win amount 830 on Bingo display 820 at FIG. 15).

Returning to block 738, if the network computer 22 determines that the last remaining player has slept through daubing the players Bingo card, several alternatives are possible for terminating the Bingo game. In the illustrated embodiment, control passes to a block 742 wherein the gaming units 20 involved in the occurrence of the Bingo game may sleep infinitely until one of the gaming units 20 detects a player daubing their Bingo card by touching the "Daub" button 838. During this time, casino personnel may be alerted to the suspended Bingo game by displaying messages at the gaming units 20, network computer 22, or any other component of the Bingo gaming system 10 used to monitor the activity occurring in the Bingo gaming system 10, by illuminating the candles 92 mounted on the gaming units 20, or by any other mechanism available within the system for alerting casino personnel to abnormal conditions within the Bingo gaming system 10. Alternatively, the occurrence of the Bingo game may be terminated after a predetermined period of time, with the wagers on the terminated game being retained by the Bingo gaming system 10. During the time that the last remaining player sleeps, players that earlier slept through their Bingo wins may be permitted to daub their Bingo cards and continue playing subsequent Bingo games without waiting for the last remaining player to claim the Bingo win.

Figure 16A:
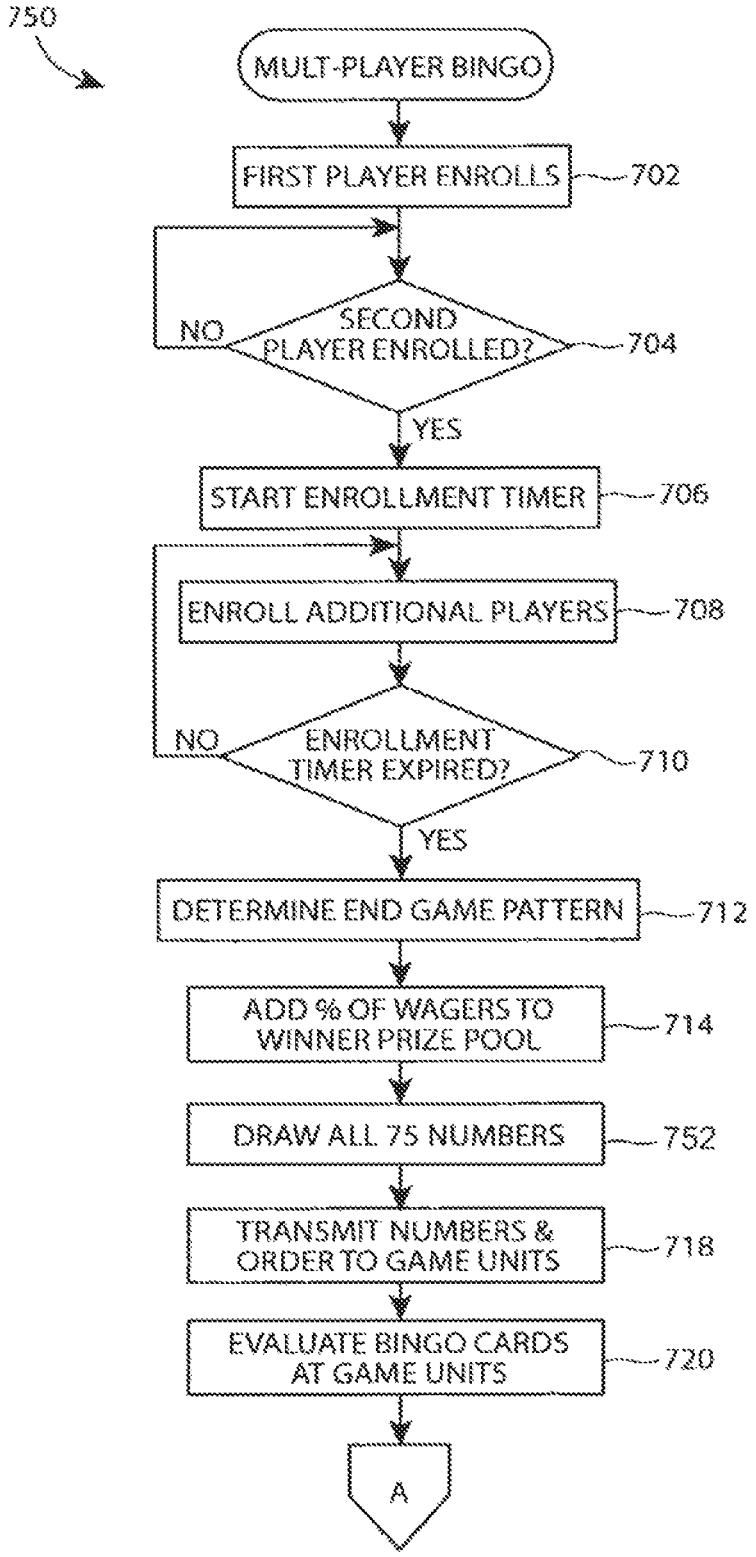
FIGS. 16A and 16B are a flowchart of another embodiment of a multi-player Bingo game routine that may be performed by the gaming network.
Figure 16B:
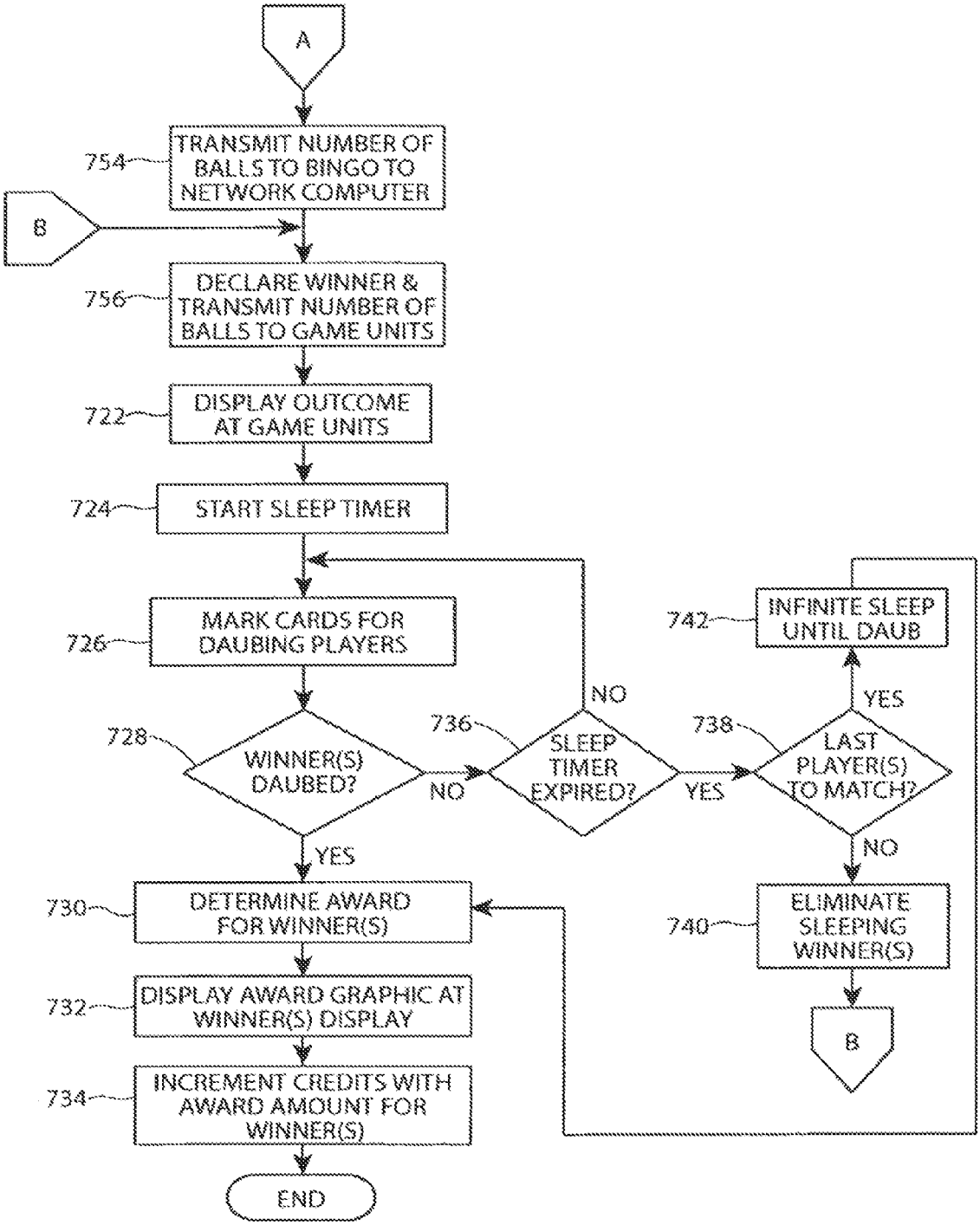

While the routine 700 illustrates the network computer 22 drawing numbers and comparing the drawn numbers to the Bingo cards until a player or players matches the game-winning pattern, other methods are contemplated for conducting the ball draw and comparison to the Bingo cards. FIGS. 16A and 16B illustrate an alternative multi-player Bingo game routine 750 wherein the network computer 22 may draw all seventy-five balls before any balls are compared to the Bingo cards. The routine 750 may have the same general flow as the routine 700 of FIGS. 5A and 5B, with similar process steps in the flowcharts being identified by the same reference numbers. The enrollment of the players in an occurrence of the Bingo game at blocks 702, 706 and 708 may proceed as previously discussed. However, the gaming units 20 may not be required to transmit information relating to the players' Bingo cards to the network computer 22 since the Bingo cards may be compared to the ball draw at the gaming units 20 only. The routine 750 may continue as previously discussed for routine 700 until control passes to a block 752 wherein the network computer 22 may randomly draw all seventy-five numbers to determine the order for the entire ball draw.

After drawing all seventy-five numbers, the network computer 22 may transmit the numbers to the gaming units 20 at block 718, and the gaming units 20 may evaluate the corresponding Bingo cards at block 720 to determine how many numbers from the ball draw are required for the Bingo cards to match the game winning pattern. After the gaming units 20 evaluate the Bingo cards, control may pass to a block 754 wherein the gaming units 20 may transmit the number of balls required for the corresponding Bingo cards to match the game-winning pattern to the network computer 22. Upon receiving the numbers from the gaming units 20, at block 756, the network computer 22 may declare a winner or winners for the Bingo game by comparing the number of balls to Bingo transmitted by the gaming units 20.

After determining the winner or winners, the network computer 22 may transmit the number of balls to Bingo for the winner or winners to the gaming units 20, each of which may determine whether the corresponding player is a winner by comparing the number of balls to Bingo transmitted by the network computer to the number of balls to Bingo for the player. Control may then pass to block 722 and the routine 750 may conclude the occurrence of the Bingo game in a similar manner as previously described for routine 700. In the event a player sleeps through a win, once the sleeping player is eliminated at block 740, control pass may back to block 756 wherein the network computer 22 may declare the player or players requiring the next fewest balls to match the game-winning pattern the new whiner of the Bingo game. By drawing all seventy-five balls at once and transmitting the entire ball draw to the gaming units 20 in a single network communication, the routine 750 may be able to reduce the amount of network traffic in the Bingo gaming system 10.

Figure 17A:
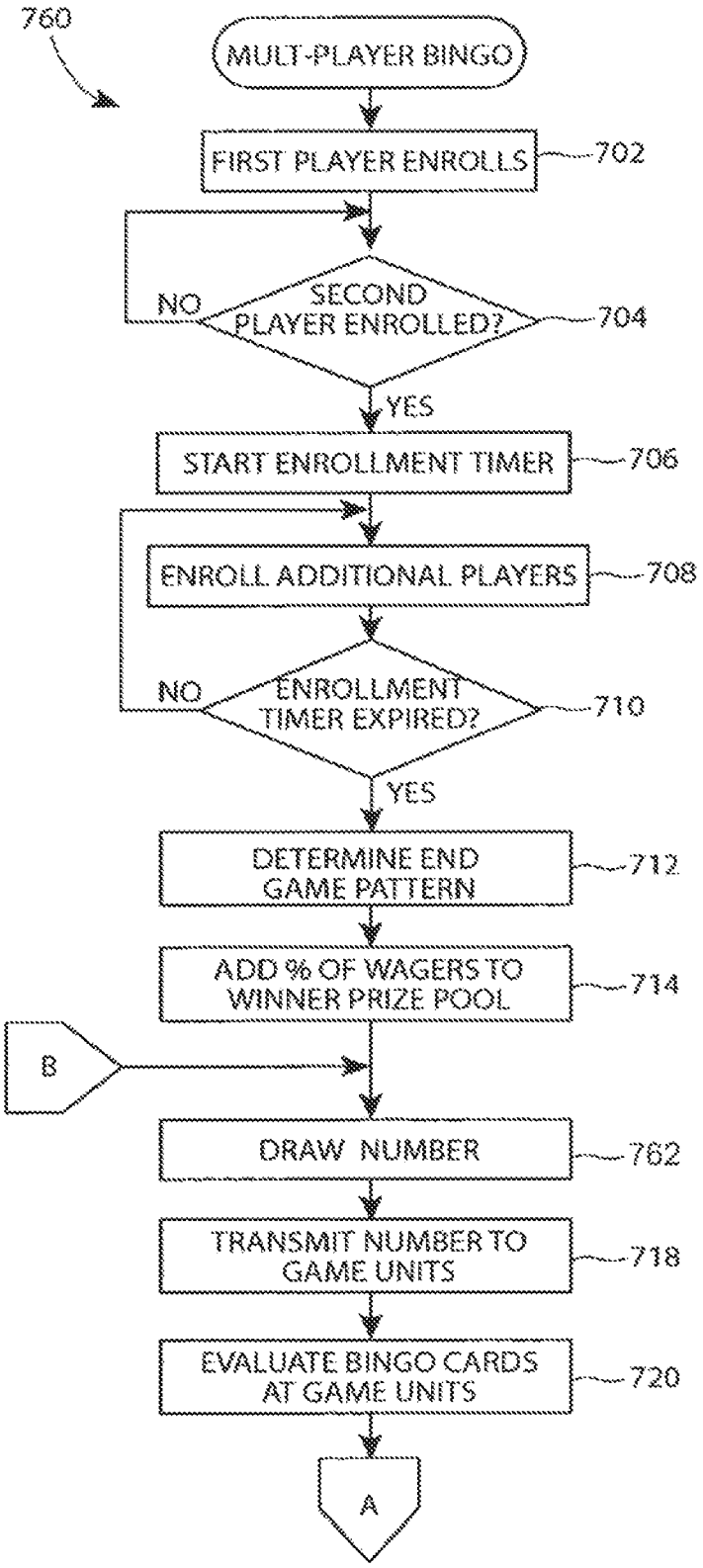
FIGS. 17A and 17B are a flowchart of a further embodiment of a multiplayer Bingo game routine that may be performed by the gaming network.
Figure 17B:
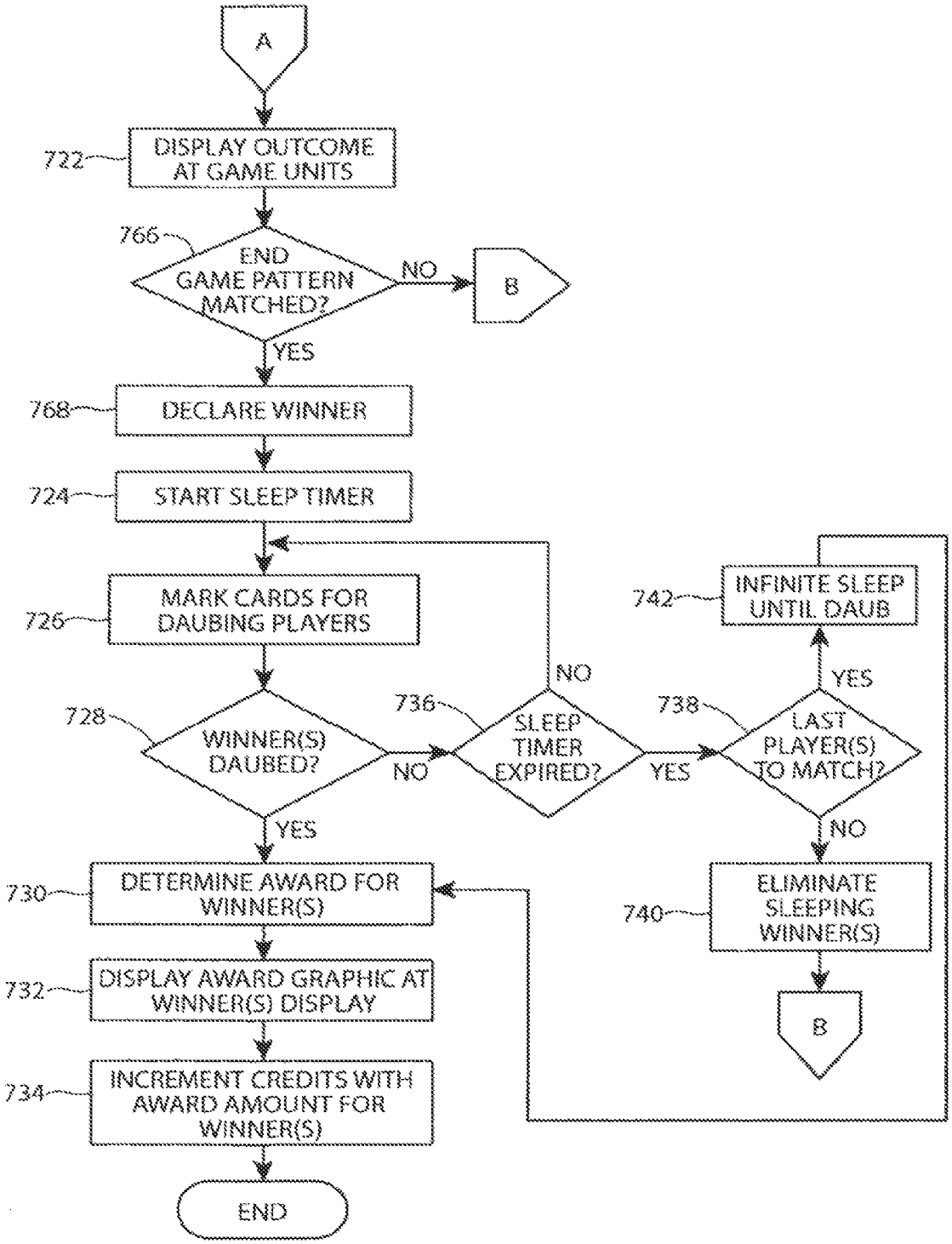

In a further alternative method for conducting the ball draw and comparison of the ball draw to the Bingo cards that may closely mirror the game flow of a traditional Bingo game, the network computer 22 may draw one number at a time and transmit each drawn number to the gaming units 20 for comparison the corresponding Bingo cards. FIGS. 17A and 17B illustrate an alternative multi-player Bingo game routine 760 wherein the network computer 22 may draw a single number and transmit the number to the gaming units 20 for comparison to the Bingo cards. The routine 760 may have the same general flow as the routine 700 of FIGS. 5A and 5B, with similar process steps in the flowcharts being identified by the same reference numbers. The enrollment of the players in an occurrence of the Bingo game at blocks 702, 706 and 708 may proceed as previously discussed. However, the gaming units 20 may not be required to transmit information relating to the players' Bingo cards to the network computer 22 since the Bingo cards may be compared to the ball draw at the gaming units 20 only. The routine 760 may continue as previously discussed for routine 700 until control passes to a block 762 wherein the network computer 22 may randomly draw one number from the range of 1 to 75.

After drawing the number, the network computer 22 may transmit the number to the gaming units 20 at a block 764, and the gaming units 20 may evaluate the corresponding Bingo cards at block 720 to determine whether the number matches a number on the Bingo card. After the gaming units 20 evaluate the Bingo cards, control may pass to block 722 to update the display at the gaming units with the drawn number and phantom marks at matching numbers on the Bingo cards. Control may then pass to a block 766 wherein each gaming unit 20 may determine whether the game-winning pattern is matched by a pattern on the corresponding Bingo card. If at least one Bingo card matches the game-winning pattern, control may pass to a block 768 wherein the gaming units 20 having Bingo cards matching the game winning pattern may transmit a corresponding message to the network computer 22, and the network computer 22 may declare a winner or winners for the Bingo game based on the messages transmitted by the gaming units 20 and transmit a corresponding message to the gaming units 20. Control may then pass to block 724 and the routine 760 may conclude the occurrence of the Bingo game in a similar manner as previously described for routine 700. If none of the Bingo cards matches the game-winning pattern, control may pass back to block 762 wherein the network computer 22 may randomly draw another number, and may continue in this manner until one of the Bingo cards matches the game-winning pattern.

Figure 18A:
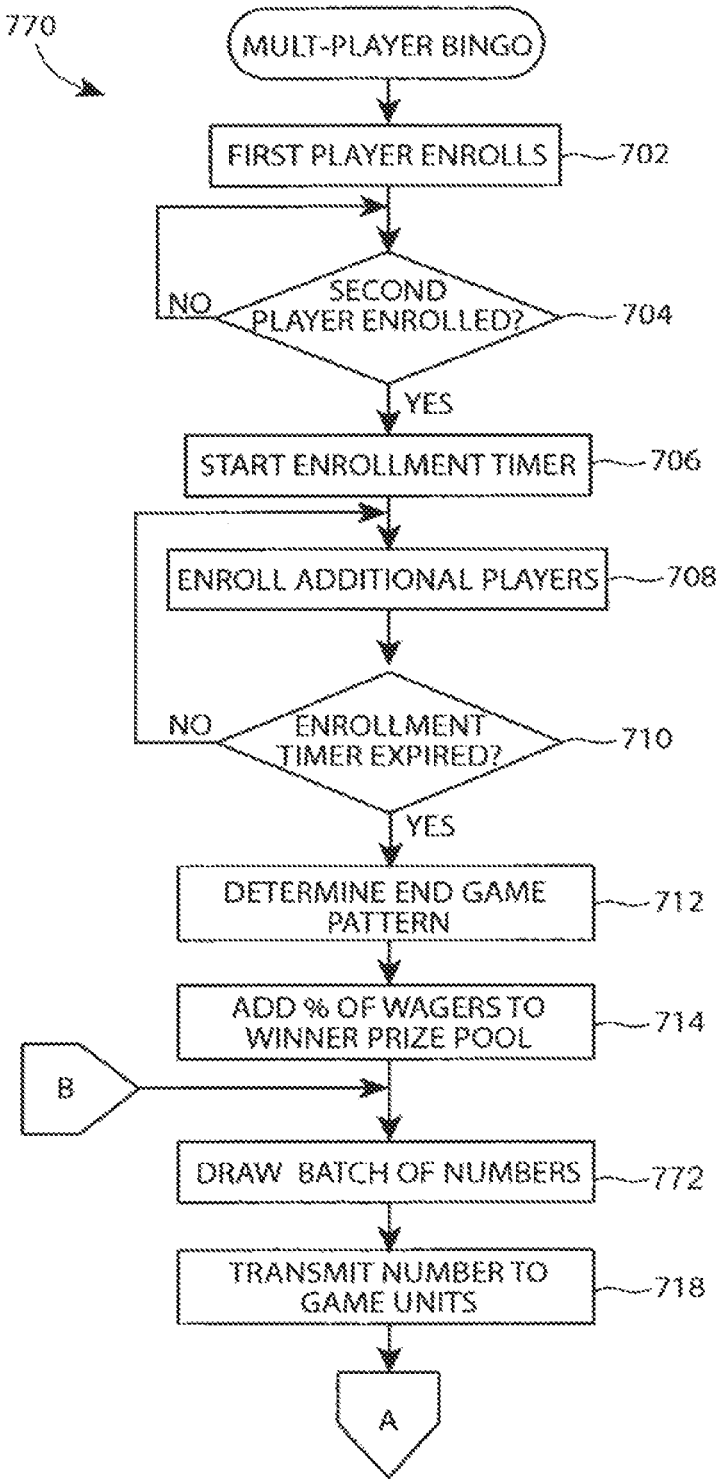
FIGS. 18A and 18B are a flowchart of a still further embodiment of a multiplayer Bingo game routine that may be performed by the gaming network.
Figure 18B:
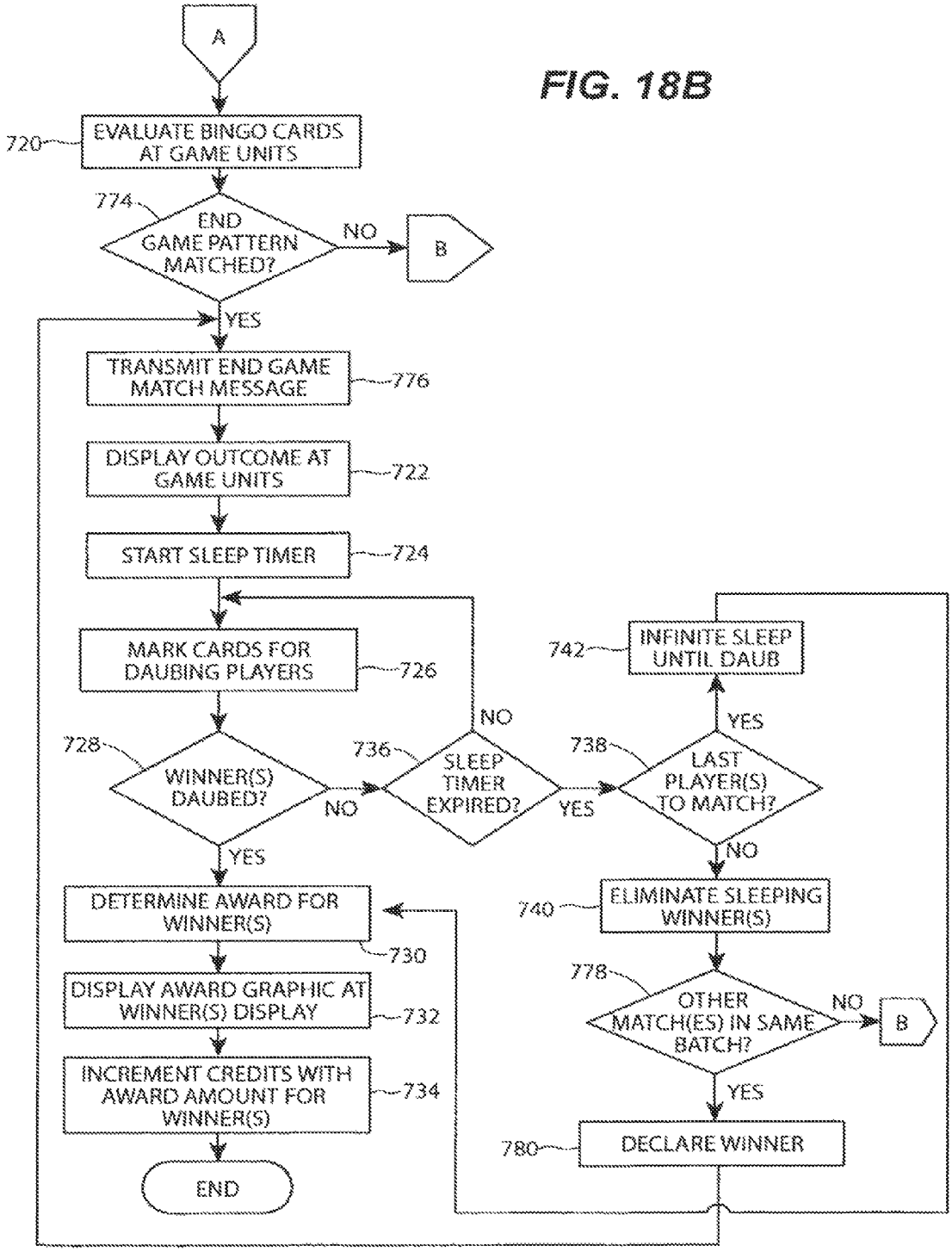

In a still further alternative method for conducting the ball draw and comparison of the ball draw to the Bingo cards, the network computer 22 may draw a batch of numbers, such as five, ten, fifteen or other desired size batch, and transmit the drawn batch of numbers to the gaming units 20 for comparison the corresponding Bingo cards. FIGS. 18A and 18B illustrate an alternative multi-player Bingo game routine 770 wherein the network computer 22 may draw a batch of numbers and transmit the batch of numbers to the gaming units 20 for comparison to the Bingo cards. The routine 770 may have the same general flow as the routine 700 of FIGS. 5A and 5B, with similar process steps in the flowcharts being identified by the same reference numbers. The enrollment of the players in an occurrence of the Bingo game at blocks 702, 706 and 708 may proceed as previously discussed. However, the gaming units 20 may not be required to transmit information relating to the players' Bingo cards to the network computer 22 since the Bingo cards may be compared to the ball draw at the gaming units 20 only. The routine 770 may continue as previously discussed for routine 700 until control passes to a block 772 wherein the network computer 22 may randomly draw a batch of numbers from the range of 1 to 75.

Alter drawing the batch of numbers, the network computer 22 may transmit the batch of numbers to the gaming units 20 at block 718, and the gaming units 20 may evaluate the corresponding Bingo cards at block 720 to determine whether the numbers in the batch of numbers match numbers on the Bingo card. Control may then pass to a block 774 wherein each gaming unit 20 may determine whether the game-winning pattern is matched by a pattern on the corresponding Bingo card, and on which number from the batch of numbers the game-winning pattern was matched. If at least one Bingo card matches the game-winning pattern, control may pass to a block 776 wherein the gaming units 20 having Bingo cards matching the game winning pattern may transmit a corresponding message to the network computer 22, including the number on which the game-winning pattern was matched. The network computer 22 may declare a winner or winners for the Bingo game based on the messages transmitted by the gaming units 20 and the number on which the game winning pattern was matched, and transmit a corresponding message to the gaming units 20. Control may then pass to block 722 wherein the outcome of the Bingo game may be displayed, and the routine 770 may conclude the occurrence of the Bingo game in a similar manner as previously described for routine 700. If none of the Bingo cards matches the game-winning pattern, control may pass back to block 772 wherein the network computer 22 may randomly draw another batch of numbers, and may continue in this manner until one of the Bingo cards matches the game-winning pattern.

When a player sleeps through a Bingo win, it may be possible that another player may match the game-winning pattern on a later-drawn number within the same batch of numbers. It this situation, the other player should be given the opportunity to win the Bingo win award before another batch of numbers is drawn by the network computer 22. After the sleeping winner or winners are eliminated at block 740, control may pass to a block 778 to determine whether other game-winning pattern matches occurred with numbers in the same batch of numbers. If another player will match the game-winning pattern, control may pass to a block 780 wherein the network computer 22 may declare the other player or players the new winner or winners of the Bingo game. After the new winner or winners is declared, control passes back to block 722 to update the displays of the Bingo game outcome at the gaming units 20. If no other players will match the game-winning pattern based on the current batch of numbers at block 778, control may pass back to block 772 where the network computer 22 may select the next batch of numbers.

In routines 760 and 770, the display of the outcome of the Bingo game at block 722 is illustrated as occurring either before (routine 760) or after (routine 770) determining whether the game-winning pattern is matched. In either routine 760 or 770, the display of the outcome may occur in either order based on the desired configuration of the system. If the multi-player Bingo game is configured such that the delay between drawing a number or batch of numbers is discernible by the players, the outcome display may occur before determining whether the game winning pattern is matched so that the players may observe the numbers as they are drawn and the phantom marking of numbers on the Bingo cards as the ball draw proceeds. However, if the system is configured to conduct the ball draw rapidly such that the delay between drawn numbers may not be discernible by the players, it may be desired to update the outcome display after the game-winning pattern is matched by one of the players.

While the general flows for the various multi-player Bingo game routines are discussed herein, the game play for the multi-player Bingo game may be modified as necessary based on system design and/or regulatory requirements, design preferences and the like. For example, where two or more players may remain in an occurrence of the Bingo game, and wherein each of the remaining players may require the same number of balls to match the game-winning pattern, the Bingo win award may be awarded to the remaining players based whether some or all of the players daub their Bingo cards. If all remaining players daub their Bingo cards, the Bingo win award may be split between the remaining players. If less than all of the remaining players daub their Bingo cards before the expiration of the sleep timer, the routine may be configured either to spot the Bingo win award between the remaining players that have daubed their Bingo cards, or to split the Bingo win award between all the remaining players if any of the remaining players daub their Bingo cards before the expiration of the sleep timer. Similarly, if all the remaining players sleep through their Bingos, the Bingo game may sleep infinitely until one of the remaining players daubs their Bingo card. Once one of the remaining players daubs their Bingo card, the routine may be configured either to pay the entire Bingo win award to the remaining player to first daub their Bingo card, or to split the Bingo win award between all the remaining players if any of the remaining players daub their Bingo cards before the expiration of the sleep timer.

The routines may also be modified in implementations where a player may not be required to daub their Bingo cards to receive the Bingo win award. In these implementations, the portions of the routines relating to the sleep timer and daubing, and to eliminating sleeping players and declaring additional winners may be omitted. Even in implementations where players may sleep through a Bingo win, the consequences of sleeping through the Bingo win may be varied as desired. For example, as illustrated, the player who sleeps through a Bingo win may be shut out of collecting the Bingo win even if the player daubs the Bingo card after the sleep timer expires and the player is eliminated. Alternatively, the player initially sleeping through a Bingo win may be provided with the opportunity to claim the Bingo win award if the player daubs the Bingo card before a subsequently declared winning player daubs their Bingo card.

As previously discussed, in some implementations, it may be desired to allow players to purchase and play multiple cards at the gaming unit 20 for a given occurrence of the multi-player Bingo game. The players may be permitted to select from one to a predetermined maximum number of cards for the occurrence of the game, and different players participating III the occurrence of the game may be playing different numbers of cards. In such implementations, it may correspondingly be necessary to increase the minimum number of cards that must be enrolled in an occurrence of the Bingo game in order to ensure that regardless of the number of cards purchased by an individual player, the player has no better than a 50% chance of winning the occurrence of the Bingo game. In one example, the Bingo game may be configured such that each occurrence of the Bingo game includes exactly a predetermined number of cards, and each player may purchase up to one-half the predetermined number of cards. Consequently, if the Bingo game is configured such that each occurrence of the Bingo game involves a total of twelve cards, each player may be permitted to purchase between one and six cards for an occurrence of the Bingo game. Once a total of twelve cards are enrolled by players, the occurrence of the Bingo game may proceed in a similar manner as discussed above for routines 700, 750, 760 or 770.

The number of cards purchased by each player will determine the probability that the player may be the first player to match the game-winning pattern on one of the player's cards. In the above example where each occurrence of the Bingo game involves twelve cards, each card has a 1-in-12 or 8⅓% chance of being the first card to match the game-winning pattern. Each additional card purchased by a player increases the player's chance of matching the game-winning pattern first, up to a 6-in-12 or 50% chance if the player purchases the maximum six cards for the occurrence of the Bingo game. Depending on the implementation of the Bingo game, players may be limited to purchasing fewer than half of the predetermined number of cards for an occurrence of the Bingo game, with the player's chance of having the first card matching the game-winning pattern being reduced correspondingly.

Figure 19:
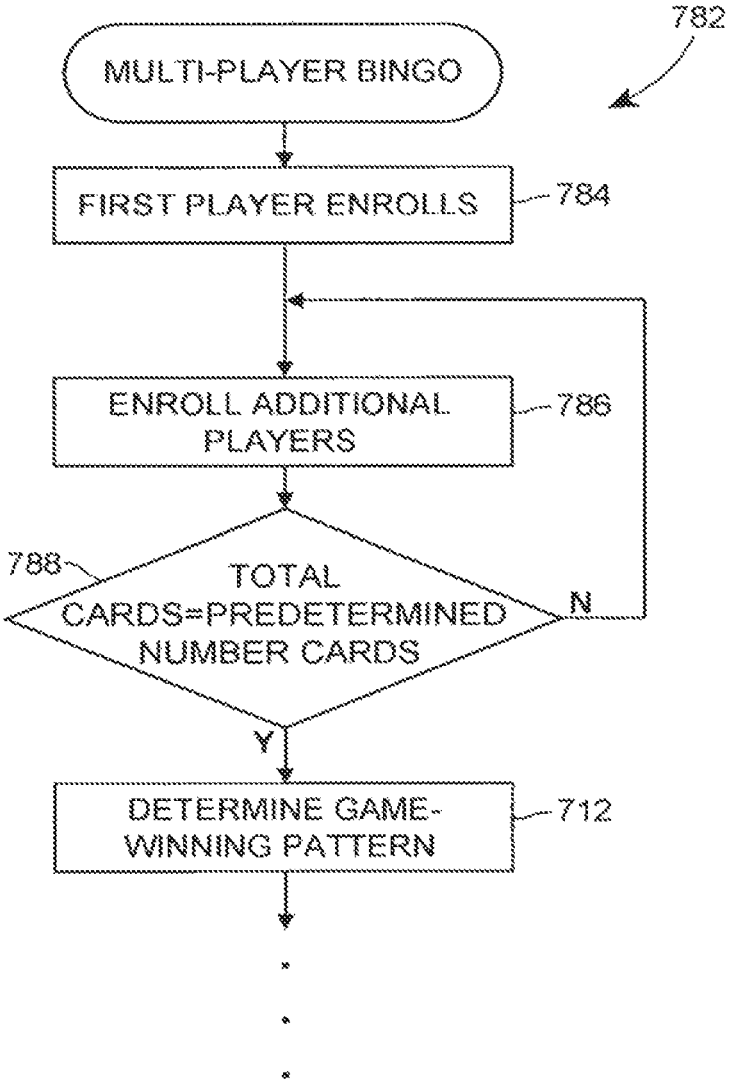
FIG. 19 is a flowchart of an embodiment of an enrollment routine for a multi-player Bingo game routine that may be performed by the gaming network.

As previously mentioned, the routines 700, 750, 760 and 770, and any other routine for conducting an occurrence of the multi-player Bingo game may be conducted in the same manner by enrolling players such that each occurrence includes the predetermined number of cards. FIG. 19 illustrates one embodiment of an enrollment routine 782 that may be implemented in place of portions of the routines 700, 750, 760 and 770 identified by blocks 702, 704, 706, 708 and 710. The enrollment routine 782 may begin at a block 784 at which a first player enrolls in the multi-player Bingo game at one of the gaming units 20. The player's enrollment at block 784 may be similar to the enrollment at block 702, with the addition of the gaming unit 20 offering the player the option of purchasing up to the maximum number of cards allowable for a player for an occurrence of the Bingo game. Once the player selects the number of cards to play and the desired wager amount, and enrolls in the Bingo game by pressing the "Play" button 816, the controller 100 may transmit a message to the network computer 22 indicating that the first player has enrolled in the Bingo game, and further indicating the number of cards selected by the player. Once the player is enrolled, the player's cards 802 may be displayed at the gaming unit 20 in manner such as previously illustrated at FIGS. 6A-6C and described in the accompanying text, or in any other appropriate manner.

Once a first player has enrolled in the occurrence of the Bingo game, the network computer 22 and other gaming units 20 may enroll additional players in the Bingo game at block 786. The enrollment process for the additional players may be similar to the process for the first player, with each additional player selecting up to the maximum number of Bingo cards, selecting a wager amount, and touching the play button of the gaming unit 20 and thereby causing an enrollment message to be transmitted from the gaming unit 20 to the network computer 22. If the gaming units 20 include alternative outcome displays for displaying the outcome of the Bingo game in an alternative format, such as a slots display as discussed below, animated graphics or other display, such as the spinning of video or electro-mechanical reels, may be initiated at the gaming units 20 once the second player enrolls in the Bingo game. At a block 788, the network computer 22 may evaluate the number of cards enrolled in the occurrence of the Bingo game to determine whether the total number of enrolled cards is equal to the required number of cards for playing the Bingo game. If the total number of enrolled cards is less than the required number of cards, the network computer 22 may continue to wait for additional players to enroll in the Bingo game. If the network computer 22 determines that the number of enrolled cards equals the required number of cards, control may pass to the block 712 of the routines 700, 750, 760 or 770, with the network computer 22 proceeding to conduct the occurrence of the Bingo game.

Because each occurrence of the Bingo game has a required number of cards, conditions may arise wherein a newly-enrolling player may elect to play more cards than are needed to complete the enrollment for occurrence of the game. For example, three players may be enrolled for an occurrence of a twelve card Bingo game and select a total of nine cards between them. The next enrolling player may elect to play the maximum allowable six cards, which is three more cards than are necessary to fill out the occurrence of the game. In this case, instead of splitting the fourth player's cards across multiple occurrences of the Bingo game, the network computer 22 may enroll the player in a different occurrence of the Bingo game. If no other occurrence currently exists, the network computer 22 may enroll the player and the player's six cards in a new occurrence of the Bingo game. If other occurrences of the Bingo game are currently being filled, the player and the player's cards may be added to one of the other occurrences, assuming the player's six cards do not exceed the number necessary to complete the enrollment for the other occurrences.

Depending on the speed and preferred order of play for conducting the Bingo game, varying algorithms or criteria may be used to determine which of a plurality of occurrences of the Bingo game in which to enroll the new player. For example, when a new player enrolls, the player may be enrolled in the first available occurrence of the game having a sufficient amount of available cards to accommodate the number of cards the player desires to play. This enrollment strategy may allow the players who have been waiting the longest to begin their occurrence of the game. In an alternate strategy, the player and the player's cards may be enrolled in the first occurrence of the game requiring the exact number of cards enrolled by the player to begin the occurrence of the game, even if occurrences in which the players have been waiting longer are bypassed. Those skilled in the art will understand that any other enrollment strategy achieving desired characteristics for player wait times and order of play where a predetermined number of cards are enrolled in each occurrence of the multi-player Bingo game may be implemented.

In a given occurrence of the multi-player Bingo game having multiple cards enrolled by the players, it is possible to have simultaneous game-winning pattern matches (i.e., matches in the same number of balls) on two or more of the cards enrolled in the occurrence of the Bingo game. In order to maintain a desired payout rate for the multi-player Bingo game, it may be desired to award proportionate shares of the game-winning award to each player having one or more cards matching the game-winning pattern. Consequently, if three cards match a game-winning pattern on the same ball, the game-whining award may be divided by three to determine each player's share. If a given player has multiple cards matching the game-winning pattern, the player may receive a share for each matching card. Thus, if three cards match the game-winning pattern and one player holds two of the matching cards, the player may receive ⅔ of the game-whining award, and the player holding the other matching card may receive 113 of the game-winning award. The division of the game-winning award may result in shares including fractions of cents. In this event, the share amount may be rounded or truncated to yield a whole number of cents, depending on the preference of the sponsor of the mufti-player Bingo game.

Because this embodiment requires a specific number of cards for each occurrence of the Bingo game, it may not be practical to provide an enrollment timer after which the occurrence of the Bingo game may begin as previously discussed for the routines 700, 750, 760 and 770. However, in order to avoid having players cumulatively selecting less than the specified number of cards from waiting indefinitely for an additional player or players to enroll and the occurrence of the game to begin, a timer may be used to set a maximum wait time for the beginning of the occurrence, the expiration of which may result in the refunding of the enrolled players' wagers.

Depending on regulatory requirements in the jurisdiction in which the Bingo game is implemented, it may be possible to complete the enrollment for the occurrence of the game by enrolling a virtual player having the number of cards necessary to complete the required number of cards for the occurrence of the game. The network computer 22 or a designated gaming unit 20 may perform the actions necessary to simulate a player playing the virtual player's cards during the occurrence of the game. The virtual player may win or lose the game, and any winnings may be returned to sponsor of the Bingo game, or added to a prize pool for the players, such as a winner's prize pool from which game-winning awards are paid, or a progressive jackpot pool. To ensure competition among the live players of the Bingo game, it may be necessary to require at least two live players to enroll in the occurrence before the virtual player may be enrolled to complete the required number cards. It should be noted, however, that enrollment of the virtual player should not affect the live players' expected win frequency, which may be determined based on the number of cards enrolled by the live player and the required number of cards for the occurrence of the Bingo game.

Alternatively, instead of refunding the money, the requirement for the number of cards may be relaxed if the exact number of cards is not enrolled within the specified wait time. For example, once the wait time expires, the network computer 22 may provide a range of the number of cards that must be enrolled for the occurrence of the Bingo game. In a game wherein twelve cards are initially required for an occurrence of the game, the network computer 22 adjust the requirement after the wait time expires to begin the occurrence of the game once anywhere from eleven to thirteen cards are enrolled for the occurrence of the game. If the number of enrolled cards is not within the range before the expiration of a second wait time, the network computer 22 may further expand the range to include anywhere from ten to fourteen cards, and so on.

As a further alternative embodiment wherein players may purchase multiple cards for an occurrence of the multi-player Bingo game, each occurrence of the multiplayer Bingo game may require the enrollment of at least a minimum number of cards for each occurrence of the game. Once at least the minimum number of cards is enrolled for the occurrence of the game, the network computer 22 may be configured to close the enrollment and begin the ball draw for the occurrence of the Bingo game. Similar to the previous multi-card embodiment, each player may be limited to the enrolling one-half of the minimum number of cards required for the occurrence of the Bingo game. Consequently, where the Bingo game may be configured to require a minimum enrollment of ten cards, players may be able to enroll up to five cards for an occurrence of the Bingo game.

Figure 20:
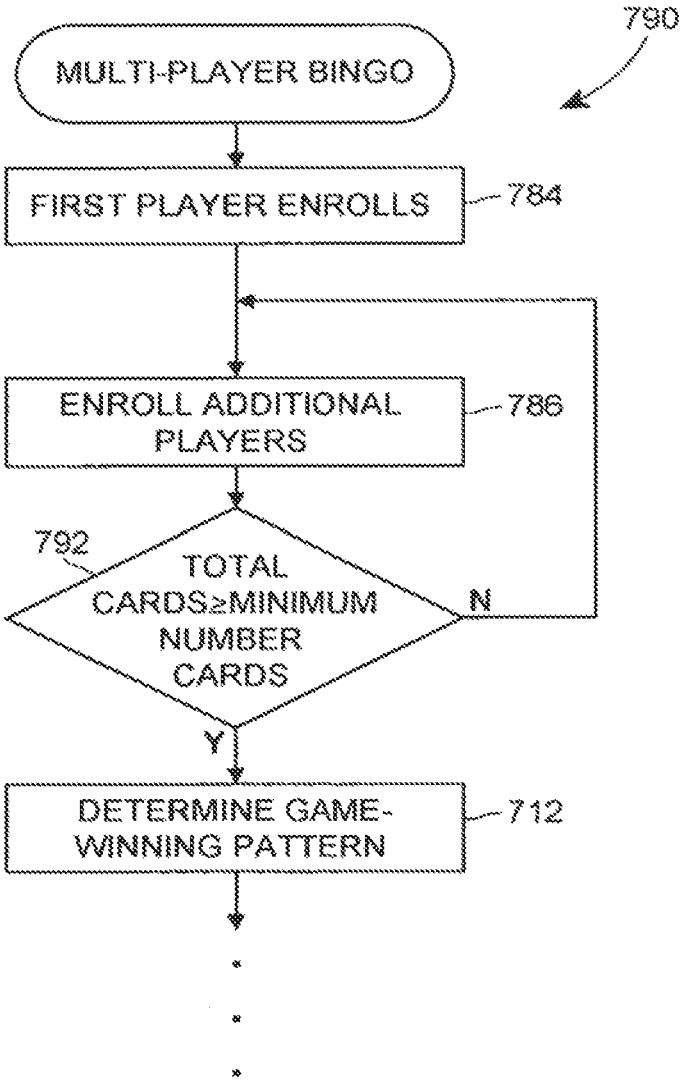
FIG. 20 is a flowchart of an alternative embodiment of an enrollment routine for a multi-player Bingo game routine that may be performed by the gaming network.

FIG. 20 illustrates an enrollment routine 790 for a multi-card Bingo game requiring a minimum number of enrolled cards that may be implemented in place of portions of the routines 700, 750, 760 and 770 identified by blocks 702, 704, 706, 708 and 710. Similar to routine 782, the enrollment routine 790 may begin with the first player enrolling one or more cards in the next occurrence of the Bingo game at block 784, and additional players enrolling in the Bingo game at block 786. As additional players enroll at block 786, control may pass to a block 792 where the network computer 22 may evaluate the number of cards enrolled in the occurrence of the Bingo game to determine whether the total number of enrolled cards is greater than or equal to the minimum number of enrolled cards required for the Bingo game. If the total number of enrolled cards is less than the minimum number of cards, the network computer 22 may continue to wait for additional players to enroll in the Bingo game. If the network computer 22 determines that the number of enrolled cards is greater than or equal to the minimum number of cards, control may pass to the block 712 of the routines 700, 750, 760 or 770, with the network computer 22 proceeding to conduct the occurrence of the Bingo game.

It is contemplated that the network computer 22 may proceed with the Bingo game as soon as at least the minimum number of cards is enrolled. However, it may be desired to allow additional players to enroll additional cards in the occurrence of the Bingo game. In such implementations, the enrollment routine 790 may further include an enrollment timer providing an additional period of time within which additional players may enroll additional cards. By using a minimum number of cards instead of a fixed predetermined number of cards for an occurrence of the Bingo game, the Bingo game may be configured to allow players to play multiple cards while offering flexibility in the enrollment process to quickly complete the enrollment and conduct the occurrence of the Bingo game with unnecessary delays in enrolling an exact number of cards for each occurrence of the Bingo game.

By permitting varying numbers of cards to be enrolled in an occurrence of the Bingo game, the player's expected win frequency may also vary from occurrence to occurrence of the Bingo game depending on the number of enrolled cards. For example, when the players are limited to enrolling six cards in an occurrence of the Bingo game and a minimum of twelve cards must be enrolled for an occurrence of the Bingo game, an occurrence of the Bingo game could start with anywhere from twelve to seventeen cards enrolled for the occurrence of the Bingo game. In this case, seventeen cards may be enrolled if a player enrolls six cards when eleven cards are currently enrolled for the next occurrence of the Bingo game. Further, where the required number of cards may be expanded after the expiration of the wait time for enrollment, the occurrence may start with more or fewer than the required number of cards. Assuming other factors remain the same, the varying number of cards enrolled in an occurrence of the Bingo game may cause a corresponding variation in the expected win frequency for each card enrolled in the game. Consequently, the more cards enrolled in the occurrence of the Bingo game, the lower the expected win frequency for each card and the lower the player's expected rate of return for playing the Bingo game, and the fewer cards enrolled, the higher the expected win frequency and the higher the expected rate of return. In order to compensate for the variations caused by the varying number of cards enrolled in the occurrence of the Bingo game, other aspects of the game may be correspondingly varied in order to produce a desired expected rate of return for the players regardless of the total number of cards enrolled in an occurrence of the Bingo game.

As one example, the game-winning pattern or patterns may be varied based on the number of cards enrolled in the Bingo game. By varying the number of game winning patterns, the number of spots to be matched in the game-winning patterns, and the number of spots shared between the game-winning patterns, a consistent statistical distribution of the number of balls to be drawn when the game-winning pattern(s) is/are matched on one of the enrolled cards may be achieved so that an expected rate of return for the game-winning an interim pattern awards may be achieved regardless of the number of cards enrolled in the Bingo game. For example, when a greater number of cards are enrolled in the occurrence of the Bingo game, the game-winning patterns may include a combination of an increased number of spots per pattern and a reduced number of shared spots between the game-winning patterns such that the probability distribution of a player matching a game-winning pattern on at least one of the enrolled cards may remain essentially the same over the range of numbers that may be used to match interim patterns.

Alternatively, or in addition to varying the game-winning patterns, where the number of balls needed to match the game-winning pattern may determine the game-winning award amount for the occurrence of the Bingo game, the break points at which the award amount changes may be adjusted to provide a consistent expected' rate of return over the range of cards that may be enrolled in the occurrence of the Bingo game. For example, the break points for the award amounts may be increased as the number of cards enrolled in the occurrence of the Bingo game is increased such that, on average, the award amount for matching the game-winning pattern increases and, correspondingly, the players expected return rate may remain approximately constant despite the lower expected win frequency accompanying the increase hi enrolled cards. When twelve cards are enrolled in an occurrence of the Bingo game, a player may receive the maximum game-winning award for matching the game winning pattern within five drawn numbers, while a player may win the maximum game-winning award by matching the game-winning pattern within eight drawn numbers when seventeen cards are enrolled in the occurrence of the Bingo game. Additionally, other variables, such as the game-winning award amounts, secondary patterns used to determine award amounts as described more fully below, and the like, may be adjusted based on number of cards enrolled in the occurrence of the Bingo game in order to achieve a uniform expected rate of return for the players of the Bingo game.

Determining Game-Winning Pattern Bingo Win Amount

As illustrated above, once the winner or winners of the Bingo game is determined and, if necessary the winner or winners daub their Bingo cards, the Bingo win award amount may be determined at block 730. Many different and varying methods for determining the Bingo game award amount may be implemented for the multi-player Bingo game. In part, particular methods may be implemented to support allowing players wagering different amounts on the Bingo game to participate in the same occurrence of the Bingo game and/or to compete for the same progressive jackpots. III perhaps the simplest method, the Bingo win award may be a fixed amount, such as a predetermined number of credits, awarded to each of the winners, or a percentage of winning player's wager on the Bingo game. These methods may minimize the complexity and processing required to determine the Bingo win award.

In order to enhance the players' gaming experience, other methods for determining the Bingo win award may provide for the awarding of Bingo win award amounts that vary from game to game, and perhaps from winner to winner within a given occurrence of the Bingo game. In one embodiment, the Bingo game award may be determined based in part on the number of balls needed by the winning player to match the game-winning pattern. Players matching the game-winning pattern in fewer numbers may receive a larger Bingo game award than players matching the game-winning pattern in more numbers. For example, in one embodiment of Bingo win award determination, a player matching the game-whining pattern within a predetermined maximum number of balls, such as thirty-five balls, may be awarded a progressive jackpot or a portion of an accumulated prize pool. A player matching the game-winning pattern in more than the maximum number of balls may be awarded a smaller Bingo win award, such as a nominal fixed amount or percentage of the player's wager as described above, that may be deducted from the Bingo win prize pool.

The prize pool for the Bingo win award may be funded by players' wagers, with the prize pool being incremented with a predetermined percentage of each player's wager on each occurrence of the Bingo game. As previously mentioned, the winning player may be awarded the entire prize pool as a progressive jackpot, or a percentage of the prize pool. The Bingo win award amount may also be determined in part on the amount of the player's wager so that players making larger wagers on the Bingo game may receive a proportionately larger portion of the prize pool upon winning the Bingo game.

For example, a player matching the game-winning pattern for the Bingo game in fewer than thirty-five balls may be entitled to receive ninety percent of the prize pool. The amount of the prize pool that the winning player actually receives from the prize pool may be adjusted to the size of the winning player's wager compared to the maximum wager that may be made on the Bingo game. For a given occurrence of the Bingo game, the winning player may wager \$5.00 on the Bingo game and the maximum permitted wager may be \$90.00. The Bingo win award for the player may be determined by multiplying the amount in the prize pool by ninety percent, and then multiplying the result by the ratio of the player's wager (\$5.00) to the maximum wager (\$90.00). If the accumulated prize pool for the Bingo game is \$1000 when the player wins the Bingo game, the player's Bingo win award= (\$1000×0.9)×(\$5.00/\$90.00)=\$50.00. When the Bingo win award is dispensed to the winning player, the Bingo win award is deducted from the prize pool. Consequently, the accumulated prize pool may be reduced to \$950 after the winning player receives the \$50.00 Bingo win award. Of course, other methods for awarding all or a portion of the prize pool are contemplated.

Where relatively few Bingo win award amounts may be offered to the players of the multi-player Bingo game, it may be relatively simple to determine awards based on the number of balls required to match a game-winning pattern to achieve a desired probability of paying out each award amount and a desired overall Bingo award payout rate. As the number of award amounts increases, it may become increasingly difficult to map the award amounts to the number of balls required to match the game-winning Bingo patterns on a standard Bingo card.

Figure 21:
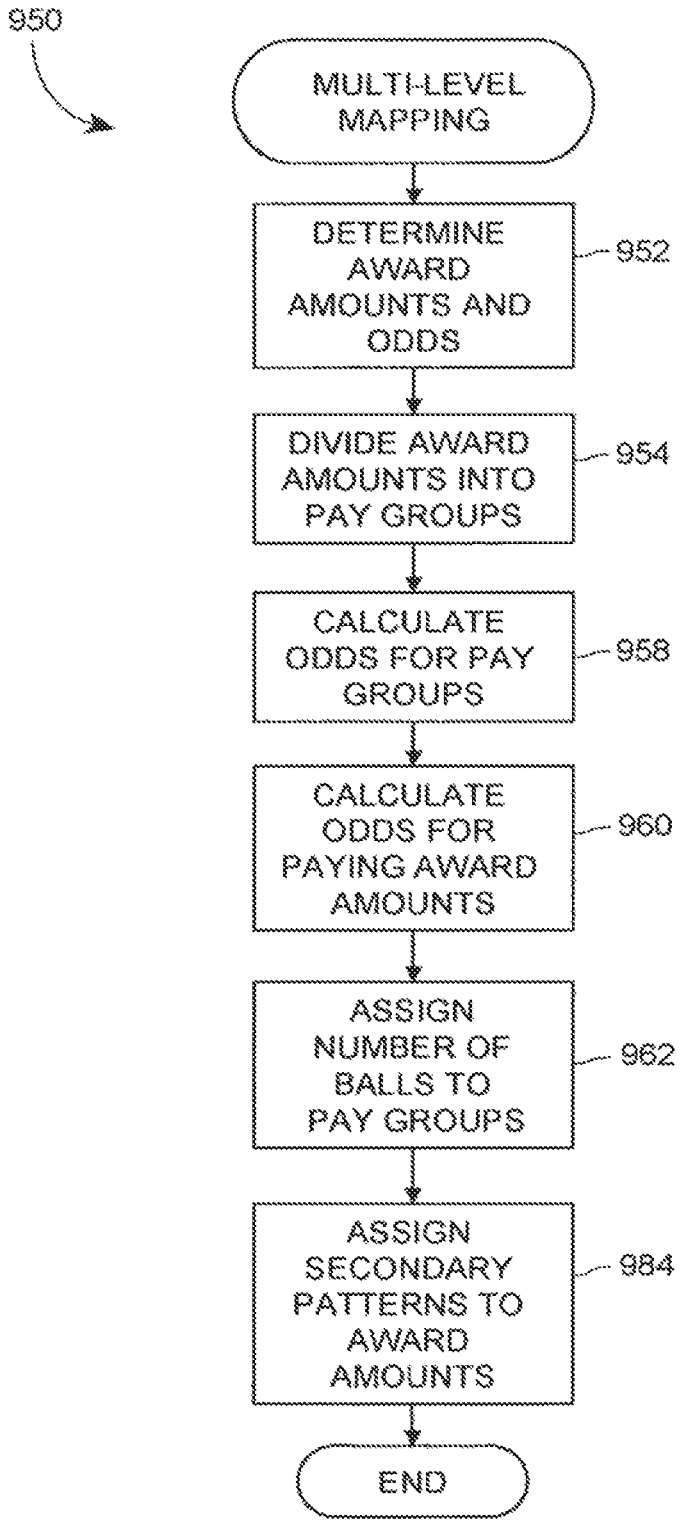
FIG. 21 is a flowchart of a method for performing multi-level pattern mapping.

The difficulty in awarding a large number of award amounts may be reduced by applying a multi-level mapping strategy wherein most or all of the desired award amounts may be provided without the necessity assigning distinct numbers of balls to match a game-winning pattern to each award amount. In one embodiment of a multi-level mapping strategy, the desired award amounts may be divided into a plurality of subsets or pay groups, with each subset or pay group containing one or more of the award amounts, and then assigning a number of balls within which to match the game-winning pattern to each of the pay groups and secondary patterns to each of the award amounts within the pay groups. FIG. 21 is a flowchart of a multilevel Bingo pattern mapping routine 950 that may be implemented to map the desired award amounts. The multi-level mapping routine 950 may begin at a block 952 at which the award amounts for the Bingo game and associated probabilities are determined. The award amounts and associated probabilities may be determined in any known manner for calculating paytables to achieve a desired award payout rate. Moreover, as an alternative to determining the award amounts and probabilities from scratch, the awards and probabilities may be derived from known paytables used in other gaming devices to achieve a desired payout rate.

After the award amounts and associated probabilities are determined, the award amounts may be divided into a plurality of pay groups at block 954. The award amounts may be divided into any desired number of pay groups, each containing any desired number of award amounts. Further, the pay groups may each have the same number of award amounts, or the number of award amounts may vary from pay group to pay group.

One example of a grouping of award amounts is illustrated in FIG. 22. The award amounts consist of the whole numbers between 1 and 100. In the pay group table 956, the award amounts may be separated into ten groups of ten award amounts without overlapping the award amounts between groups. Each award amount may have an associated probability of being awarded. The award amounts may be assigned any desired probability, and the higher value award amounts need not have a lower probability of being awarded than lower value award amounts. In short, the award amounts may be assigned any necessary probabilities in order to achieve the desired award amount payout rate.

Once the award amounts are divided into pay groups, the odds of paying out one of the award amounts from each group may be calculated at block 958. The odds for the group may be calculated based on the cumulative odds for the award amounts within the group. For example, the award amounts in pay group 1 of pay group table 956 may have the assigned odds shown in Table 1:

TABLE 1

| Award Amount | Game Odds |
|---|---|
| 1 | 15-to-1 |
| 2 | 5-to-1 |
| 3 | 150-to-1 |
| 4 | 150-to-1 |
| 5 | 10-to-1 |
| 6 | 700-to-1 |
| 7 | 700-to-1 |
| 8 | 700-to-1 |

TABLE 1-continued

| Award Amount | Game Odds |
|---|---|
| 9 | 750-to-1 |
| 10 | 25-to-1 |

The odds for the pay group are calculated by summing the odds of the individual award amounts in the group. In the above example, the calculated odds for pay group 1 are approximately 2.35-to-1 the one of the award amounts in group 1 may be paid out. Similar calculations may be performed for each of the pay groups.

After calculating the pay group odds, the odds of paying out a particular award amount from its pay group may be calculated at block 960. The odds of paying out an award amount are the odds that once it is determined that an award may be paid out from a given pay group the particular award amount will be the award amount paid out from the pay group. Using the example from Table 1, the approximate odds of paying out the awards from pay group 1 are shown in Table 2:

TABLE 2

| Award Amount | Game Odds |
|---|---|
| 1 | 6.4-to-1 |
| 2 | 2.1-to-1 |
| 3 | 63.8-to-1 |
| 4 | 63.8-to-1 |
| 5 | 4.3-to-1 |
| 6 | 297.9-to-1 |
| 7 | 297.9-to-1 |
| 8 | 297.9-to-1 |
| 9 | 319.2-to-1 |
| 10 | 10.6-to-1 |

Based on these pay group odds for the award amounts in pay group 1, the odds that the 10 credit award will be paid out once it is determined that an award will be paid out of pay group 1 is approximately 10.6-to-1.

After calculating the odds for the pay groups, and for the award amounts within the pay groups, a number of balls within which to match the game-winning patterns may be assigned to the pay groups at block 962. The number of balls assigned to the pay groups may be configured so that the odds of matching the game winning pattern during the Bingo game are approximately equal to the calculated odds of paying an award amount from the corresponding pay group. The number may vary for a given pay group based on the number and characteristics of the game-winning patterns available for use in an occurrence of the Bingo game. For example, the pay group may have a lower number of balls for easier patterns (i.e. fewer spots) than for more complex patterns (i.e. more spots). Also, where multiple game-winning patterns may be used during the occurrence of the Bingo game. The number assigned to a pay group may also relate to a minimum number of balls required to be drawn prior to matching the game-winning pattern such that matching the game-winning pattern in greater than the number of balls corresponds to the pay group. Even if the probability of matching the game-winning pattern in fewer or more than the corresponding number of drawn balls, the number should correspond such that the desired payout rate may be achieved over time.

Returning to FIG. 21, prior to, concurrently with or after assigning the number of balls to the pay groups, secondary patterns may be assigned to the award amounts within the groups at block 984. The secondary patterns may relate to the Bingo cards 802, 822 used by the players during the Bingo game, or may relate to a separate Bingo card that may or may not have the same configuration as the Bingo cards 802, 822. Moreover, the secondary patterns may relate to any other configuration or group of number, symbols or other indicia where patterns may be defined and matched using the numbers selected for the ball draw of the Bingo game. In one embodiment, the secondary patterns may relate to the Bingo cards 802, 822 used by the players, and represent additional patterns that may be matched on the cards 802, 822 to determine an award amount if the corresponding primary Bingo pattern for the pay group is matched on the Bingo card 802, 822. In one approach, the first four columns of the Bingo card may be used for the primary Bingo patterns for the pay groups, and the last column may be used for the secondary patterns for that award amounts within the groups.

Figure 23:
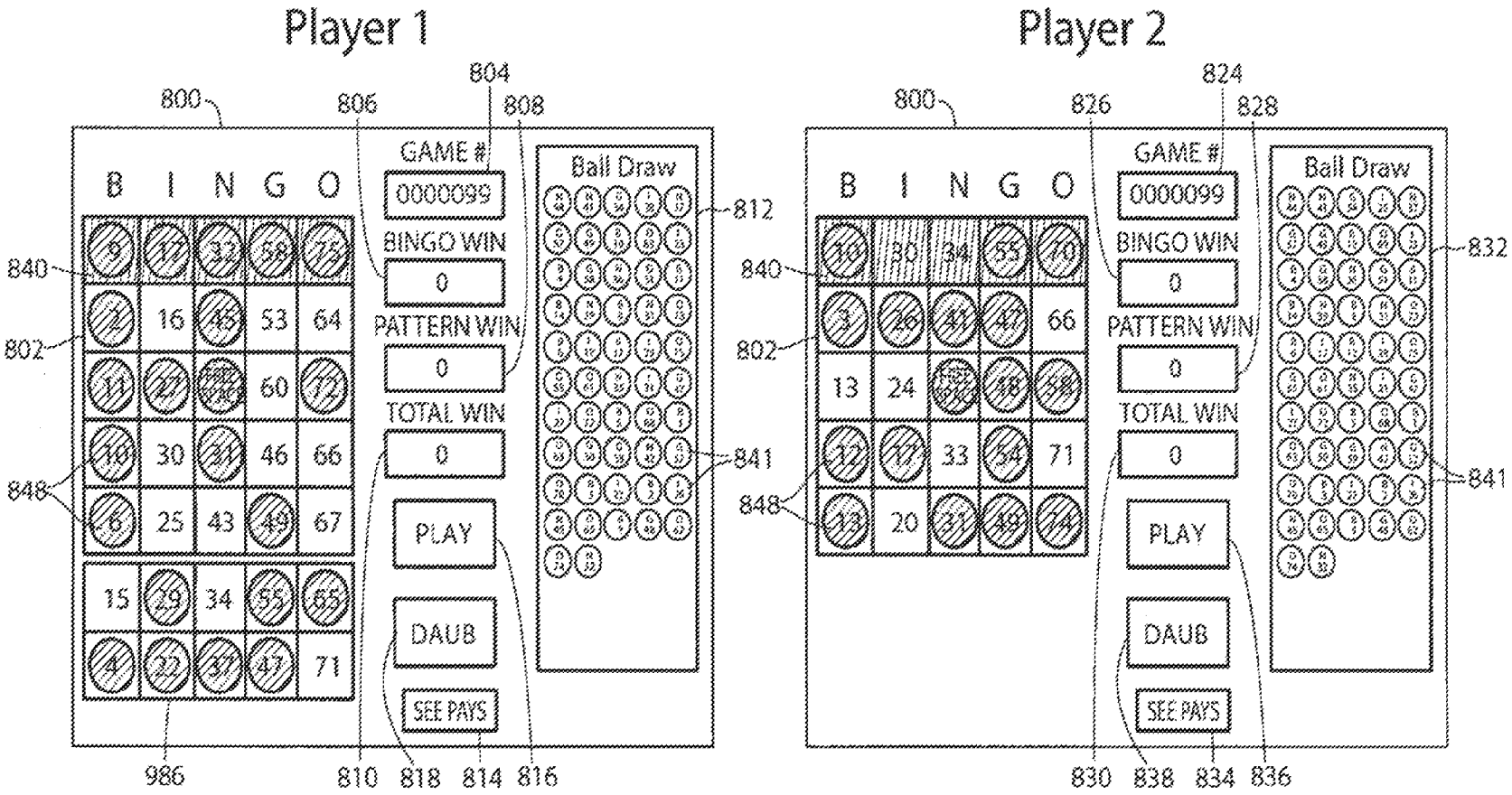
FIG. 23 is an illustration of visual displays that may be displayed during the determination of a game-winning pattern award amount.

In another embodiment, each player may be provided with a secondary card in addition to the Bingo card 802, 822 used to play the Bingo game and to match the game-winning patterns. In one alternative, each player may receive an additional card having two rows and five columns, with each of the columns corresponding to one of the columns of the player's Bingo card 802, 822. FIG. 23 corresponds to the occurrence of the Bingo game previously illustrated in FIGS. 6-15, and showing first Bingo display 800 including a secondary Bingo card 986 received by the first player for evaluating the secondary patterns upon matching the game-winning pattern 840 on the Bingo card 802. As discussed, the secondary Bingo card 986 includes a two row by five column array of numbers. The numbers of the secondary Bingo card 986 may be drawn from the same ranges of numbers as the primary Bingo cards 802, 822 (i.e., B=1 to 15, I=16 to 30, N=31 to 45, G=46 to 60 and O=61 to 75), and may be selected such that the numbers of the secondary Bingo card 986 may not repeat numbers on the primary Bingo card 802. However, numbers may be repeated between the primary Bingo cards 802, 822 and the secondary Bingo cards 986 if desired, and the numbers in the columns of the secondary Bingo cards 986 need not be restricted to being selected from any particular ranges as is the case with the primary Bingo cards 802, 822.

While the Bingo cards are illustrated herein as a 5×5 card 802 and a separate 2×5 card 986, they may be considered as a single 7×5 card with the first five rows being used to play the Bingo game and the last two rows being evaluated in the event that certain predefined patterns are matched in the first five rows. Moreover, the primary Bingo cards 802, 822 and secondary Bingo cards 986 need not be two-dimensional matrices of game indicia, and may be any size or form of array of game indicia in which the matched game indicia of the array may form patterns that may be compared to predetermined patterns, and may be separate arrays or portions of the same array. Where players may have multiple cards 802, 822 for an occurrence of the Bingo game, the Bingo game may be implemented such that the player may receive a secondary card 986 for each Bingo card 802, or such that the player may receive a single secondary card 986 for the occurrence of the Bingo game for use in conjunction with whichever card or cards 802 are the first to match the game-winning pattern.

Figure 24:
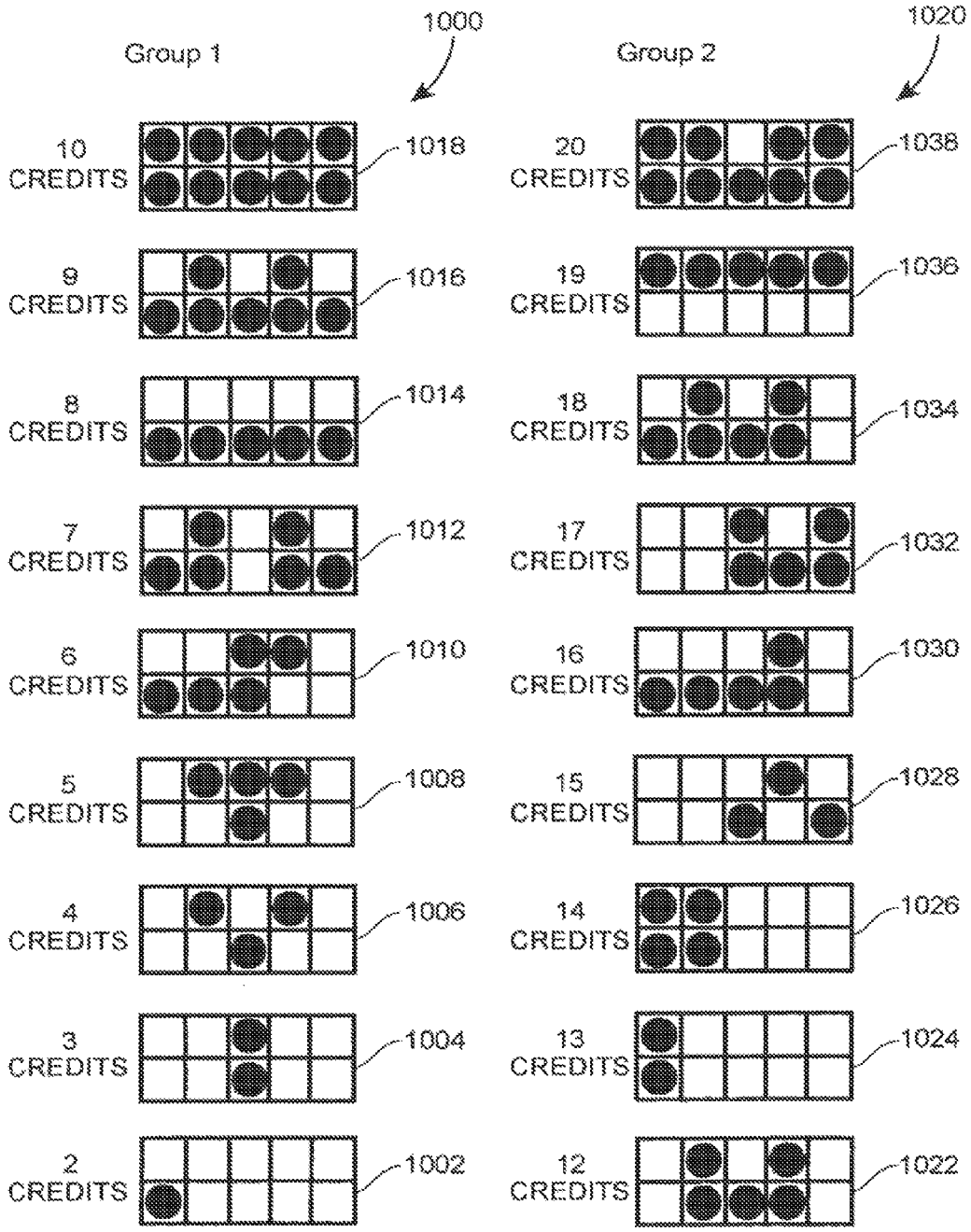
FIG. 24 is an illustration of sets of secondary patterns for a multi-player Bingo game with multi-level pattern mapping of award amounts.

In the embodiment wherein the secondary Bingo card 986 is used to evaluate the secondary patterns, it follows that the secondary patterns may be similarly defined within two rows and five columns. FIG. 24 illustrates a secondary pattern set 1000 containing secondary patterns 1002-1018 corresponding to the 2 credit through 10 credit award amounts of pay group 1 of FIG. 22, and a secondary pattern set 1020 containing secondary patterns 1022-1038 corresponding to the 12 credit through 20 credit award amounts of pay group 1 of FIG.

22. In this example, one of the awards in pay group 2 may be awarded if a player matches the game winning pattern in fifty-five drawn numbers or less, but more than the number for pay group 3, while an award from pay group 1 may be awarded if the game-winning pattern is matched in more than fifty-five drawn numbers. Similar secondary patterns sets may be assigned for remaining pay groups 3-10. The various secondary pattern sets mayor may not use the same secondary patterns. Even where the same secondary patterns are used for all pay groups, the odds within the groups may still be varied based on the particular patterns and the number of patterns assigned to each award amount within a given group. In this embodiment, when the game-winning pattern 840 is matched on the primary Bingo cards 802, 822 within the range of drawn numbers corresponding to the particular pay group, the player may be paid the lowest award amount in the pay group in the event that none of the secondary patterns for the pay group are matched on the secondary Bingo card 802, 822. Consequently, it may not be necessary to assign a secondary pattern to the lowest value award amounts. However, a secondary pattern may be assigned to the lowest value award amounts, and the player may not receive an award if no secondary pattern is matched after matching the primary Bingo pattern.

Referring back to FIG. 23, the secondary Bingo card 986 may be evaluated and marked by the network computer 22 and/or the gaming units 20 in a similar manner as discussed for the primary Bingo cards 802, 822. The player's Bingo card must be the first to match the game-winning pattern 840 in order for the player to receive an award, and the gaming units 20 may be configured to display the secondary Bingo card 986 only after a game-winning pattern is matched on the primary Bingo cards 802, 822. Alternatively, the secondary Bingo card 986 may be displayed at all times. As discussed above, a player may be required to daub their Bingo cards in order to claim any game-ending wins.

Depending on the configuration for determining the game-winning awards, the secondary Bingo card 986 may be marked based on the same ball draw or portion thereof as is used for the primary Bingo cards 802, 822. For the first player, the game-winning pattern 840 was matched when the fifty-second number drawn ("32") and marked on the players Bingo card 802, which is within the number range corresponding to pay group 2. As discussed previously, players may be awarded either the sum of the game-winning awards when multiple secondary patterns are matched, or only the highest award amount, depending on the configuration of the Bingo game. Where only the highest award amount may be awarded, the first player may receive the highest award amount in pay group 2. On the secondary Bingo card 986, the marked numbers match secondary patterns 1022 ("22," "29," "37," "47" and "55"), 1030 ("4," "22," "37," "47" and "55") and 1034 ("4," "22," "29," "37," "47" and "55") of secondary pattern set 1020. Consequently, the first player may receive eighteen credits as game-winning award as the highest award amount for the secondary patterns matched in pay group 2. Alternatively, the first player may receive forty-six credits if the award amounts are summed.

Multi-level pattern mapping is not limited to two levels as illustrated herein. Any number of levels may be used depending on the number of potential award amounts available in a paytable to which the patterns are to be mapped. Therefore, groups may further include subgroups, each of which may include further subgroups or multiple award amounts. For example, in addition to a 5×5 primary Bingo card and a 2×5 secondary Bingo card, the Bingo game may further include a 2×2 or 3×3 interim pattern, with patterns on the 5×5 Bingo game corresponding to groups of award amounts, patterns on the 2×5 card corresponding to subgroups of award amounts under the groups, and the 2×2 or 3×3 cards corresponding to particular award amounts within the subgroups. Those skilled in the art will understand that any card configuration and number of levels may be used to implement interim pattern wins in a Bingo game.

Alternative Displays of Bingo Game Outcomes

As previously discussed, players may find the display of other games, such as slot machines, video poker, video blackjack, video Keno and the like, to be more appealing than the display of Bingo games. Moreover, as the number of award amounts and, correspondingly the number of Bingo patterns, offered in a Bingo game increases, it may become more difficult for players to discern winning outcomes (i.e. pattern matches) in a Bingo game than, for example, a slot machine offering a comparable number of award amounts based on matching reel symbols along a plurality of paylines. The Bingo player's gaming experience may be enhanced by providing an alternative display of the outcome of the Bingo game determined based on a ball draw and the player's Bingo card in a format that may be preferential to the player or allow the player to more readily identify winning outcomes of the Bingo game. In one alternative, the outcome determined by the Bingo game may be presented to the players with the display simulating the appearance of a traditional Class III game, such as electro-mechanical or video slots, video poker, video blackjack, video Keno and the like.

It may be emphasized that the slot reels or other alternative outcome displays used to display the outcome determined by the Bingo game may not themselves determine the outcome of the Bingo game. The Bingo gaming system is conducting a Bingo game that may still be played without providing the supplemental outcome display offered by such alternative outcome displays. The ball draw leads to covered numbers, characters or other game indicia on the Bingo card. Achieving coverage of the predetermined game-winning pattern leads to a Bingo win award. The game-winning patterns, the maximum number of cards per player and per occurrence, the break points of the number of balls for triggering game-winning awards or award groups, or other awards (e.g., interim awards, bonus features, progressives) may be chosen to achieve desired Bingo game dynamics. However, the targeted dynamics (i.e. the Bingo win award values, the relative frequency of occurrence of the awards, the Bingo win and interim pattern payout rates, and the like) may be selected so as to closely mirror the dynamics that a desired alternative outcome display, such as a particular slot machine or other casino game, might produce. The correspondence between the Bingo game dynamics and the casino game dynamics may allow the designer to map the Bingo game awards to the display of the casino game via the alternative outcome display, thereby providing an alternative and potentially more user-appealing display of the Bingo outcome.

In one embodiment, an existing casino game may be used for the alternative outcome display, with the award amounts and the paytable for the casino game being used to configure the Bingo game dynamics. For example, the multi-player Bingo game may include an alternative outcome display simulating the appearance of a traditional slot machine, with the number of balls to match a game-winning pattern and secondary patterns being mapped to the award amounts of the slot machine paytable to achieve approximately the same payout rate for the Bingo game awards as for the slot machine. Where relatively few award amounts are offered in the paytable for the slot machine, a set of break points for the number of balls to match the game winning patterns may be mapped to the award amounts, with the game winning award amounts having approximately the same odds of being matched on a player's Bingo card as the odds of the slot machine paying out the corresponding award amount.

Figure 25:
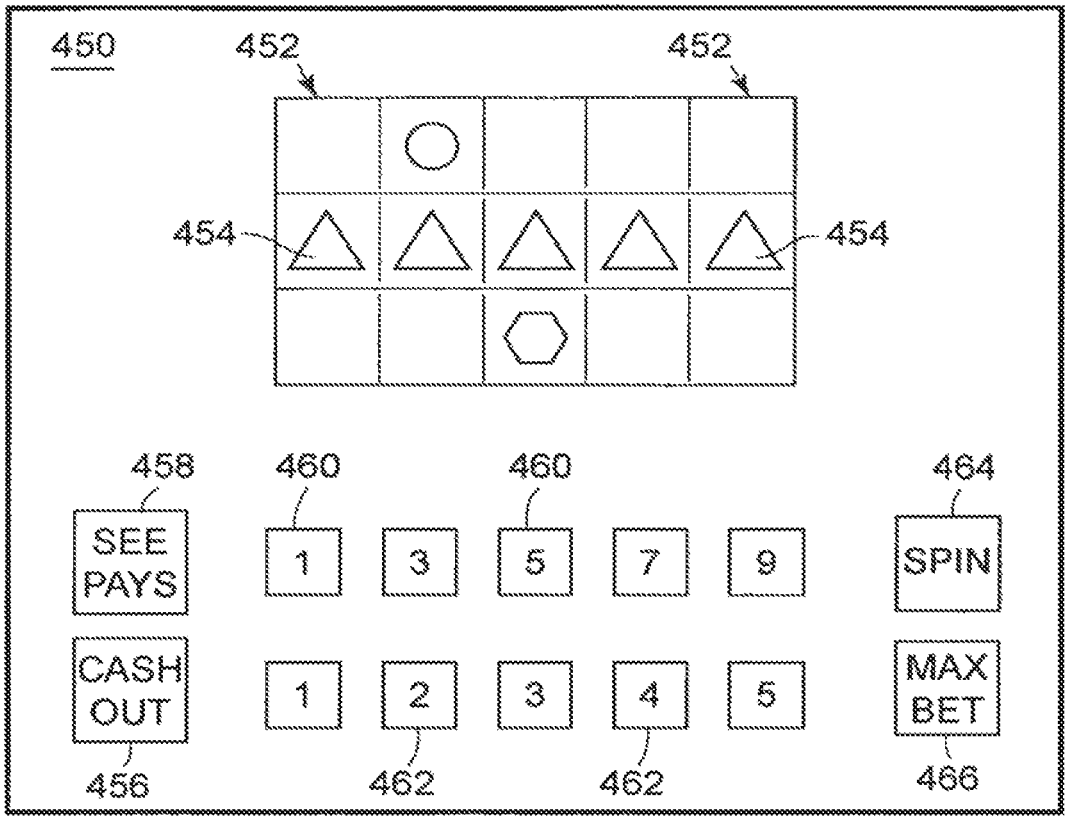
FIG. 25 is an illustration of an embodiment of a video slots display that may be displayed as an alternative outcome display.

The alternative outcome display may be provided at the gaming units 20 in addition to the display of the Bingo game discussed above. For the above example, the outcome of the Bingo game may be displayed at the first display device 68 of the gaming unit 20, and the alternative outcome display may be provided at the second display device 70, perhaps as an electro-mechanical or video display of a set of slot reels. FIG. 25 is an exemplary display 450 that may be shown on the display unit 70 as an alternative outcome display. Referring to FIG. 25, the display 450 may include video images 452 of a plurality of slot machine reels, each of the reels having a plurality of reel symbols 454 associated therewith. Although the display 450 shows five reel images 452, each of which may have three reel symbols 454 that are visible at a time, other reel configurations could be utilized. Such an alternate display may be to display the outcome whether the player plays a single card for the occurrence of the Bingo game, or plays multiple cards for the occurrence. Even where multiple cards are played, a composite or combined outcome for the player for the occurrence of the game may be displayed at a single alternate outcome display, such as display 450.

To allow the player to control the play of the Bingo game, a plurality of player-selectable buttons may be displayed that may map wagering selections for a slot machine to wagers by the players on the Bingo game. The buttons may include a "Cash Out" button 456, a "See Pays" button 458, a plurality of payline-selection buttons 460 each of which allows the player to select, a different number of pay lines prior to "spinning" the reels, a plurality of bet-selection buttons 462 each of which allows a player to specify a wager amount for each payline selected, a "Spin" button 464, and a "Max Bet" button 466 to allow a player to make the maximum wager allowable.

Figure 26:
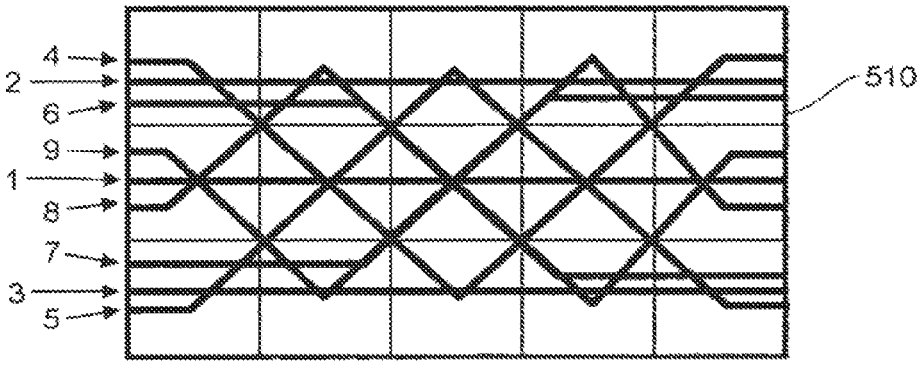
FIGS. 26 and 27 illustrate an embodiment of the multi-line paytable corresponding to the video slots display of FIG. 25, along with illustrations of the individual paylines.
Figure 27:
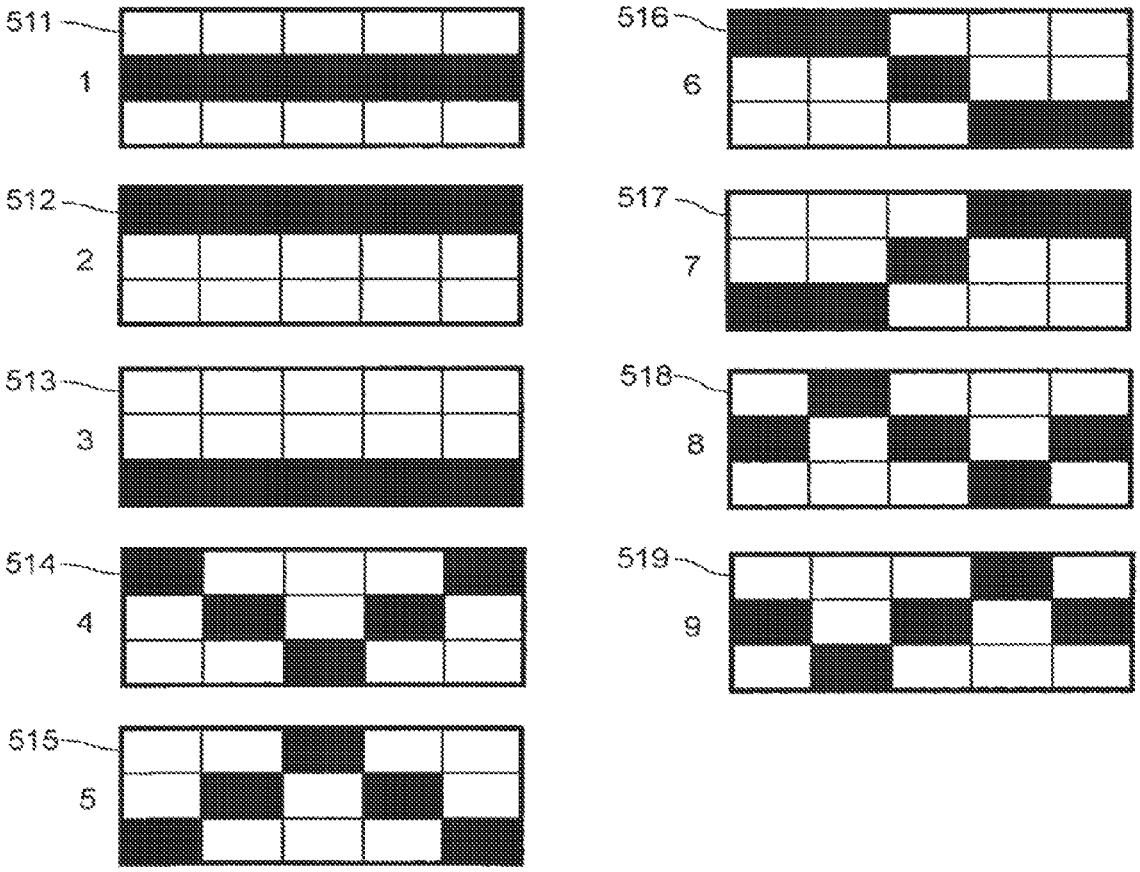

If the player requests payout information, such as by activating the "See Pays" button 458, the gaming unit 20 may cause one or more paytables to be displayed on the display unit 70. One example of a paytable 510 for a slot machine with multiple paylines is illustrated in FIG. 26. The paytable 510 may correspond to a five reel slot machine having three stop positions per reel such that 15 symbols are displayed as shown in FIG. 25. The paytable 510 includes nine paylines that may be played by the player based on selections made using buttons 460. FIG. 27 illustrates each of the individual paylines 511-519 making up the paytable 510 for the purpose of clarity. When the reels are spun and stop, each of the paylines 511-519 on which the player wagers is evaluated to determine whether the symbols on the reels match any of the predefined combination of reel symbols for which a prize is awarded. More than one payline may include a winning combination of reel symbols, and the award amounts for multiple paylines may be added to determine a total award amount for the reel spin.

Each award amount in the slot machine paytable may correspond to one or more combinations of reel stop positions that when hit by the slot machine result in the payout of the, associated award amount. The mapping of the Bingo game wins to the slot machine paytable may further include mapping the break points and secondary patterns to the combination or combinations of reel stop positions corresponding to the award amount. For each Bingo game win and corresponding award amount, the gaming unit 20 may store the available combination or combinations of reel stop positions to be displayed at the alternative outcome display to represent the outcome of the Bingo game. When a given game-winning pattern is matched on the Bingo card, the gaming unit 20 may randomly or sequentially select one of the available combinations of reel stop positions corresponding to the award amount, and cause the alternative outcome display to display the slot reels in the appropriate positions to display a slot machine outcome that if determined by a slot machine engine would result in the payout of the award amount.

During the execution of the multi-player Bingo game routines 700, 750, 760, 770, of FIGS. 5A and 5B, 16A and 16B, 17A and 17B, and 18A and 18B, respectively, or other routines for conducting the Bingo game, the gaming unit 20 may control the alternative outcome display to achieve a realistic simulation of the casino game used to display the outcome of the Bingo game. At blocks 704 and 706, once two or more players enroll in the occurrence of the Bingo game, thereby ensuring that the Bingo game may be played, the gaming unit 20 may cause the display device 70 to display an animated graphic or other display simulating the initiation of the casino game. For example, if a slot machine is being simulated, the gaming unit 20 may cause the display device 70 to start the electro-mechanical or video reels spinning as if a player had hit a "Spin" button or pulled the arm of a slot machine. For video card games, the display device 70 may display a graphic of a deck of cards being shuffled or of hands being dealt face down by a dealer. Still further, for video Keno games, the display device 70 may display a graphic of a blower-type ball draw mechanism tumbling the Keno balls.

The animated display may continue until the Bingo game winner or winners are determined and the Bingo cards are evaluated for game-winning and/or secondary patterns and corresponding award amounts. After the awards are determined at block 730, in addition to displaying the Bingo game outcome and award graphics at the display device 68 at block 732, the gaming device 20 may also determine and display at the display device 70 an alternative outcome display corresponding to the Bingo game outcome. Using the outcome of the Bingo game and corresponding award amount, the gaming unit 20 may select one of the available alternative outcome displays for the outcome and award amount, and cause the display device 70 to display the selected outcome display. For a slot machine, the gaming unit 20 may cause the display device 70 to stop the reels at the corresponding combination of reel stop positions. Similarly, for a video card game, the display device 70 may display player and/or dealer hands that would result in the payout of the award amount by the corresponding video card game.

While a single level of Bingo patterns or ball selection break points may be appropriate to map a paytable for a casino game having a relative small number of award amounts, the multi-level pattern mapping strategy discussed above may be necessary to configure the Bingo game dynamics to correspond to a casino game desired to be used as an alternative outcome display having a large number of available award amounts. In one example of a slot machine having five reels with three symbols per reel being displayed, and players being able to wager on up to nine paylines, the paytable may contain hundreds of available award amounts. In this example, thirty four distinct award amounts may be available when only one payline is played, while 351 distinct award amounts may be available when all nine paylines are played with the award amounts ranging from two to 4,727 credits.

In one embodiment, Bingo patterns for the Bingo game may be mapped to the paytable for the slot machine using three levels of mapping. At the first level, the paytable may be divided into groups of award amounts corresponding to the number of paylines being played by a player. In the above example, the one line group may include thirty-four distinct award amounts, the nine line group may include 351 distinct award amounts, and the groups corresponding to playing two through eight ones may each include the corresponding distinct award amounts available in the paytable. In one embodiment described more fully below, the number of paylines selected and the amount wagered per payline may dictate the number of cards played by the player and the wager per card for the occurrence of the Bingo game. Once the award amounts are divided into groups based on the number of lines played, game winning and secondary patterns, and break points for the number of balls to match the game-winning pattern(s) may be assigned for the award amounts in each group according to the multi-level pattern strategy discussed above.

Using the nine payline group as a further example, the available award amounts may be divided into non-overlapping pay groups as shown in pay group table 1050 of FIG. 28. With extremely large numbers of award amounts, it may be desirable to select a subset of the most prevalent award amounts, or select a subset based on other criteria. In this example, the 149 most prevalent award amounts may have been selected and divided into the sixteen non-overlapping groups of pay group table 1050. Once the groups are determined, the pay group odds and the odds for the award amounts within the pay groups may be calculated in the manner described above.

After the odds are calculated for the pay groups and the awards, game winning patterns and the number of balls to Bingo break points may be assigned to the pay groups, and secondary patterns may be assigned to the award amounts within the pay groups corresponding to the calculated odds in the manner described above. Where only the highest award amount may be paid for multiple pattern matches, the odds of paying out an award from each of the pay groups are shown in Table 3:

TABLE 3

| Primary Pattern | Odds of Payout |
|---|---|
| 1 | 11,740-to-1 |
| 2 | 13,602-to-1 |
| 3 | 4,766-to-1 |
| 4 | 909-to-1 |
| 5 | 2,142-to-1 |
| 6 | 1,979-to-1 |
| 7 | 1,798-to-1 |
| 8 | 139-to-1 |
| 9 | 282-to-1 |
| 10 | 172-to-1 |
| 11 | 71-to-1 |
| 12 | 24-to-1 |
| 13 | 67-to-1 |
| 14 | 33-to-1 |
| 15 | 11-to-1 |
| 16 | 2.9-to-1 |

The game-winning patterns and corresponding number of balls to Bingo break points may be configured so that the odds of matching the patterns within a certain number of drawn balls may be approximately equal to the calculated odds of paying out an award amount from the corresponding pay groups.

Figure 29:
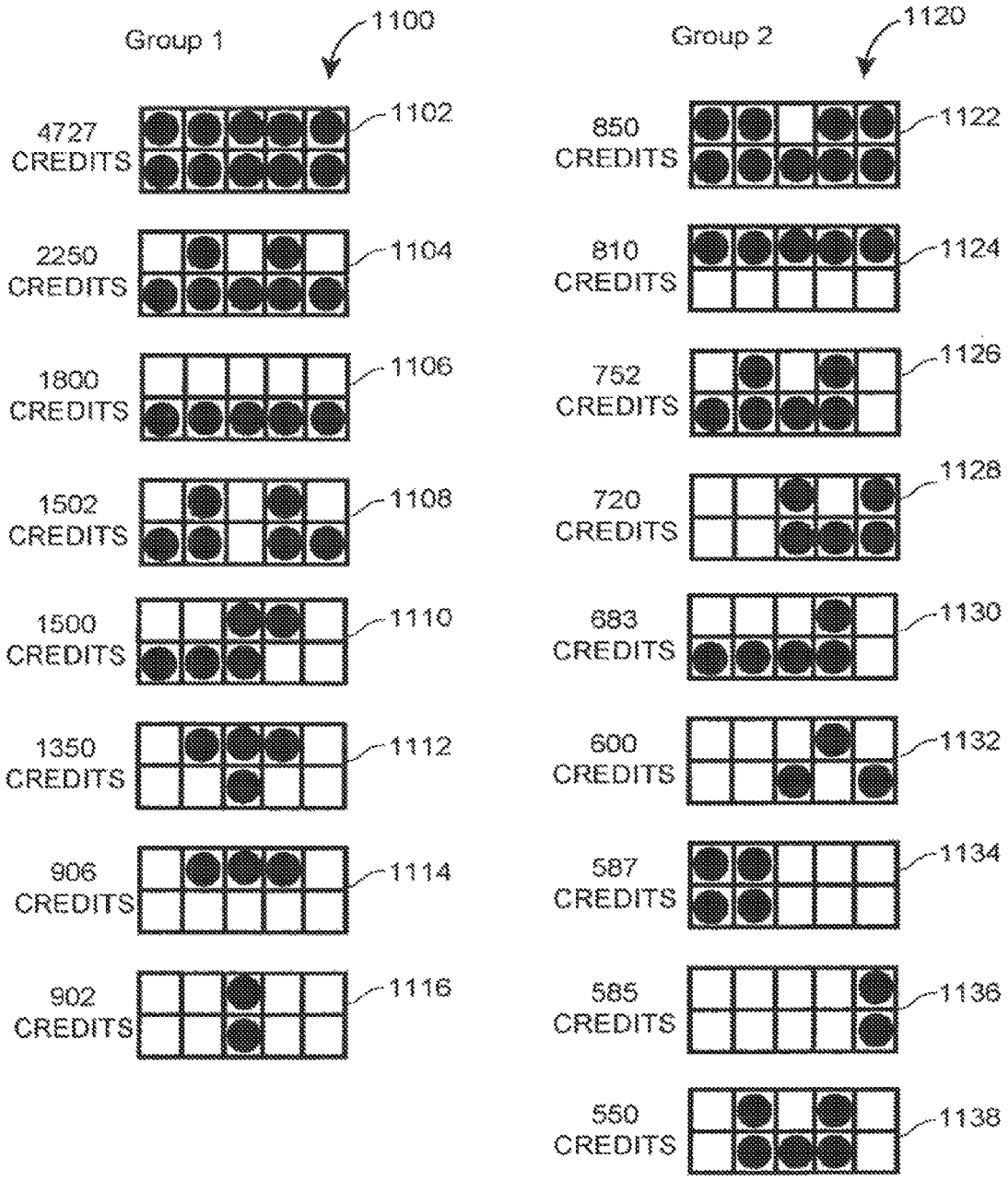
FIG. 29 is an illustration of sets of secondary patterns for a multi-player Bingo game with multi-level pattern mapping of award amounts.

As with the example above, the secondary patterns for the award amounts may correspond to the secondary Bingo cards 986 discussed above. FIG. 29 illustrates a first secondary pattern set 1100 of secondary patterns 1102-1116 that may be assigned to the award amounts in pay group 1 (which may correspond to matching a five-spot game-winning pattern within the first five drawn numbers), and the second secondary pattern set 1120 of secondary patterns 1122-1138 that may be assigned to the award amounts in pay group 2 (which may correspond to matching the five-spot game-winning pattern on the sixth, seventh or eighth drawn number). Similar secondary pattern sets may be assigned to the remaining pay groups 3-16. The odds of matching the secondary patterns may be approximately equal to the calculated odds of paying out a particular award amount from the pay group when the corresponding primary pattern is matched on a player's Bingo card. In each pay group, a secondary pattern may not be assigned to the lowest award amount in a pay group where the lowest award amount may be paid out if none of the secondary patterns of the pay group are matched.

Figure 30:
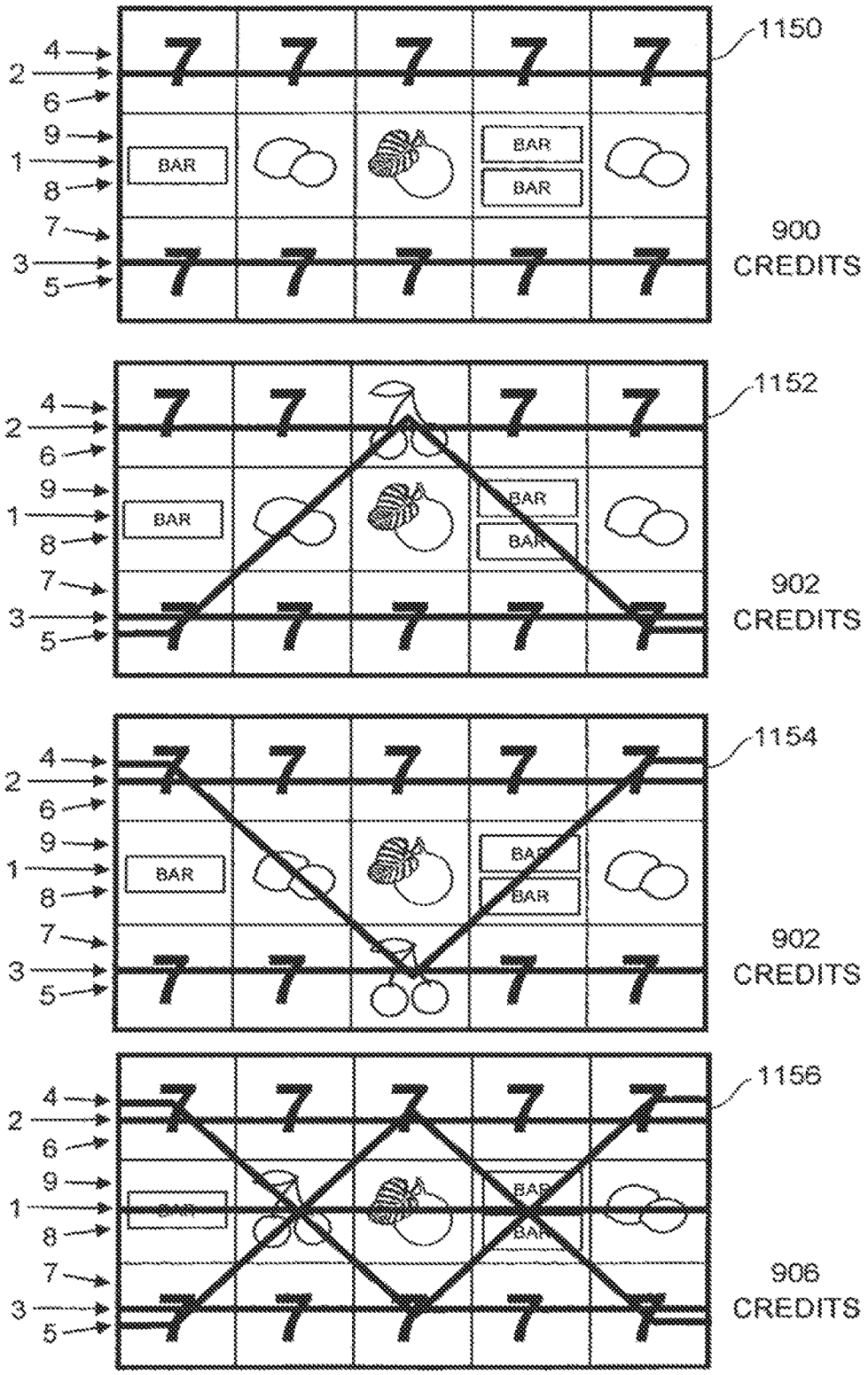
FIG. 30 is an illustration of possible slot machine reel stop positions corresponding to various award amounts.

As previously discussed, each award amount from the paytable may correspond to one or more outcomes of the casino game being simulated at the alternative outcome display. Several example reel stop positions 1150-1156 corresponding to award amounts from pay group 1 are illustrated in FIG. 30, and may be stored at gaming units 20 for display at the alternative outcome display. As discussed above, the example slot machine may include five reels with three symbols of each reel that would be generated by slot machine engine if the slot machine were being paid. Moreover, up to nine paylines may be used to evaluate combinations of symbols. The reel stop positions 1150, in which five "7's" are matched on payline 2 and payline 3, correspond to the 900 credit award amount of in pay group 1. When a player matches the five-spot game-winning pattern on the primary Bingo card with the first five drawn numbers; and does not match any of the secondary patterns 1102-1116 of secondary pattern set 1100 of FIG. 29 on the secondary Bingo card, the player may be awarded 900 credits. The gaming unit 20 selects the reel stop positions 1150 from the pool of slot machine outcomes, and causes the second display device 70 to stop the slot reels at the reel stop positions 1150 to simulate the appearance of a slot machine, and to display the outcome determined in the Bingo game.

The reel stop positions 1152, 1154 may both correspond to a 902 credit award amount; and both may be stored at the gaming units 20 in the pool of available slot machine outcomes. The cherry may be a wild card symbol combinable with other symbols to match the predetermined combination of symbols, or may pay an award of two credits even if no combinations are matched. Consequently, the cherry in the top row may complete the five "7's" for payline 2, and result in additional two credit awards on paylines 5 and 4, respectively, giving a total award of 902 credits. When a player matches the five-spot game-winning pattern on the primary Bingo card with the first five drawn numbers, and also matches the secondary pattern 1116 of secondary pattern set 1100 of FIG. 29 on the secondary Bingo card, the player may be awarded 902 credits; and the gaining unit 20 may randomly or sequentially select one of the reel stop positions 1152, 1154 for display at the second display device 70. The reel stop positions 1156 may correspond to a 906 credit award amount, with the wild card cherry resulting in two credit awards on each of paylines 1, 4 and 5. When a player matches the five-spot game-winning pattern on the primary Bingo card with the first five drawn numbers, and also matches the secondary pattern 1114 of secondary pattern set 1100 of FIG. 29 on the secondary Bingo card, the player may be awarded 906 credits, and the gaming unit 20 may select the real stop positions 1156 for display at the second display device 70.

If none of the primary patterns 1052-1080 are matched on the primary Bingo card, regardless of whether any secondary patterns for any pay groups are matched on the secondary Bingo card, no credits are awarded to the player and the gaming unit 20 may randomly or sequentially select an outcome from a pool of nonwinning reel stop positions for display at the second display device 70. Alternatively, the gaming unit 20 may be configured in any appropriate manner for generating nonwinning reel stop positions. For example, the gaming unit 20 may include an algorithm for randomly generating reel stop positions representative of game outcomes. When the gaming unit 20 determines that the player does not receive awards for the occurrence of the game, the algorithm may be executed to generate reel stop positions, with the generated reel stop positions being rejected and discarded until a non-winning set of reel stop positions is generated and displayed.

While the embodiment of an alternative outcome display illustrated and discussed herein may simulate the appearance of a slot machine, those skilled in the art will understand that other casino games may be simulated in an alternative outcome display, with the award amounts for the casino game's paytable being mapped to single or multiple levels of Bingo patterns. For example, the alternative outcome display may simulate the appearance of a video poker machine. The award amounts for the video poker machines may correspond to one or more poker hands. When particular Bingo patterns are matched by a player in an occurrence of the Bingo game resulting in the payout of an award amount, the gaming unit 20 may select an available poker hand corresponding to the award amount for display at the display device 70. Other casino games may be similarly mapped and simulated by the alternative outcome display in a similar manner. Moreover, the gaming units 20 may be programmed with a plurality of alternative outcome displays corresponding to a plurality of casino games, with the player being provided with the opportunity to select a desired one of the available alternative outcome displays.

In implementations of the multi-player Bingo game wherein players may purchase and enroll a plurality of cards for a given occurrence of the Bingo game, it may be impractical to provide a separate alternate outcome display for each card enrolled by the player in the occurrence of the Bingo game. Consequently, it may be desired to provide a single alternate outcome display representing the cumulative outcome for the player across all of the player's cards for the occurrence of the Bingo game. For example, if the player is playing three cards for an occurrence of the Bingo game, the player may still be provided with a single spinning reel presentation representing the cumulative result of the player's three cards for the occurrence of the Bingo game. As discussed above for the total award amount for the player matching a game-winning pattern and any interim patterns that may be offered on a single card, the total award amount across all of the players cards may be mapped to reel stop positions on the alternate outcome display corresponding to the total award amount won by the player for the occurrence of the Bingo game.

One complexity in mapping the outcomes from multiple Bingo cards to a spinning reel game or any other alternate outcome display with realistic game play characteristics is the need to match the desired win frequency based on the number of cards played in the occurrence of the Bingo game with the expected win frequency for the game represented by the alternate outcome display. Moreover, an accurate representation of the outcome of the Bingo game may require that the total wager equal to the number of cards enrolled by the player multiplied by the wager amount per card is also equal to the number of paylines of the alternate outcome display multiplied by the wager per payline. Because the number of paylines on which the player wagers in a spinning reel game may strongly influence the win frequency for the spinning reel game, and the number of cards enrolled by the player in the occurrence of the Bingo game may determine the expected win frequency for the player for the occurrence of the Bingo game, it may be possible to match the number of cards enrolled by a player and the corresponding expected win frequency to a corresponding number of paylines of a given spinning reel game that may yield a similar expected win frequency if the spinning reel game was implemented in Class III gaming unit. Consequently, selecting the number of cards to use for an occurrence of the Bingo game may dictate the number of paylines to be used in the spinning reel game alternate outcome display. For example, enrolling three cards in an occurrence of the Bingo game might dictate that the alternate outcome display may use five paylines on the spinning reel game to represent the outcome of the occurrence of the Bingo game.

As discussed above, the number of cards and corresponding number of paylines are chosen to best match the expected win frequency. For example, in a multi-card Bingo game wherein each occurrence of the game involves twelve Bingo cards, and in which a player may enroll up to six Bingo cards for an occurrence of the game, the expected win frequency ranges from 8⅓% for one card up to 50% for six cards. If a player enrolls three cards, the players expected win frequency may be 25%. Consequently, the outcome for the player enrolling three cards in the occurrence of the Bingo game should be mapped to an alternate outcome display also having approximately a 25% expected win frequency. For example, the outcome may be mapped to a spinning reel game in which five paylines are active such that the expected win frequency for the spinning reel game would be approximately 25%. The mapping may further be defined so as to maintain integer values of the basic currency used in wagering on the Bingo game. One example of a typical mapping of Bingo cards to paylines of a spinning reel game may be shown in Table 4 as follow:

TABLE 4

| Enrolled Bingo Cards | Spinning Reel Paylines |
|---|---|
| 1 | 1 |
| 2 | 3 |
| 3 | 5 |
| 4 | 10 |
| 6 | 20 |

For the particular spinning reel game and paytable used as the alternate outcome display for the Bingo game, the number of lines in the payline column of Table 4 may have an expected win frequency approximately equal to the corresponding number of cards in the left hand column of Table 4. For example, the five payline reel presentation may have an expected win frequency of approximately 25% corresponding to the approximate win frequency of three cards in a Bingo game having twelve total cards. Similarly, the one payline presentation for the given spinning reel game and paytable may have an approximate win frequency of 8⅓%, while the twenty payline reel presentation may have an approximate win frequency of 50%. Table 4 further illustrates that it may be necessary to prevent a player from enrolling a particular number of cards where the spinning reel game may not offer a corresponding number of paylines having approximately the same expected win frequency, or where the combination of cards and paylines may result in undesirable fractional awards (i.e. awarding fractions of cents).

The non-linear mapping of Bingo game cards to paylines may necessitate specific requirements for the available wagering denominations in order to maintain whole number awards, such as increments of a penny, regardless of the number of cards enrolled by the player and the number of winning cards for an occurrence of the Bingo game. To maintain the traditional flavor of the spinning reel game presentations and consistency with the games' glass-based paytables, the awards may be displayed to the players as an amount of credits. However, depending on the embodiment, the cash value per credit may vary with the number of cards and, consequently, the number of paylines, selected by the player. Additionally, the outcome of the Bingo game may be presented in cents. Further, depending upon the embodiment, the outcome of the Bingo game may be displayed in credits, though the cash value of the credits used to display the outcome of the Bingo game may not necessarily represent the same cash value as the credits used in the spinning reel presentation.

In order to accurately and realistically map the outcomes for a plurality of cards for an occurrence of the Bingo game to a corresponding number of paylines of the spinning reel game of the alternate outcome display, it may be necessary to match the total wager amount for the cards enrolled by the player in the occurrence of the Bingo game to the total wager amount for the corresponding simulated occurrence of the spinning reel game of the alternate outcome display. For example, if the player wagers a total of $3.00 on the enrolled cards, the alternate outcome display may illustrate a wager on the corresponding number of paylines for the spinning reel game totaling $3.00. Depending on the configuration of the Bingo game, the total amount wagered on the occurrence of the Bingo game may be matched to the total wager amount for the simulated spinning reel game by adjusting the variables used in the equations for determining the total wager amount for the Bingo game and the simulated spinning reel game.

In one embodiment, the multi-player Bingo game may be configured such that the total wager amount for an occurrence of the Bingo game is fixed regardless of the number of cards enrolled by the player. By using the fixed total wager amount, the wager amount per card may be determined by dividing the fixed total wager amount by the number of cards enrolled by the player, and the wager amount per payline may be calculated by dividing the fixed wager amount by the number of paylines corresponding to the number of cards enrolled by the player for the occurrence of the Bingo game. An example of an application of the fixed total wager amount may be illustrated in Table 5:

TABLE 5

| Bingo Cards | Wager Per Card | Total Bingo Wager | Paylines | Wager Per Payline | Total Payline Wager |
|---|---|---|---|---|---|
| 1 | $0.60 | $0.60 | 1 | $0.60 | $0.60 |
| 2 | $0.30 | $0.60 | 3 | $0.20 | $0.60 |
| 3 | $0.20 | $0.60 | 5 | $0.12 | $0.60 |
| 4 | $0.15 | $0.60 | 10 | $0.06 | $0.60 |
| 5 | $0.12 | $0.60 | 12 | $0.05 | $0.60 |
| 6 | $0.10 | $0.60 | 15 | $0.04 | $0.60 |

The player may be limited to wagering only the fixed total wager amount or, alternatively, the player may be permitted to wager multiples of the fixed total wager amount, with the wager amounts per card and per payline increasing correspondingly. For example, the player wagering $3.00 may enroll three cards at $1.00 per card and a corresponding five lines at $0.60 per payline, or enroll five cards at $0.60 per card with a corresponding twelve paylines at $0.25 per payline. Further, depending on the desired fixed total wager amount, it may be necessary or desirable to preclude a player from enrolling one or more of the number of cards in order to avoid the possibility of awarding the player fractions of a penny for a given occurrence of the Bingo game. It should also be noted that a particular spinning reel game and paytable used for as the alternate outcome display results in different numbers of paylines corresponding to the number of enrolled cards, the wager per payline may be correspondingly adjusted to result in the fixed total wager amount. Consequently, if twenty paylines correspond to six enrolled cards in the example above, the wager per payline may be $0.03 to match the $0.60 total wager amount.

While the player may be constrained to wagering the same total wager amount regardless of the number of cards enrolled in the occurrence of the Bingo game, the player may still have the flexibility through the number of cards enrolled in the game to achieve a desired or preferred payout characteristic over time. For example, the award structure for the Bingo game may be configured such that the amount of the award won by a player during an occurrence of the Bingo game is proportionate to the amount wagered per Bingo card. Consequently, a player wagering $0.60 on the occurrence of the wagering game may receive an award for matching a pattern on an enrolled card that may be six times greater when the player enrolls one card for $0.60 than when the player enrolls cards at $0.10 per card. However, despite while the latter player may stand to receive smaller awards for matching patterns, the player's expected win frequency may be increased correspondingly by enrolling more cards. Based on the number of cards enrolled in an occurrence of the game, the player may achieve a desired balance between the size of the potential award for matching a given pattern versus the probability of matching the pattern.

In another embodiment, the Bingo game may be configured to constrain the player a fixed wager amount per card enrolled in the Bingo game such that as the wager increases in increments of the fixed wager amount, the number of cards enrolled by the player increases correspondingly. One example of such a fixed wager per card wagering option may be illustrated in Table 6 as follows:

TABLE 6

| Bingo Cards | Wager Per Card | Total Bingo Wager | Paylines | Wager Per Payline | Total Payline Wager |
|---|---|---|---|---|---|
| 1 | $0.60 | $0.60 | 1 | $0.60 | $0.60 |
| 2 | $0.60 | $1.20 | 3 | $0.40 | $0.60 |
| | | | 5 | $0.24 | |
| 3 | $0.60 | $1.80 | 5 | $0.36 | $0.60 |
| | | | 9 | $0.20 | |
| 4 | $0.60 | $2.40 | 10 | $0.24 | $0.60 |
| | | | 15 | $0.16 | |
| 5 | $0.60 | $3.00 | 12 | $0.25 | $0.60 |
| | | | 10 | $0.30 | |
| | | | 20 | $0.15 | |
| 6 | $0.60 | $3.60 | 20 | $0.18 | $0.60 |

Table 6 further illustrates that different numbers of paylines may provide approximately the same expected win frequency for a given number of cards enrolled in the Bingo game depending on the particular spinning reel game and associated paytable used for the alternate outcome display. In this embodiment, because the same wager is made for each card enrolled by the player, the prize amounts awarded for matching patterns may be the same regardless of the number of cards enrolled by the player. At the same time, the players expected win frequency may still be increased proportionate to the number of cards enrolled by the player.

In a further embodiment, the Bingo game may be configured with a fixed wager per payline for the spinning reel game of the alternate outcome display, with the wager per card enrolled in the occurrence of the Bingo game varying accordingly. Table 7 illustrates one example wherein the fixed wager per payline is $0.60 as follows:

TABLE 7

| Bingo Cards | Wager Per Card | Total Bingo Wager | Paylines | Wager Per Payline | Total Payline Wager |
|---|---|---|---|---|---|
| 1 | $0.60 | $0.60 | 1 | $0.60 | $0.60 |
| 2 | $0.90 | $1.80 | 3 | $0.60 | $1.80 |
| 3 | $1.00 | $3.00 | 5 | $0.60 | $3.00 |
| 4 | $1.50 | $6.00 | 10 | $0.60 | $6.00 |
| 5 | $1.44 | $7.20 | 12 | $0.60 | $7.20 |
| 6 | $1.50 | $9.00 | 15 | $0.60 | $9.00 |

Depending on the spinning reel game and the paytable used in the alternate outcome display, the wager per card enrolled in the Bingo game may vary based on the number of paylines having approximately the same expected win frequency and corresponding total wager amount. For example, enrolling five cards in an occurrence of the Bingo game may correspond to nine paylines for a total wager amount of $5.40, or $1.08 per card, or to fifteen lines at a total wager amount of $9.00, or $1.80 per card. Moreover, the fixed wager per payline may be adjusted for players having varying preferences regarding how much to wager on a given occurrence of the Bingo game. For example, an alternative fixed wager per payline embodiment implementing lower wagering denominations as illustrated in Table 8 as follows:

TABLE 8

| Bingo Cards | Wager Per Card | Total Bingo Wager | Paylines | Wager Per Payline | Total Payline Wager |
|---|---|---|---|---|---|
| 1 | $0.06 | $0.06 | 1 | $0.06 | $0.06 |
| 2 | $0.09 | $0.18 | 3 | $0.06 | $0.18 |
| 3 | $0.10 | $0.30 | 5 | $0.06 | $0.30 |
| 4 | $0.15 | $0.60 | 10 | $0.06 | $0.60 |
| 5 | $0.18 | $0.90 | 15 | $0.06 | $0.90 |
| 6 | $0.20 | $1.20 | 20 | $0.06 | $1.20 |

As with the other embodiments, the awards available to a player and the expected win frequency for an occurrence of the Bingo game may be adjusted based on the wager amount per card and the total wager amount paid by the player. For example, as the wager amount per card enrolled in the game may increase as shown in Tables 7 and 8, the available awards for the Bingo game may increase proportionately, and the expected win frequency may increase as the number of cards enrolled in the occurrence of the game increases as previously discussed.

While the number of paylines or other parameters for a wagering game of the alternate outcome display have generally been described as being determined based on the number of Bingo cards selected by the player for an occurrence of the Bingo game, it will be understood that the player may alternatively select the playing parameters of wagering options for the wagering game of the alternate outcome display to achieve a desired expected win frequency or rate of return, the selection of which may determine the number of cards and associated wager amount per card for the player for the occurrence of the wagering game. The gaming unit 20 may be configured to allow the player to enter wagering options for the wagering game of the alternate outcome display. For example, the player may be allowed to select a number of paylines on which to wager and a wager amount per payline for the spinning reel game of Table 8. Is this example, the player may make selections for the spinning reel game to play ten paylines at $0.30 per payline for a total wager of $3.00. Per Table 8, the selections for the spinning reel game may dictate that the player will play four cards for the occurrence of the Bingo game at $0.75 per card so that the player may have approximately the same expected win frequency and rate of return as if the player were actually playing the spinning reel game. Configured in this way, the player may better able to select desired expected win frequencies and rates of return when the alternate outcome display is a wagering game with which the player may be familiar.

Regardless of the method of matching the total wager amount for the cards enrolled in the Bingo game to the total wager amount for the corresponding paylines of the alternate outcome display, or whether the total wager amounts are matched, once the outcome for the player for the occurrence of the Bingo game is determined, the outcome may be mapped to a corresponding outcome of the spinning reel game of the alternate outcome display simulating the player wagering on a corresponding number of paylines, with the combination of awards won on the paylines of the alternate outcome display yielding a total award amount corresponding to the player's combined outcome for the card or cards played by the player during the occurrence of the Bingo game.

The preceding describes an alternate outcome display of a single secondary wagering game having a plurality of wagering options corresponding to the wagering options (number of cards, wager per card, and the like) for the player for the Bingo game. Alternatively, the alternate outcome display may have a plurality of wagering games that may be used to display outcomes corresponding to the outcomes of the Bingo game. In one embodiment, a different wagering game may be provided as an alternate outcome display for each wagering option for the player for the Bingo game, with the wagering game associated with a wagering option having approximately the same expected win frequency. For example, a player may be permitted to have between one and six cards for an occurrence of the Bingo game, with each number of cards having a corresponding wagering game that may be displayed as the alternate outcome display. A player playing a single card may have an alternate outcome display of a spinning reel game with a wager on one payline, while a player playing two cards may have an alternate outcome display of a video poker game having approximately the same expected win frequency, and so on. As with the spinning reel game displays described above, once the outcome is determined for the player for the occurrence of the Bingo game, an outcome for the wagering game corresponding to the number of cards played by the player may be determined and displayed as the alternate outcome display.

While the preceding text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

The invention is claimed as follows:

1. A method of operating a gaming system, said method comprising:

(a) causing at least one processor to execute a plurality of instructions stored in at least one memory device to enroll a plurality of players of a plurality of gaming devices for an occurrence of a multiplayer wagering game, wherein said occurrence of the multiplayer wagering game includes a predetermined total number of game arrays and each game array includes a different combination of indicia of a set of game indicia;

(b) for each enrolled real player, providing said enrolled real player with one or more of the game arrays for said occurrence of the multiplayer wagering game;

(c) causing the at least one processor to execute the plurality of instructions to randomly select game indicia from the set of game indicia;

(d) for each randomly selected game indicium, for each enrolled player, causing the at least one processor to execute the plurality of instructions to determine whether said randomly selected game indicium matches any of the game indicia of the game arrays of said enrolled player and cause at least one display device of the gaming device of said enrolled player to display any said matches; and (e) for each enrolled player, causing the at least one processor to execute the plurality of instructions to:

(i) determine a game outcome for said play of the multiplayer wagering game based on any matched game indicia of the game arrays of said enrolled player, wherein a credit balance is increasable based on any award associated with the determined game outcome for said play of the multiplayer wagering game, said credit balance being increasable via an acceptor of a physical item associated with a monetary value, and said credit balance being decreasable via a cashout device;

(ii) cause the at least one display device of the gaming device of said enrolled player to display an outcome of a second wagering game, wherein:

(A) the outcome of the second wagering game corresponds to the game outcome of the multiplayer wagering game for said enrolled player, (B) the second wagering game has a plurality of wagering options, (C) a number of game arrays of said enrolled player corresponds to one of said wagering options, (D) the displayed outcome of the second wagering game is an outcome for the wagering option corresponding to the number of game arrays of said enrolled player, and (E) the credit balance is increasable based on any award associated with the outcome of the second wagering game; and (iii) map a win frequency of achieving the game outcome of the multi-player wagering game with a win frequency of achieving the outcome of the second wagering game.

2. The method of claim 1, wherein the second wagering game is a spinning reel game associated with a plurality of paylines, and each wagering option is associated with a number of the paylines on which wagers are made.

3. The method of claim 2, wherein a wager amount per payline is equal to a fixed wager amount per payline regardless of the number of game arrays for the player for the occurrence of the multi-player wagering game.

4. The method of claim 2, which includes, for each enrolled player, enabling said enrolled player to select a number of the paylines, and causing the at least one processor to execute the plurality of instructions to provide a number of game arrays corresponding to the selected number of the paylines to said enrolled player.

5. The method of claim 2, wherein, for each enroller player, a wager amount per game array is equal to a fixed wager amount per game array regardless of the number of game arrays provided to said enrolled player.

6. The method of claim 2, which includes, for each enrolled player, enabling said enrolled player to select one of the plurality of wagering options, and causing the at least one processor to execute the plurality of instructions to provide the number of game arrays corresponding to the selected wagering option to said enrolled player.

7. The method of claim 1, which includes causing the at least one processor to execute the plurality of instructions to:

determine whether any of the game arrays include a pattern of matched game indicia that matches a secondary pattern; and for each enrolled real player having at least one game array including a pattern of matched game indicia that matches the secondary pattern, determine a secondary award for said enrolled real player.

8. The method of claim 1, which is provided through a data network.

9. The method of claim 8, wherein the data network is an internet.

* * * * *